US012495854B2

(12) United States Patent
Stone et al.

(10) Patent No.: US 12,495,854 B2
(45) Date of Patent: Dec. 16, 2025

(54) IMPACT ABSORBING STRUCTURES FOR ATHLETIC HELMET

(71) Applicant: VICIS IP, LLC, New York, NY (US)

(72) Inventors: Andre H.P. Stone, Seattle, WA (US); Anton P. Alferness, Seattle, WA (US); Mike Czerski, Seattle, WA (US); Jason Neubauer, Seattle, WA (US); Adam Frank, Seattle, WA (US)

(73) Assignee: VICIS IP, LLC, New York, NY (US)

( * ) Notice: Subject to any disclaimer, the term of this patent is extended or adjusted under 35 U.S.C. 154(b) by 0 days.

(21) Appl. No.: 18/778,889

(22) Filed: Jul. 19, 2024

(65) Prior Publication Data

US 2024/0415223 A1 Dec. 19, 2024

Related U.S. Application Data

(60) Division of application No. 17/228,667, filed on Apr. 12, 2021, now Pat. No. 12,102,159, which is a continuation of application No. 15/644,756, filed on Jul. 8, 2017, now Pat. No. 10,973,272, which is a (Continued)

(51) Int. Cl.
*A42B 3/06* (2006.01)
*A42B 3/12* (2006.01)

(52) U.S. Cl.
CPC ..... *A42B 3/063* (2013.01); *A42B 3/064* (2013.01); *A42B 3/065* (2013.01); *A42B 3/125* (2013.01)

(58) Field of Classification Search
CPC ..... A42B 3/069; A42B 3/066; A42B 3/063; A42B 3/065; A42B 3/06; A42B 3/12; A42B 3/124
See application file for complete search history.

(56) References Cited

U.S. PATENT DOCUMENTS 3,447,163 A 6/1969 Tojeiro et al.
3,617,416 A 11/1971 Kromrey
4,283,864 A 8/1981 Lipfert
(Continued)

FOREIGN PATENT DOCUMENTS

CN 1291263 4/2001
CN 101513287 8/2009
(Continued)

OTHER PUBLICATIONS

Qi, H.J., Boyce, M.C. "Stress-Strain Behavior of Thermoplastic Polyurethanes," 2005, Mechanics of Materials 37, pp. 817-839.

*Primary Examiner* — Patrick J. Lynch
(74) *Attorney, Agent, or Firm* — Ingrassia Fisher & Lorenz, LLP

(57) ABSTRACT

A helmet includes an outer shell, an impact absorbing layer positioned inside the outer shell, and a foam layer interior to the impact absorbing layer. The impact absorbing layer includes a plurality of impact absorbing structures positioned inside the outer shell, wherein at least a portion of the outer shell is flexible to transmit an impact force to a localized section of the plurality of impact absorbing structures. One or more of the plurality of impact absorbing structures include a plurality of filaments, wherein ends of at least some of the filaments are joined at a node and the at least some of the filaments are capable of buckling and absorbing energy when subjected to the impact force.

22 Claims, 41 Drawing Sheets

Related U.S. Application Data continuation-in-part of application No. 15/399,034, filed on Jan. 5, 2017, now abandoned.

(60) Provisional application No. 62/276,793, filed on Jan. 8, 2016.

(56) References Cited

U.S. PATENT DOCUMENTS

| | | | |
|---|---|---|---|
| 4,412,358 | A | 11/1983 | Lavender |
| 4,558,470 | A | 12/1985 | Mitchell et al. |
| 5,204,998 | A | 4/1993 | Liu |
| 5,950,243 | A | 9/1999 | Winters |
| 5,956,777 | A | 9/1999 | Popovich |
| 6,029,962 | A | 2/2000 | Shorten et al. |
| 6,397,399 | B1 | 6/2002 | Lampe |
| 6,530,564 | B1 | 3/2003 | Julien |
| 6,871,525 | B2 | 3/2005 | Withnall et al. |
| 6,969,548 | B1 | 11/2005 | Goldfine |
| 7,089,602 | B2 | 8/2006 | Talluri |
| D582,608 | S | 12/2008 | Palmer |
| 7,516,597 | B1 | 4/2009 | Roose |
| 7,677,538 | B2 | 3/2010 | Darnell et al. |
| 8,528,118 | B2 | 9/2013 | Ide et al. |
| 8,615,826 | B2 | 12/2013 | Michael |
| 8,640,267 | B1 | 2/2014 | Cohen |
| 8,661,564 | B2 | 3/2014 | Dodd |
| 8,961,733 | B2 | 2/2015 | Dodd |
| 9,116,428 | B1 | 8/2015 | Jacobsen |
| D752,822 | S | 3/2016 | Bologna |
| 9,375,041 | B2 | 6/2016 | Plant |
| D787,748 | S | 5/2017 | Bologna |
| 9,788,591 | B2 | 10/2017 | Ide et al. |
| 9,839,251 | B2 | 12/2017 | Pannikottu et al. |
| 10,136,692 | B2 | 11/2018 | Ide et al. |
| 10,159,296 | B2 | 12/2018 | Pietrzak et al. |
| D844,255 | S | 3/2019 | Bologna |
| 10,258,100 | B1 | 4/2019 | Erb |
| 10,271,605 | B2 | 4/2019 | Withnall et al. |
| 10,342,281 | B2 | 7/2019 | Fischer et al. |
| 10,342,283 | B2 | 7/2019 | Glover et al. |
| 10,362,829 | B2 | 7/2019 | Lowe |
| D856,600 | S | 8/2019 | Withnall et al. |
| 10,376,000 | B2 | 8/2019 | Desnoyers |
| 10,433,609 | B2 | 10/2019 | Reinhall et al. |
| 10,506,841 | B2 | 12/2019 | Bologna et al. |
| 10,561,193 | B2 | 2/2020 | Withnall et al. |
| 10,780,338 | B1 | 9/2020 | Bologna et al. |
| 10,813,402 | B2 | 10/2020 | Posner et al. |
| 10,813,403 | B2 | 10/2020 | Vanhoutin et al. |
| 10,856,600 | B2 | 12/2020 | Ide et al. |
| 10,932,514 | B2 | 3/2021 | Ide et al. |
| 10,948,898 | B1 | 3/2021 | Pietrzak et al. |
| D916,385 | S | 4/2021 | Withnall et al. |
| 10,966,479 | B2 | 4/2021 | Browd et al. |
| 10,973,272 | B2 | 4/2021 | Stone et al. |
| D927,084 | S | 8/2021 | Bologna et al. |
| 11,166,511 | B2 | 11/2021 | Infusing et al. |
| 11,167,198 | B2 | 11/2021 | Bologna et al. |
| 11,213,736 | B2 | 1/2022 | Bologna et al. |
| 11,241,059 | B2 | 2/2022 | Stone et al. |
| 11,291,263 | B2 | 4/2022 | Lowe |
| 11,311,067 | B2 | 4/2022 | Bologna et al. |
| 11,399,589 | B2 | 8/2022 | Bologna et al. |
| 11,419,383 | B2 | 8/2022 | Pietrzak et al. |
| 11,445,777 | B2 | 9/2022 | Fischer et al. |
| 11,503,872 | B2 | 11/2022 | Bologna et al. |
| 11,571,036 | B2 | 2/2023 | Stone et al. |
| 11,638,457 | B2 | 5/2023 | Lowe |
| 11,712,615 | B2 | 8/2023 | Bologna et al. |
| 2002/0017805 | A1 | 2/2002 | Carroll |
| 2002/0060462 | A1 | 5/2002 | Glance |
| 2004/0168246 | A1 | 9/2004 | Phillips |
| 2006/0064900 | A1 | 3/2006 | Aveni |
| 2006/0070171 | A1 | 4/2006 | Copeland et al. |
| 2007/0083965 | A1 | 4/2007 | Darnell |
| 2008/0113143 | A1 | 5/2008 | Taylor |
| 2009/0139159 | A1 | 6/2009 | Hill |
| 2010/0223730 | A1 | 9/2010 | Pearce |
| 2010/0258988 | A1 | 10/2010 | Darnell et al. |
| 2011/0113559 | A1 | 5/2011 | Dodd |
| 2011/0143080 | A1 | 6/2011 | Ortiz |
| 2011/0229685 | A1 | 9/2011 | Lin |
| 2011/0250385 | A1 | 10/2011 | Sypeck |
| 2011/0265238 | A1 | 11/2011 | Choi et al. |
| 2012/0141750 | A1 | 6/2012 | Taylor |
| 2012/0198604 | A1 | 8/2012 | Weber |
| 2012/0233745 | A1 | 9/2012 | Veazie |
| 2012/0266365 | A1 | 10/2012 | Cohen |
| 2013/0061371 | A1 | 3/2013 | Phipps et al. |
| 2013/0122256 | A1 | 5/2013 | Kleiven et al. |
| 2013/0185837 | A1 | 7/2013 | Phipps et al. |
| 2013/0234376 | A1 | 9/2013 | Frey et al. |
| 2013/0305435 | A1 | 11/2013 | Surabhi |
| 2013/0333100 | A1 | 12/2013 | Erb et al. |
| 2013/0340147 | A1 | 12/2013 | Giles |
| 2014/0004322 | A1 | 1/2014 | Kim |
| 2014/0007322 | A1 | 1/2014 | Marz et al. |
| 2014/0090155 | A1 | 4/2014 | Johnston |
| 2014/0101816 | A1 | 4/2014 | Toronjo |
| 2014/0196198 | A1 | 7/2014 | Cohen |
| 2014/0252674 | A1 | 9/2014 | Hundley |
| 2015/0000018 | A1 | 1/2015 | Brandt |
| 2015/0033453 | A1 | 2/2015 | Pannikottu |
| 2015/0059063 | A1 | 3/2015 | Ho |
| 2015/0072103 | A1 | 3/2015 | Tresso et al. |
| 2015/0075697 | A1 | 3/2015 | Gildersleeve |
| 2015/0223546 | A1 | 8/2015 | Cohen |
| 2015/0223547 | A1 | 8/2015 | Wibby |
| 2015/0257471 | A1 | 9/2015 | Warmouth |
| 2015/0272255 | A1 | 10/2015 | Galaitsis et al. |
| 2015/0285697 | A1 | 10/2015 | O'Bier et al. |
| 2015/0305430 | A1 | 10/2015 | Rush et al. |
| 2016/0039168 | A1 | 2/2016 | Mankame |
| 2016/0255900 | A1 | 9/2016 | Browd et al. |
| 2016/0270473 | A1 | 9/2016 | Warmouth |
| 2016/0278470 | A1 | 9/2016 | Posner et al. |
| 2016/0302496 | A1* | 10/2016 | Ferrara ..... A42B 3/128 |
| 2016/0327113 | A1* | 11/2016 | Shelley ..... B32B 27/20 |
| 2016/0346997 | A1 | 12/2016 | Lewis |
| 2017/0007751 | A1 | 1/2017 | Hartwell |
| 2017/0196291 | A1 | 7/2017 | Glover et al. |
| 2017/0231322 | A1 | 8/2017 | Gheorghian et al. |
| 2017/0360156 | A1 | 12/2017 | Lussier |
| 2018/0058531 | A1 | 3/2018 | Schaedler |
| 2018/0071979 | A1 | 3/2018 | Achten |
| 2018/0132556 | A1 | 5/2018 | LaPerriere et al. |
| 2018/0140037 | A1 | 5/2018 | Frieder, Jr. et al. |
| 2018/0184732 | A1 | 7/2018 | Plant |
| 2018/0184745 | A1 | 7/2018 | Stone |
| 2018/0341286 | A1 | 11/2018 | Markovsky |
| 2019/0014850 | A1 | 1/2019 | Johnson |
| 2019/0075876 | A1 | 3/2019 | Burek |
| 2019/0104792 | A1 | 4/2019 | Diamond |
| 2019/0111658 | A1 | 4/2019 | Gupta |
| 2019/0145740 | A1 | 5/2019 | Czerski et al. |
| 2019/0231018 | A1 | 8/2019 | Boutin |
| 2019/0313732 | A1 | 10/2019 | Russell |
| 2020/0113267 | A1 | 4/2020 | Light |
| 2020/0130324 | A1 | 4/2020 | Chuang |
| 2021/0023775 | A1 | 1/2021 | Poelma |
| 2021/0316501 | A1 | 10/2021 | Boyce |
| 2023/0010873 | A1 | 1/2023 | Storey |

FOREIGN PATENT DOCUMENTS

| | | |
|---|---|---|
| CN | 103263108 | 8/2013 |
| CN | 203152622 | 8/2013 |
| EP | 1793697 | 6/2007 |
| EP | 2922431 | 9/2015 |
| GB | 1578351 | 11/1980 |
| GB | 2518668 | 6/2001 |
| JP | 3025480 | 6/1996 |
| JP | 2001171448 | 6/2001 |
| JP | 2007254920 | 10/2007 |

(56) References Cited

FOREIGN PATENT DOCUMENTS

| | | | | |
|---|---|---|---|---|
| WO | 2010076257 | | 7/2010 | |
| WO | 2015002986 | | 1/2015 | |
| WO | 2015044687 | | 4/2015 | |
| WO | WO-2015069800 | A2 * | 5/2015 | ..... A42B 3/046 |
| WO | 2015089646 | | 6/2015 | |
| WO | 2015103634 | | 7/2015 | |
| WO | 2016154364 | | 9/2016 | |
| WO | 2017033022 | | 3/2017 | |
| WO | 2019152992 | A1 | 8/2019 | |
| WO | 2019200409 | A1 | 10/2019 | |
| WO | 2019237025 | A1 | 12/2019 | |

* cited by examiner

IMPACT ABSORBING STRUCTURES FOR ATHLETIC HELMET

CROSS-REFERENCE TO RELATED APPLICATIONS

This application is a division of U.S. patent application Ser. No. 17/228,667, filed Apr. 12, 2021, which is a continuation of U.S. patent application Ser. No. 15/644,756, entitled "Laterally Supported Filaments," filed on Jul. 8, 2017, which is a continuation-in-part application of U.S. patent application Ser. No. 15/399,034 entitled "Impact Absorbing Structures for Athletic Helmet," filed Jan. 5, 2017, which claims the benefit of U.S. Provisional Application No. 62/276,793 entitled "Impact Absorbing Structures for Athletic Helmet," filed Jan. 8, 2016, the disclosures of which are both incorporated by reference herein in their entireties.

TECHNICAL FIELD

The present invention relates to devices, systems and methods for improving protective clothing such as helmets and protective headgear, including improvements in impact absorbing structures and materials to reduce the deleterious effects of impacts between the wearer and other objects. In various embodiments, improved filament arrays are disclosed that can reduce acceleration/deceleration and/or disperse impact forces on a protected item, such as a wearer. Various designs include modular, semi-custom or customized components that can be assembled and/or integrated into new and/or existing protective clothing designs for use in all types of wearer activities (i.e., sports, military, equestrian, etc.).

BACKGROUND

Impact absorbing structures can be integrated into protective clothing or other structures to desirably prevent and/or reduce the effect of collisions between stationary and/or moving objects. For example, an athletic helmet typically protects a skull and various other anatomical regions of the wearer from collisions with the ground, equipment, other players and/or other stationary and/or moving objects, while body pads and/or other protective clothing seeks to protect other anatomical regions. Helmets are typically designed with the primary goal of preventing traumatic skull fractures and other blunt trauma, while body pads and ballistic armors are primarily designed to cushion blows to other anatomical regions and/or prevent/resist body penetration by high velocity objects such as bullets and/or shell fragments. Some protective clothing designs primarily seek to reduce the effects of blunt trauma associated with impacts, while other designs primarily seek to prevent and/or reduce "sharp force" or penetration trauma, including trauma due to the penetration of objects such as bullets, knives and/or shell fragments into a wearer's body. In many cases, a protective clothing design will seek to protect a wearer from both blunt and sharp force injuries, which often involves balancing of a variety of competing needs including weight, flexibility, breathability, comfort and utility (as well as many other considerations).

For example, a helmet will generally include a hard, rounded shell with cushioning inside the shell (and typically also includes a retention system to maintain the helmet in contact with the wearer's head). When another object collides with the helmet, the rounded shape desirably deflects at least some of the force tangentially, while the hard shell desirably protects against object penetration and/or distributes some amount of the impact forces over a wider area of the head. The impact absorbing structures, which typically contact both the inner surface of the helmet shell and an outer surface of the wearer's head, then transmits this impact force (at varying levels) to the wearer's head, which may involve direct contact between the hard shell and the head for higher impact forces.

A wide variety of impact absorbing structures have been utilized over the millennia, including natural materials such as leathers, animal furs, fabrics and plant fibers. Impact absorbing structures have also commonly incorporated flexible membranes, bladders, balloons, bags, sacks and/or other structures containing air, other gases and/or fluids. In more recent decades, the advent of advanced polymers and foaming technologies has given rise to the use of artificial materials such as polymer foams as preferred cushion materials, with a wide variety of such materials to choose from, including ethyl vinyl acetate (EVA) foam, polyurethane (PU) foam, thermoplastic polyurethane (TPU) foam, lightweight foamed EVA, EVA-bound blends and a variety of proprietary foam blends and/or biodegradable foams, as well as open and/or closed cell configurations thereof.

While polymer foams can be extremely useful as cushioning structures, there are various aspects of polymer foams that can limit their usefulness in many impact-absorption applications. Polymer foams can have open- or closed-cell structures, with their mechanical properties dependent on their structure and the type of polymer of which the cells are made. For open-cell foams, the mechanisms of cell edge and micro-wall deformations are also major contributors to the mechanical properties of the foam, while closed cell mechanical properties are also typically affected by the pressure of gases or other substance(s) present in the cells. Because polymer foams are made up of a solid (polymer) and gas (blowing agent) phase mixed together to form a foam, the dispersion, shape and/or directionality of the resulting foam cells are typically irregular and fairly random, which causes the foam to provide a uniform (i.e., non-directionally dependent) response to multi-axial loading. While useful from a general "cushioning" and global "force absorption" perspective, this uniform response can greatly increase the challenge of "tailoring" a polymer foam to provide a desired response to an impact force coming from different loading directions. Stated in another way, it is often difficult to alter a foam's response in one loading mode (for example, altering the foam's resistance to axial compression) without also significantly altering its response to other loading modes (i.e., the foam's resistance to lateral shear forces).

The uniform, multi-axial response of polymer foams can negatively affect their usefulness in a variety of protective garment applications. For example, some helmet designs incorporating thick foam compression layers have been successful at preventing skull fractures from direct axial impacts, but these thick foam layers have been less than successful in protecting the wearer's anatomy from lateral and/or rotational impacts (and can also allow a significant degree of concussive impacts to occur). While softening the foam layers could render the foam more responsive to lateral and/or rotational impacts, this change could also reduce the compressive response of the foam layer, potentially rendering the helmet unable to protect the wearer from impact induced trauma and/or additional brain concussions.

The balancing of force response needs becomes especially true where the thickness of a given compressive foam layer is limited by the cushioning space available in the protective garment, such as between an inner helmet surface and an outer surface of a wearer's skull. In many applications, it is desirous to minimize helmet size and/or weight, which can require a limited foam layer thickness and/or reduced weight foam layer which may be unable to protect the wearer from various impact induced brain concussions. A concussion can occur when the skull changes velocity rapidly relative to the enclosed brain and cerebrospinal fluid. The resulting collision between the brain and the inner surface of the skull in various helmet designs can result in a brain injury with neurological symptoms such as memory loss. Although the cerebrospinal fluid desirably cushions the brain from small forces, the fluid may not be capable of absorbing all of the energy from collisions that arise in sports such as football, hockey, skiing, and biking. Even where the helmet design may include sufficient foam cushioning to dissipate some energy absorbed by the hard shell from being transmitted directly to and injuring the wearer, this cushioning is often insufficient to prevent concussions from very violent collisions or from the cumulative effects of many lower velocity collisions.

SUMMARY

Various aspects of the present invention include the realization of a need for improved impact absorbing structures, including custom or semi-custom laterally supported buckling structures and/or various types of macroscopic support structures for replacing and/or augmenting various impact absorbing structures within helmets, footwear and other protective clothing. In various embodiments, the incorporation of specific designs and configurations of support elements can significantly improve the performance, strength, utility and/or usability of the impact absorbing structure, can reduce structure weight and/or enable or facilitate the use of materials in impact absorbing structures that were heretofore useless, suboptimal and/or marginally useful in existing designs.

In various embodiments, an impact absorbing structure can comprise an array of longitudinally-extending vertical filaments, columns and/or other buckling structures attached to a first face sheet, with each vertical filament incorporating a wall, web or thin sheet of material extending laterally to at least one adjacent filament. In various embodiments, the extending lateral walls can be thinner than the diameter of the vertical filaments, with the lateral walls desirably acting as reinforcing members and/or "lateral buckling sheets" that can inhibit buckling, bending and/or other deformation of some portion of the vertical filaments in one or more desired manners. By incorporating lateral walls between the vertical filaments of the impact absorbing array, the individual vertical filaments can potentially be reduced in diameter and/or spaced further apart to create an impact absorbing array of laterally reinforced vertical filaments having an equivalent compressive response to that of a larger diameter and/or higher density array of unsupported vertical filaments. Moreover, in various embodiments the response of the array to lateral and/or torsional loading can be effectively "uncoupled" from its axial loading response to varying degrees, with the axial loading response primarily dependent upon the diameter, density and/or spacing of the vertical filaments in the array and the lateral/torsional loading response dependent upon the orientation, location and/or thicknesses of the lateral walls.

In various exemplary embodiments, an impact absorbing array can incorporate an array of vertically oriented filaments incorporating lateral walls positioned in a "repeated polygon" structural element configuration, in which the lateral walls between filaments are primarily arranged to extend in repeating geometric patterns, such as triangles, squares, pentagons, hexagons, septagons, octagons, nonagons and/or decagons. In various other embodiments, the lateral walls may be arranged in one or more repeated geometric configurations, such as parallel or converging/diverging lines, crisscrossing figures, cross-hatches, plus signs, curved lines, asterisks, etc. In other embodiments, various combinations thereof, including non-repeated configurations and/or outlier connections in repeating arrays (i.e., including connections to filaments at the edge of an impact absorbing array or filament bed) can be utilized.

In one exemplary embodiment, an impact absorbing structure can be created wherein filaments in the vertically orientated filament array are connected by lateral walls positioned in a hexagonal polygonal configuration. In one exemplary embodiment, each filament can be connected by lateral walls to two adjacent filaments, with an approximately 120-degree separation angle between the two lateral walls connecting to each filament, leading to a surprisingly stable array configuration that can optionally obviate the need and/or desire for a second face sheet proximate to an upper end of the filaments of the array. The absence of a second face sheet on the array can greatly facilitate manufacture of the array using a variety of manufacturing methods, including low-cost and/or high throughout manufacture by injection molding, compression molding, casting, transfer molding, thermoforming, blow molding and/or vacuum forming. If desired, the first face sheet (i.e., the lower face sheet) can be pierced, holed, webbed, latticed and/or otherwise perforated, which may further reduce weight and/or material density of the face sheet (and weight/density of the overall array) as well as facilitate bending, curving, shaping and/or other flexibility of the array at room temperatures to accommodate curved, spherical and/or irregularly shaped regions such as the inside surface of a helmet and/or within flexible clothing. Such flexible arrays can also reduce manufacturing costs, as they can be manufactured in large quantities in a flat-plane configuration and then subsequently cut and bent or otherwise shaped into a wide variety of desired shapes.

The incorporation of lateral walls in the filament bed, which can desirably allow a commensurate reduction in the diameter of the filaments and/or an as increased filament spacing, can also greatly reduce the height at which the array will "bottom out" under compressive and/or axial loading, which can occur when the filament columns of the array have completely buckled and/or collapsed (i.e., the array is "fully compressed"), and the collapsed filament material and bent wall materials can fold and "pile up" to form a relatively solid layer of material resisting further compressive loading. As compared to an impact absorbing array of conventional columnar filament design, an improved impact absorbing array incorporating lateral walls can be reduced to half as tall (i.e., 50% of the offset) as the conventional array, yet provide the same or equivalent impact absorbing performance, including providing an equivalent total amount of layer deflection to that allowed by the conventional filament array. Specifically, where a traditional 1 inch tall filament column array may compress ½ inch before "bottoming out" (as the filament bed becomes fully compressed at 0.5 inches height), one exemplary embodiment of an improved filament array incorporating lateral wall support that is 0.7 inches tall can compress ½ inch before bottoming out (as the filament bed becomes fully compressed at 0.25 inches height). This arrangement provides for equivalent and/or improved axial array performance in a reduced profile or "offset" as compared to the traditional filament array design.

In various embodiments, an improved impact absorbing array can incorporate various "draft" or tapered features, which can facilitate removal of the filaments and wall structures from an injection mold or other manufacturing equipment as well as potentially improve the performance of the array. In one exemplary embodiment incorporating a hexagonal wall/filament configuration, the outer and inner walls of the hexagonal elements (and/or the outer and inner walls of the filaments) may be slightly canted and/or tapered to facilitate ejection of the array from the mold. In various embodiments, the walls and/or filaments will desirably include at least 0.5 degrees of draft on all vertical faces, which may more desirably be increased to 2 to 3 degrees or greater for various components. In various alternative embodiments, a tapered form for the wall/filament configuration (i.e., the polygonal elements) could include frustum forms for such elements (i.e., the portion of a solid-such as a cone or pyramid-that lies between one or two parallel planes cutting it), including circular, oval, triangular, square, pentagonal, hexagonal, septagonal and octagonal frustum forms.

In various embodiments, the improved impact absorbing structures may be customized and retrofitted into one or more commercially available helmets, footwear and/or other protective clothing. Various specifications (e.g., mechanical characteristics, behavioral characteristics, the configuration profile, fit and/or aesthetics) can be provided to customize or semi-customize the impact absorbing structures. If desired, the original liner or material layers can be removed from the commercially available helmet, footwear, and/or protective equipment, and replaced with the customized impact absorbing structures described herein.

In various embodiments, a helmet can include one or more generally concentric shells, with an improved impact absorbing structure positioned proximate to an inner surface of at least one shell. Where more than one shell is provided, the impact absorbing structure may be disposed between shells. If provided, an inner shell may be somewhat rigid to protect against skull fracture and the outer shell may also somewhat rigid to spread impact forces over a wider area of the impact absorbing structures positioned inside the outer shell, or the outer shell may be more flexible such that impact forces locally deform the outer shell to transmit forces to a smaller, more localized section of the impact absorbing structures positioned inside the outer shell.

In various embodiments, improved impact absorbing structures can be secured between generally concentric shells and desirably have sufficient strength to resist forces from mild collisions. However, the impact absorbing structures will also desirably undergo deformation (e.g., buckling) when subjected to forces from a sufficiently strong impact force. As a result of this deformation, the impact absorbing structures desirably attenuate and/or reduce the peak force transmitted from the outer shell to the inner shell, thereby desirably reducing forces on the wearer's skull and brain. The impact absorbing structures may also allow the outer shell to move independently of the inner shell in a variety of planes or directions. Thus, impact absorbing structures can greatly reduce the incidence and severity of concussions or other injuries as a result of sports and other activities. When the outer and inner shell move independently from one another, rotational acceleration, which contributes to concussions, may also be reduced.

The impact absorbing structures may include improved impact absorbing members mechanically secured between the outer shell and the inner shell, and/or between the outer shell and skull (i.e., head) of the wearer. In one example embodiment, an improved impact absorbing member can comprise an array of columns or filaments having one end secured to an outer shell, with laterally supporting walls extending between adjacent columns (which could optionally include an opposite end of the columns secured to the inner shell). In an alternative embodiment, an improved impact absorbing member can comprise an array of columns having one end secured to an inner shell, with laterally supporting walls extending between adjacent columns (which could optionally include an opposite end of the columns secured or not secured to the outer shell).

In various embodiments, an improved impact absorbing member includes a plurality of vertical filaments joined by connecting walls or sheets to form a branched, closed and/or open polygonal shape, or various combinations thereof in a single array. By varying the length, width, and attachment angles of the filaments, the axial impact performance can desirably be altered, while varying the length, width, and attachment angles of the walls or sheets can desirably alter the lateral and/or torsional impact performance of the array. In various embodiments, the helmet manufacturer can control the threshold amounts and/or directions of force that results in filament/wall deformation and ultimate helmet performance.

In various embodiments, the improved impact absorbing structure may be secured to only one of the shells. When deformation occurs, the impact absorbing structure can contact an opposite shell or an impact absorbing structure secured to the opposite shell. Once the impact absorbing structure makes contact, the overall stiffness of the helmet may increase, and the impact absorbing structure desirably deforms to absorb energy. For example, ends of intersecting arches, bristles, or jacks could be attached to the inner shell, the outer shell, or both.

The impact absorbing structures may also be packed between the inner and outer shells without necessarily being secured to either the inner shell or outer shell. The space between the impact absorbing structures may be filled with air or a cushioning material (e.g., foam) that further absorbs energy and prevents the impact absorbing structures from rattling if they are not secured to either shell. The packed arrangement of the impact absorbing structures can potentially simplify manufacturing without reducing the overall effectiveness of the helmet. If desired, such impact absorbing elements could be manufactured individually using a variety of techniques, including by extrusion, and then the elements could be subsequently assembled into arrays.

The helmet may include modular rows to facilitate manufacturing. A modular row can include an inner surface, an outer surface, and impact absorbing structures positioned between the inner and outer surfaces. A modular row can be relatively thin and/or flat compared to the assembled helmet, which may reduce the complexity of forming the impact absorbing structures between the modular row's inner and outer surfaces. For example, the modular rows may be formed by injection molding, extrusions, fusible core injection molding, or a lost wax process, techniques which may not be feasible for molding the entire impact absorbing structures in its final form. When assembled, the inner surfaces of the modular rows may form part of the inner shell, and the outer surfaces of the modular rows may form part of the outer shell. Alternatively or additionally, the modular rows may be assembled between an innermost shell and an outermost shell that laterally secure the modular rows and radially contain them. Alternatively or additionally, adjacent rows may be laterally secured to each other.

DETAILED DESCRIPTION

Modular Helmet

Figure 1:
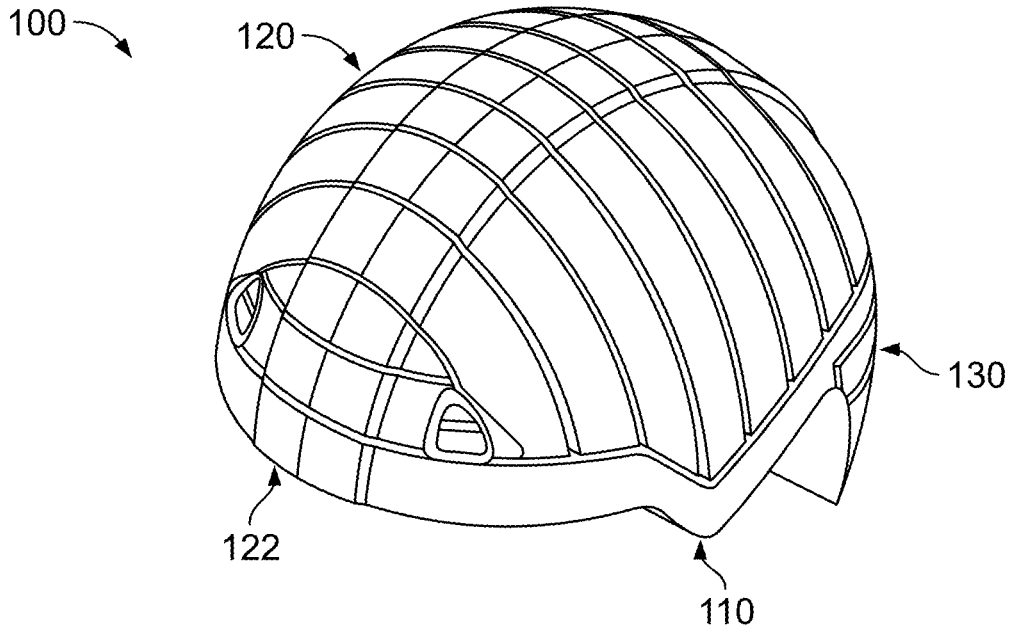
FIG. 1 is a perspective view of an assembly of impact absorbing structures formed from modular rows, in accordance with an embodiment.

FIG. 1 is a perspective view of an assembly 100 of impact absorbing structures formed from modular rows 110, 120, and 130, in accordance with an embodiment. In general, a modular row includes an inner surface, an outer surface, and impact absorbing structures between the inner surface and the outer surface. The modular row may further include a protective layer (e.g., foam) more and/or less rigid than the impact absorbing structures that encloses a remaining volume between the inner surface and outer surface after formation of the impact absorbing structures. When a helmet including the assembly 100 is worn, the inner surface is closer to the user's skull than the outer surface. Optionally, the modular row includes end surfaces connecting the short edges of the inner surface to the short edges of the outer surface. The inner surface, outer surface, and end surfaces form a slice with two parallel flat sides and an arc or bow shape on two other opposing sides. The end surfaces may be parallel to each other or angled relative to each other. The modular rows include one or more base modular rows 110, crown modular rows 120, and rear modular rows 130. The assembly 100 may include further shells, such as an innermost shell, an outermost shell, or both, that secure the modular rows relative to each other and capture the structure between the innermost and outermost shells when assembled for durability and impact resistance.

The base modular row 110 encircles the wearer's skull at approximately the same vertical level as the user's brow. The crown modular rows 120 are stacked horizontally on top of the base modular row 110 so that the long edges of the inner and outer surfaces form generally parallel vertical planes. The end surfaces of the crown modular rows 120 rest on a top plane of the base modular row. The outer surfaces of the crown modular rows 120 converge with the outer surface of the base modular row 110 to form a rounded outer shell. Likewise, the inner surfaces of the crown modular rows 120 converge with the inner surface of the base modular row 110 to form a rounded inner shell. Thus, the crown modular rows 120 and base modular row 110 form concentric inner and outer shells protecting the wearer's upper head. The outer surface of a crown modular row 120 may form a ridge 122 raised relative to the rest of the outer surface. The ridge 122 may improve distribution of impact forces or facilitate a connection between two halves (e.g., left and right halves) of an outermost layer of a helmet including assembly 100.

The rear modular rows 130 are stacked vertically under a rear portion of the base modular row 110 so that the long edges of the inner and outer surfaces form generally parallel horizontal planes. The inner surface of the topmost rear modular row 130 can form a seam with the inner surface of the base modular row 110, and the outer surface of the topmost rear modular row 130 can form a seam with the outer surface of the base modular row 110. Thus, the rear modular rows 130 and the rear portion of the base modular row 110 can form concentric inner and outer shells protecting the wearer's rear lower head and upper neck.

Modular Row

Figure 2:
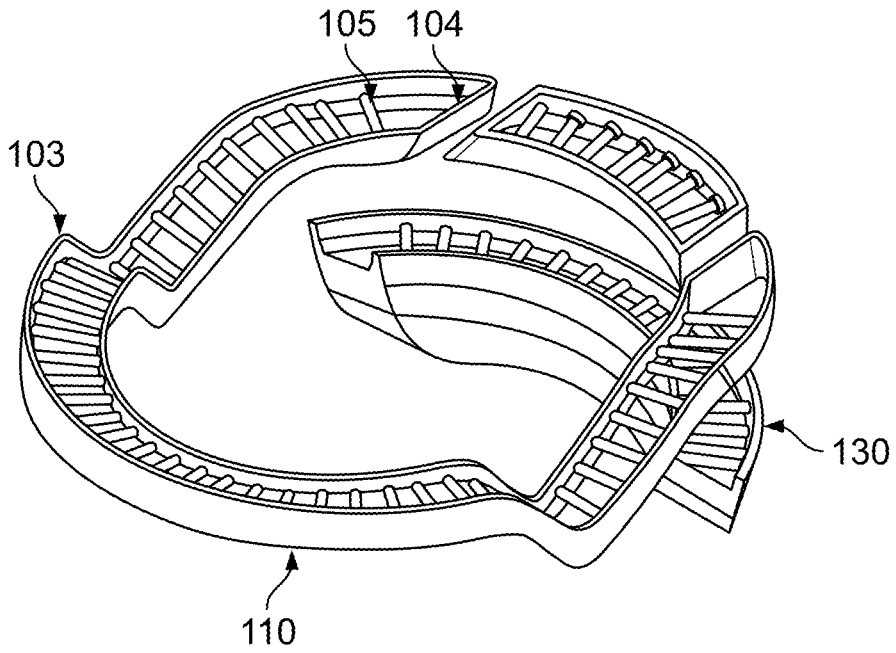
FIG. 2 is a perspective view of a modular row, in accordance with an embodiment.

FIG. 2 is a perspective view of a base modular row 110, in accordance with an embodiment. The base modular row 110 can includes two concentric surfaces 103 (e.g., an inner surface and an outer surface), end surfaces, and impact absorbing structures 105.

As illustrated, the impact absorbing structures 105 are columnar impact absorbing members which can be mechanically secured to both concentric surfaces 103. An end of the impact absorbing structure 105 may be mechanically secured to a concentric surface 103 as a result of integral formation, by a fastener, by an adhesive, by an interlocking end portion (e.g., a press fit), another technique, or a combination thereof. An end of the impact absorbing member can be secured perpendicularly to the local plane of the concentric surface 103 in order to maximize resistance to normal force. However, one or more of the impact absorbing members may be secured at another angle to modify the resistance to normal force or to improve resistance to torque due to friction between an object and the outermost surface of a helmet including assembly 100. The critical force that buckles the impact absorbing member may increase with the diameter of the impact absorbing member, and may also decrease with the length of the impact absorbing member.

In various embodiments described herein, an impact absorbing member can have a circular cross section that desirably simplifies manufacture and can eliminate significant stress concentrations occurring along edges of the structure, but other cross-sectional shapes (e.g., squares, hexagons) may be employed to alter manufacturability and/or modify performance characteristics. Generally, an impact absorbing structure will be formed from a compliant, yet strong material such as an elastomeric substrate such as hard durometer plastic (e.g., polyurethane, silicone) and may include a core and/or outer surface of a softer material such as open or closed-cell foam (e.g., polyurethane, polystyrene) or may be in contact with a fluid or gas (e.g., air). After forming the impact absorbing members, a remaining volume between the concentric surfaces 103 (that is not filled by the impact absorbing members) may be filled with a softer material, such as foam or a fluid or gas (e.g., air).

The concentric surfaces 103 are desirably curved to form an overall rounded shape (e.g., spherical, ellipsoidal) when assembled into a helmet shape. The concentric surfaces 103 and end surfaces 104 may be formed from a material that has properties stiffer than the impact absorbing members such as hard plastic, foam, metal, or a combination thereof, or they may be formed from the same material as the impact absorbing members. To facilitate manufacturing of the base modular row 110, a living hinge technique may be used. The base modular row 110 may be manufactured as an initially flat modular row, where the long edges of the concentric surfaces 103 form two parallel planes. For example, the base modular row 110 could be formed by injection molding the concentric surfaces 103, the end surfaces 104, and the impact absorbing structures 105. The base modular row 110 may then be bent to form a living hinge. The living hinge may be created by injection molding a thin section of plastic between adjacent structures. The plastic can be injected into the mold such that the plastic fills the mold by crossing the hinge in a direction transverse to the axis of the hinge, thereby forming polymer strands perpendicular to the hinge, thereby creating a hinge that is robust to cracking or degradation.

Figure 3:
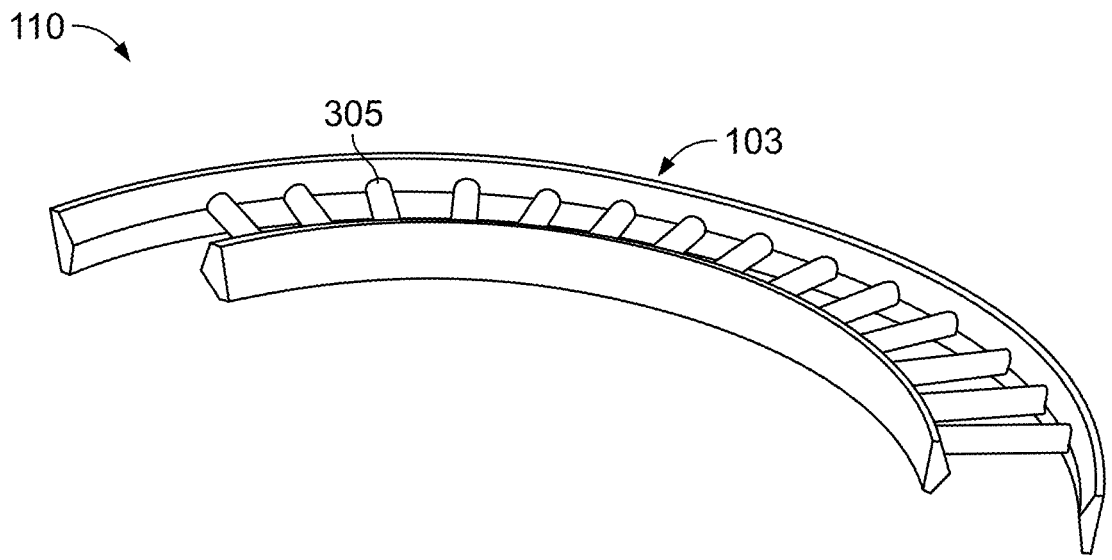
FIG. 3 is a perspective view of a modular row, in accordance with an embodiment.

FIG. 3 is a perspective view of a modular row 110, in accordance with an embodiment. The modular row 110 has a beveled edge with a cross-section that tapers from a base to an edge along which the impact absorbing members 305 are secured. For example, the modular row 110 has a pentagonal cross section where the impact absorbing members 305 are mechanically secured along an edge formed opposite the base of the pentagonal cross-section. The pentagon has two perpendicular sides extending away from the base of the pentagon to two sides that converge at an edge to which the impact absorbing members 305 are secured. As another example, the modular row 110 may have a triangular cross section (e.g., isosceles triangle), and the impact absorbing members 305 can be secured along an edge opposite the base of the triangular cross-section. Relative to a rectangular cross-section, the tapered cross-section can reduce the mass to secure the impact absorbing members 305 to the base of the modular row 110. The base of the modular row 110 may be generally wider than an impact absorbing member 305 in order to form a shell when assembled with adjacent modular rows 110. The general benefit of forming the base of the rows in this manner is to increase moldability of these structures.

Branched Impact Absorbing Members

Figure 4:
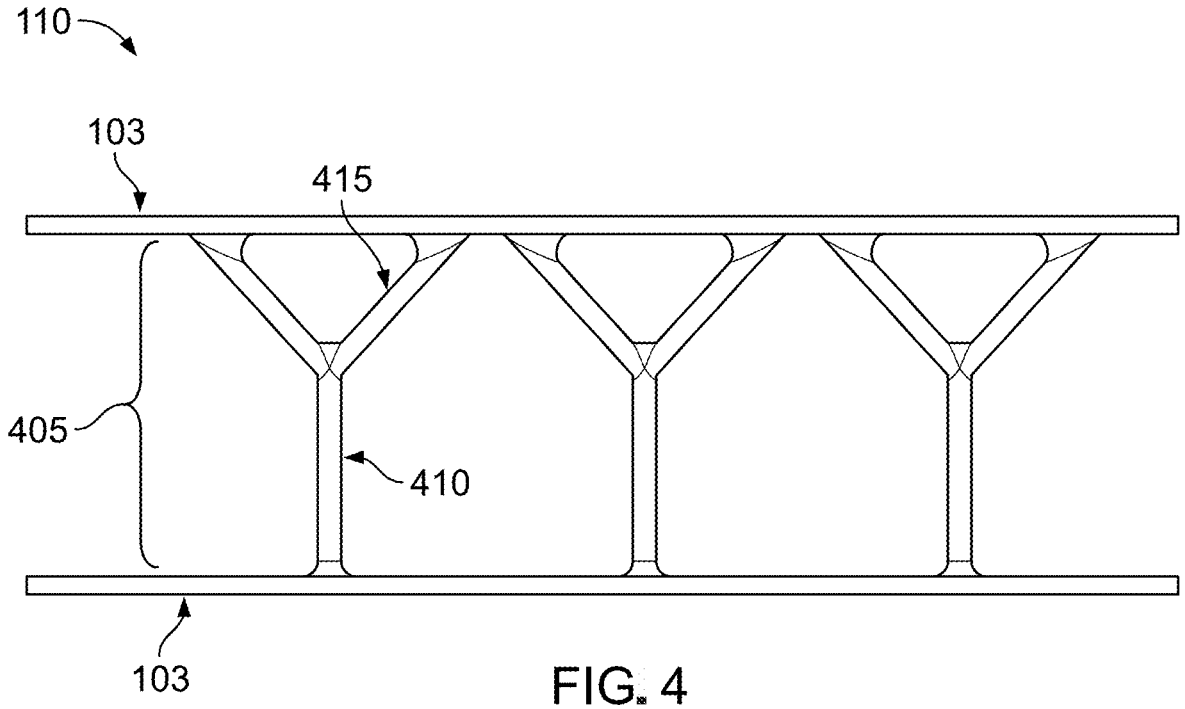
FIG. 4 is a plan view of an impact absorbing member having a branched shape, in accordance with an embodiment.

FIG. 4 is a plan view of an impact absorbing member 405 having a branched shape, in accordance with an embodiment. The impact absorbing member 405 includes a base portion 410 and at least two branched portions 415. The base portion 410 (e.g. filament or column) and the branched portions 415 (e.g., filaments or columns) are joined at one end creating a one or more nodes. Opposite ends of the branched portions 415 can be secured to one of the concentric surfaces 103, and the opposite end of the base portion 410 can be secured to an opposite one of the concentric surfaces. Varying the angle between the branched portions 415 can modify the critical force to buckle the impact absorbing member 405. For example, increasing the angle between the branched portions 415 may decrease the critical force. Generally, the angle between the branched portions 415 is between 30° and 120°. The impact absorbing structure 405 may include additional branched portions 415. For example, impact absorbing structure 405 could include three branched portions 415, one of which may be parallel to the base portion 410.

Impact Absorbing Structures Including Intersecting Arches

Figure 5A:
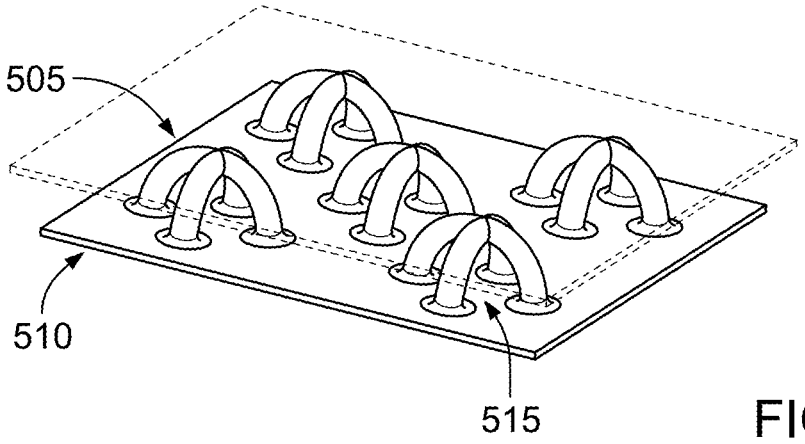
FIG. 5A is a perspective view of impact absorbing structures including intersecting arches, in accordance with an embodiment.

FIG. 5A is a perspective view of impact absorbing structures 505 including intersecting arches, in accordance with an embodiment. In the illustrated example, an impact absorbing structure 505 includes two arches which each form half a circle. The portions intersect perpendicular to each other at an apex of the impact absorbing structure 505. However, other variations are possible, such as an impact absorbing structure 505 including three arches intersecting at angles of about 60°, four arches intersecting at angles of about 45°, or a single arch. In general, having two or more intersecting arches causes the impact absorbing structure 505 to have a more uniform rigidity and yield stress from torques having different lateral directions relative to a single arch. As another example, the impact absorbing structure 505 may form a dome having a uniform resistance to torques from different lateral directions, but use of distinct intersecting arches may decrease the weight of the impact absorbing structure 505. Compared to a dome, the gaps between the arches in the impact absorbing structure 505 desirably facilitate injection of foam or another less rigid material inside of the impact absorbing structure 505 to further dissipate energy.

The ends of the arches are desirably mechanically secured to the surface 510, which may be a concentric surface 103 of a modular row or an inner or outer shell. The surface 510 may form an indentation 515 having a cross-sectional shape corresponding to (and aligned with) a projection of the impact absorbing structure 505 onto the surface 510. The indentation extends at least partway through the surface 510. For example, the indentation 515 has a cross-section of a cross to match the perpendicularly intersecting arches of the impact absorbing structure 505 secured above the indentation. When the impact absorbing structure 505 deforms as a result of a compressive force, the impact absorbing structure 505 may deflect into the indentation 515. As a result, the impact absorbing member 505 has a greater range of motion, resulting in absorption of more energy (from deformation) and slower deceleration. Without the indentation 515, a compressive force could cause the impact absorbing structure 505 to directly contact the surface 510, resulting in a sudden increase in stiffness and/or "bottoming out" of the structure, which could limit further gradual deceleration of the impact absorbing structure 505.

Figure 5B:
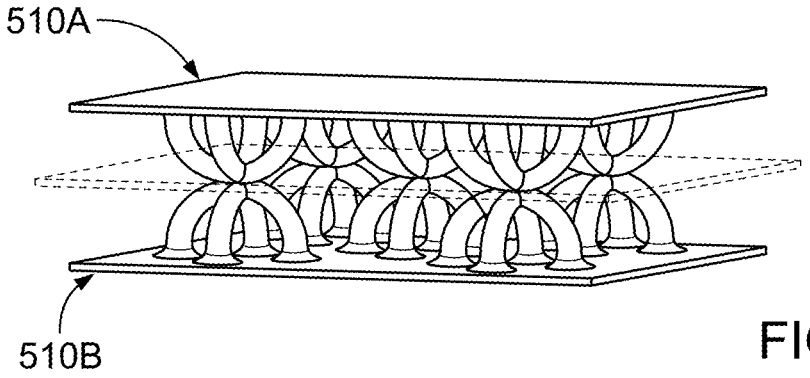
FIG. 5B is a perspective view of an opposing arrangement of the impact absorbing structures of FIG. 5A, in accordance with an embodiment.

FIG. 5B is a perspective view of an opposing arrangement of the impact absorbing 505 structures of FIG. 5A, in accordance with an embodiment. An upper set of impact absorbing structures 505 is secured to an outer surface 510A, and a lower set of impact absorbing structures 515 is secured to an inner surface 510B. The impact absorbing structures 505 may be aligned to horizontally overlap apexes of opposing impact absorbing structures 505, or the impact absorbing structures 505 may be aligned to horizontally offset apexes of impact absorbing structures 505 on the outer surface 510A and inner surface 510B. In the vertically aligned arrangement, the distance between the inner and outer surfaces can be increased, which can provide more room for deformation of the impact absorbing structures 505 to absorb energy from a collision. In the offset arrangement, the distance between the inner and outer surfaces 510 can be reduced, and the area of contact between oppositely aligned impact absorbing structures 505 increased. Although the outer surface 510A and the inner surface 510B are illustrated as being planar, they may be curved, as in a modular row or a concentric shell arrangement. In such a case, the outer surface 510A may include more impact absorbing structures 505 than the inner surface 510B, or the impact absorbing structures 505 of the outer surface 510A may be horizontally enlarged relative to those on the inner surface 510B.

Figure 5C:
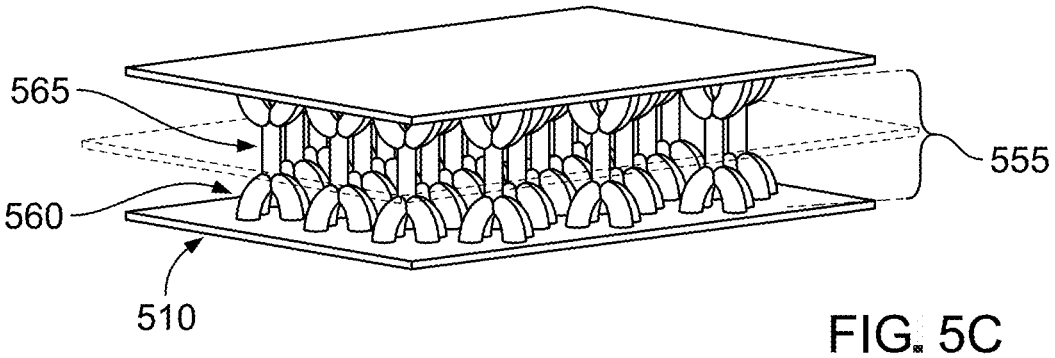
FIG. 5C is a perspective view of impact absorbing structures including intersecting arches connected by a column, in accordance with an embodiment.

FIG. 5C is a perspective view of impact absorbing structures 555 including intersecting arches 560 connected by a column 565, in accordance with an embodiment. The intersecting arches 560 may be intersecting arches, such as the impact absorbing structures 505. The column 565 may be similar to the impact absorbing members 105 and 305. As illustrated, the opposite ends of a column 565 may be perpendicularly connected (or connected at other angles and/or alignments) to two vertically aligned intersecting arches 560. Because the columns 565 are subject to different types of deformation relative to the intersecting arches (e.g., buckling and deflection), the impact absorbing structure 555 may have two or more critical forces that result in deformation of different components of the impact absorbing structure 555. In this way, the impact absorbing structure 555 may dissipate energy from a collision in multiple stages through multiple mechanisms. In other embodiments, the impact absorbing structures 505 and 555 may include any of the impact absorbing structures described with respect to FIGS. 6A through 8C.

Packed Impact Absorbing Structures

Figure 6A:
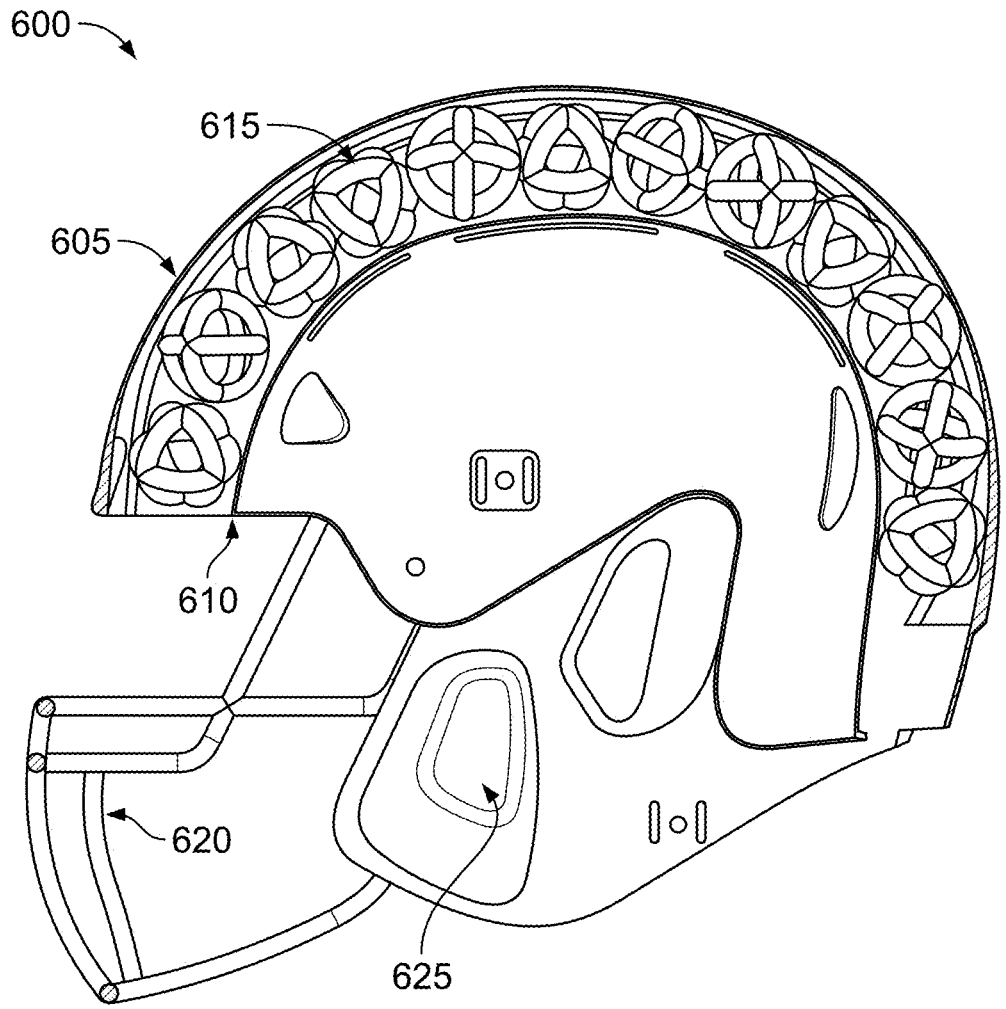
FIG. 6A is a cross-sectional view of a helmet including impact absorbing structures having a spherical wireframe shape, in accordance with an embodiment.
Figure 6B:
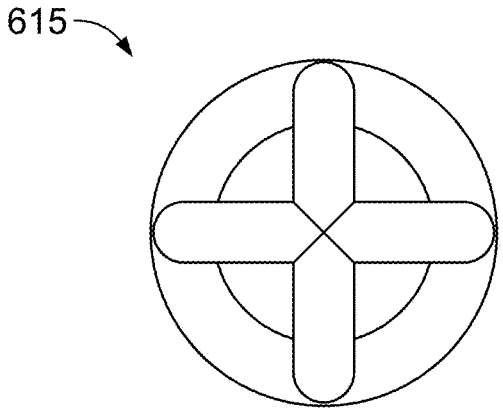
FIG. 6B is a plan view of an impact absorbing structure included in the helmet of FIG. 6A, in accordance with an embodiment.
Figure 6C:
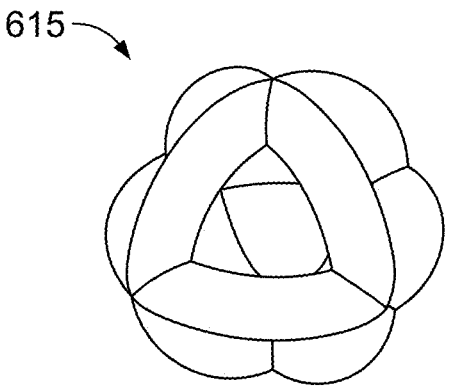
FIG. 6C is a perspective view of an impact absorbing structure included in the helmet of FIG. 6A, in accordance with an embodiment.

FIG. 6A is a cross-sectional view of a helmet 600 including impact absorbing structures 615 having a spherical wireframe shape, in accordance with another embodiment. FIG. 6B is a plan view of the impact absorbing structural element 615 included in the helmet 600, in accordance with an embodiment. FIG. 6C is another perspective view of the impact absorbing structure 615 included in the helmet 600, in accordance with an embodiment.

The helmet 600 includes an outer shell 605, an inner shell 610, and impact absorbing structures 615 disposed between the outer shell 605 and the inner shell 610. The impact absorbing structures 615 can be formed from perpendicularly interlocked rings that together form a spherical wireframe shape. Although the illustrated impact absorbing structures 615 include three mutually orthogonal rings, other structures are possible. For example, the number of longitudinal rings may be increased to improve the uniformity of the impact absorbing structure's response to forces from different directions. However, increasing the number of rings may also increase the weight of the impact absorbing structure 615 and/or may decrease the spacing between the rings, which might hinder filling an internal volume of the impact absorbing structure 615 with a less rigid material such as foam.

The helmet 600 further includes a facemask 620, which desirably protects a face of the wearer while allowing visibility, and vent holes 625, which desirably improve user comfort by enabling air circulation proximate to the user's skin. For example, the helmet 600 may incorporate vent holes 625 near the user's ears to improve propagation of sound waves. The vent holes 625 may further serve to reduce moisture and sweat accumulating in the helmet 600. In some embodiments, the helmet may include a screen or mesh (e.g., using polymeric and/or metal wire) placed over one or both vent holes 625 to desirably reduce penetration by particles (e.g., soil, sand, snow) and to prevent penetration by blunt objects during collisions.

Figure 7A:
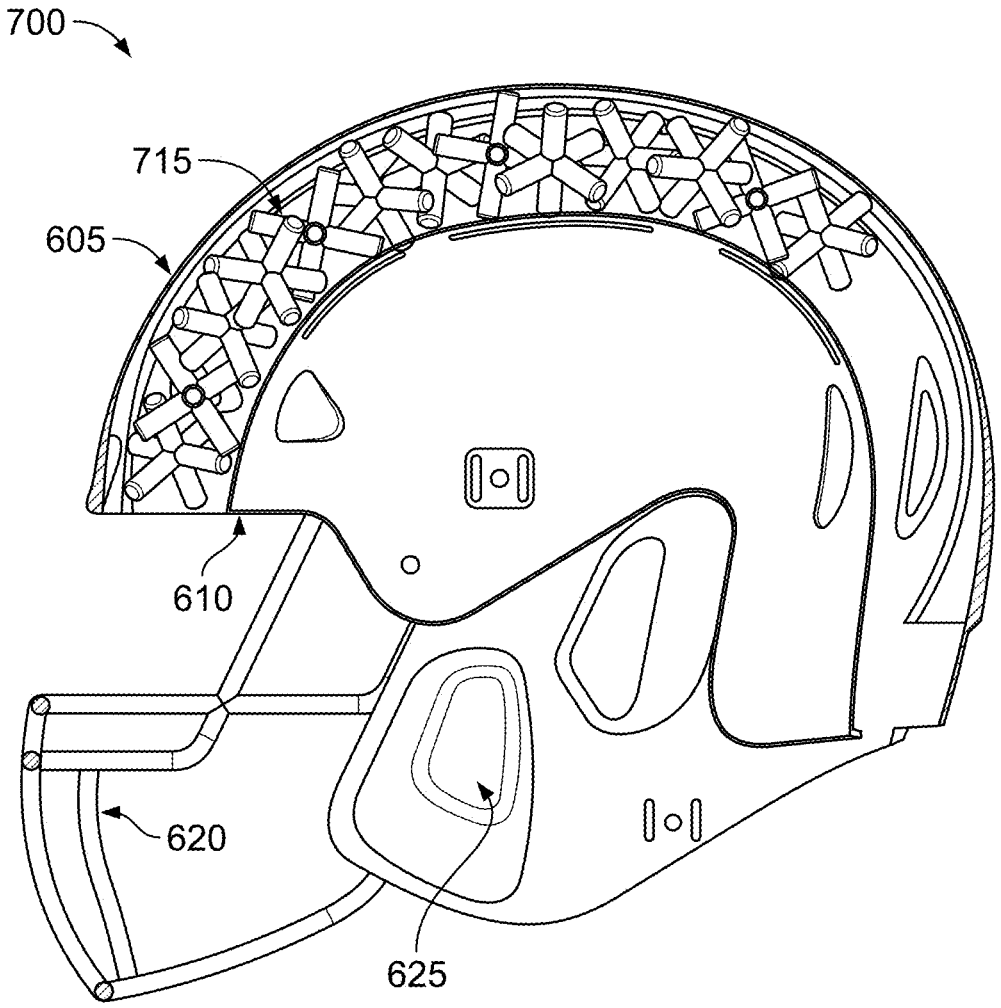
FIG. 7A is a cross-sectional view of a helmet including impact absorbing structures having a jack shape, in accordance with an embodiment.
Figure 7B:
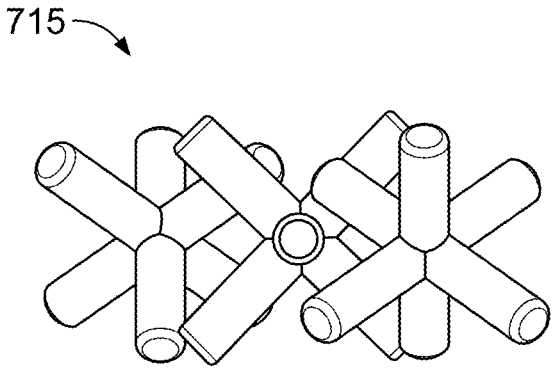
FIG. 7B is a plan view of an impact absorbing structure included in the helmet of FIG. 7A, in accordance with an embodiment.
Figure 7C:
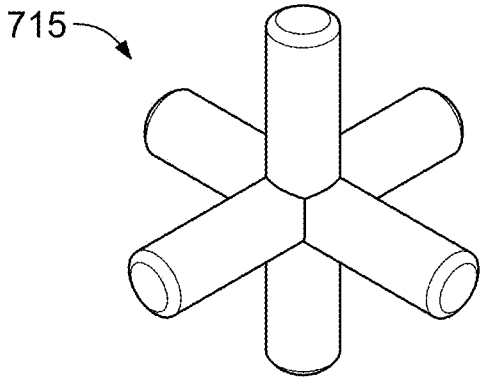
FIG. 7C is a perspective view of an impact absorbing structure included in the helmet of FIG. 7A, in accordance with an embodiment.

FIG. 7A is a cross-sectional view of a helmet 700 including impact absorbing structures 715 having a jack-like shape, in accordance with another embodiment. FIG. 7B is a plan view of the impact absorbing structure 715 included in the helmet 700, and FIG. 7C is a perspective view of the impact absorbing structure 715 included in the helmet 700, in accordance with this embodiment.

As disclosed, the helmet 700 can include an outer shell 605, an inner shell 610, a plurality of impact absorbing structures 715 disposed between the outer shell 605 and the inner shell 610, a face mask 620, and vent holes 625. As illustrated, the impact absorbing structure 715 can have a jack-like or "caltrop" shape formed by a plurality of intersecting bars and/or three or more orthogonally intersecting bars, columns or filaments, which connect a central point or a node to faces of an imaginary cube enclosing the impact absorbing structure 715. Alternatively, the impact absorbing structures may include additional bars, columns or filaments intersecting at a central point, such as bars that connect the central point to faces of an enclosing tetrahedron or octahedron. Compared to impact absorbing structures with a column shape, the impact absorbing structures 715 may have increased resistance to forces from multiple directions, particularly torques due to friction in a collision.

The impact absorbing structures 615 or 715 may be mechanically secured to the outer shell 605, the inner shell 610, or both. However, mechanically securing the impact absorbing structures 615 or 715 increase manufacturing complexity and may be obviated by filling the volume between the outer shell 605 and inner shell 610 with another material. This other material may secure the impact absorbing structures 615 relative to each other and the inner and outer shells, which prevents bothersome rattling.

Figure 8A:
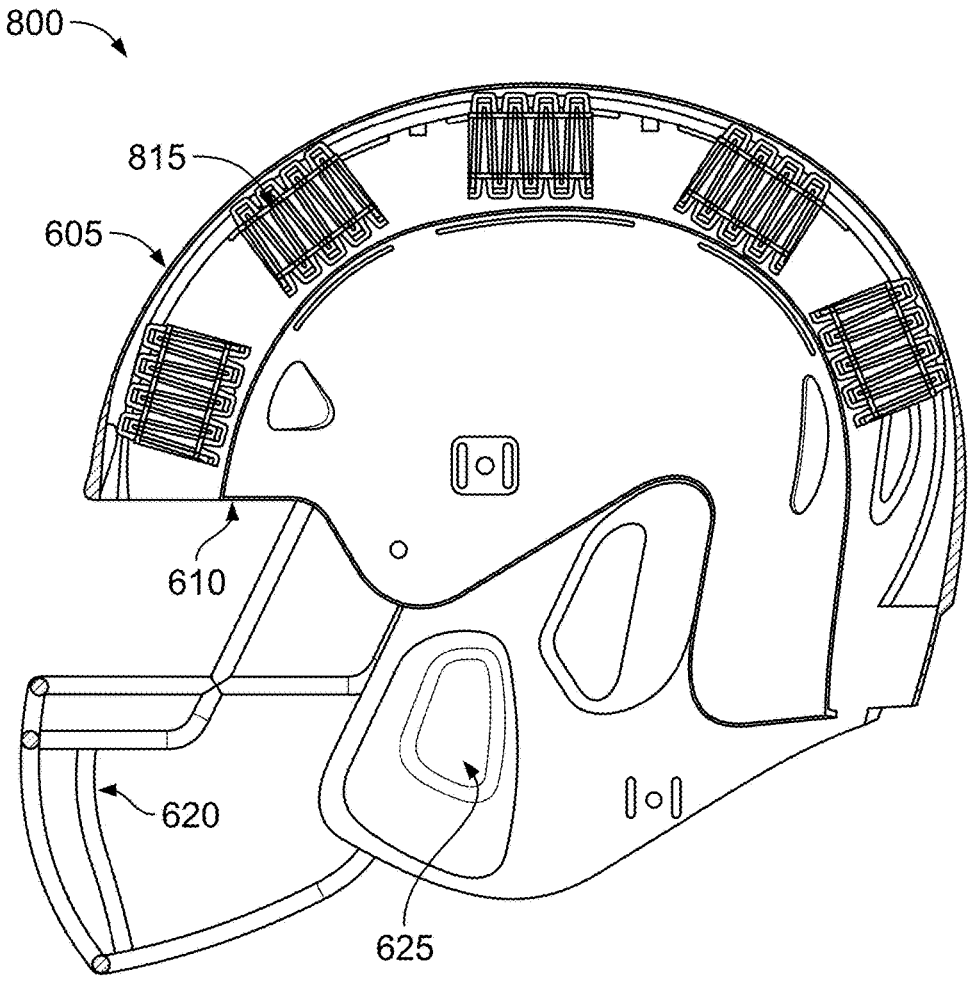
FIG. 8A is a cross-sectional view of a helmet including impact absorbing structures having a bristle shape, in accordance with an embodiment.
Figure 8B:
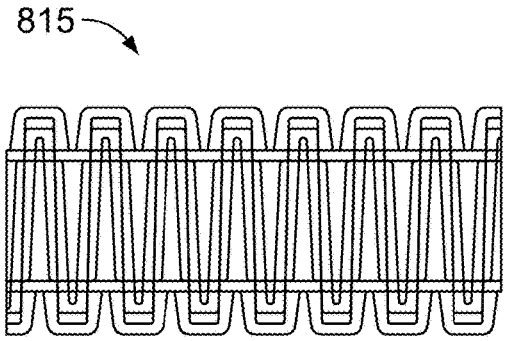
FIG. 8B is a cross-sectional view of an impact absorbing structure included in the helmet of FIG. 8A, in accordance with an embodiment.
Figure 8C:
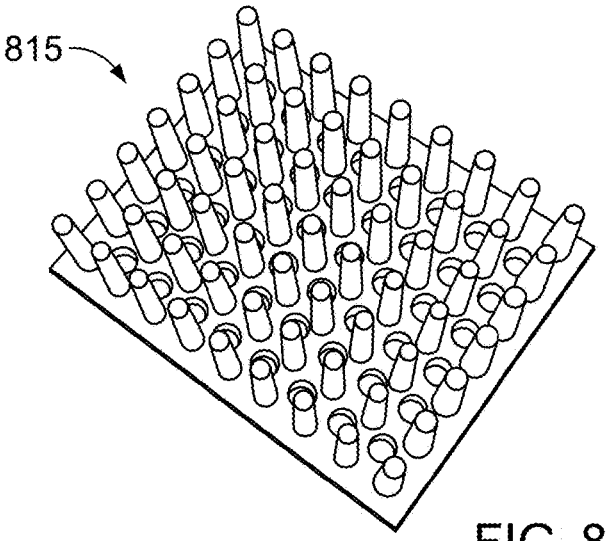
FIG. 8C is a perspective view of an impact absorbing structure included in the helmet of FIG. 8A, in accordance with an embodiment.

FIG. 8A is a cross-sectional view of a helmet 800 including impact absorbing structures 815 having a bristle shape, in accordance with an embodiment. FIG. 8B is a plan view of the impact absorbing structure 815 included in the helmet 800, in accordance with an embodiment. FIG. 8C is a perspective view of the impact absorbing structure 815 included in the helmet 800, in accordance with an embodiment.

The helmet 800 includes an outer shell 605, an inner shell 610, impact absorbing structures 815 disposed between the outer shell 605 and the inner shell 610, a face mask 620, and vent holes 625. As illustrated, an impact absorbing structure 815 has a bristle shape with multiple bristles arranged perpendicular to outer shell 605, inner shell 610, or both. The impact absorbing structure 815 further includes holes having a same diameter as the bristles. As illustrated, the holes and bristles of the impact absorbing structure are arranged in an array structure with the bristles and holes alternating across rows and columns of the array. The impact absorbing structure may include a base pad secured to the shell 605 or 610. The base pad secures the bristles and forms the holes. Alternatively, the shells 605 and 610 serve as base structures that secure the bristles and forms the holes. Impact absorbing structures 815 on the shells 605 and 610 are aligned oppositely and may be offset so that bristles of an upper impact absorbing structure 815 are aligned with holes of the lower impact absorbing structure 815, and vice versa. In this way, the ends of bristles may be laterally secured when the opposing impact absorbing structures 815 are assembled between the outer shell 605 and the inner shell 610.

In some embodiments, the impact absorbing structures 615, 715, or 815 are secured in a ridge that protrudes from an outer shell of the helmet 100 (e.g., like a mohawk). In this way, the ridge may absorb energy from a collision before the force is transmitted to the outer shell of the helmet 100.

Additional Impact Absorbing Structures

Figure 9:
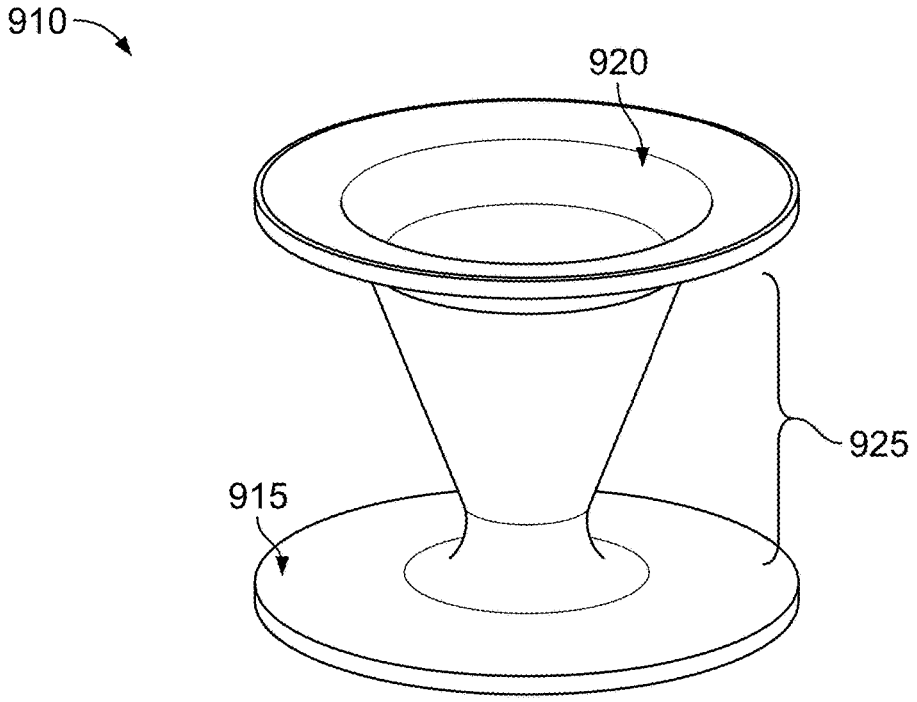
FIG. 9 is a perspective view of an embodiment of an impact absorbing structure having a conical structure, in accordance with an embodiment.
Figure 10:
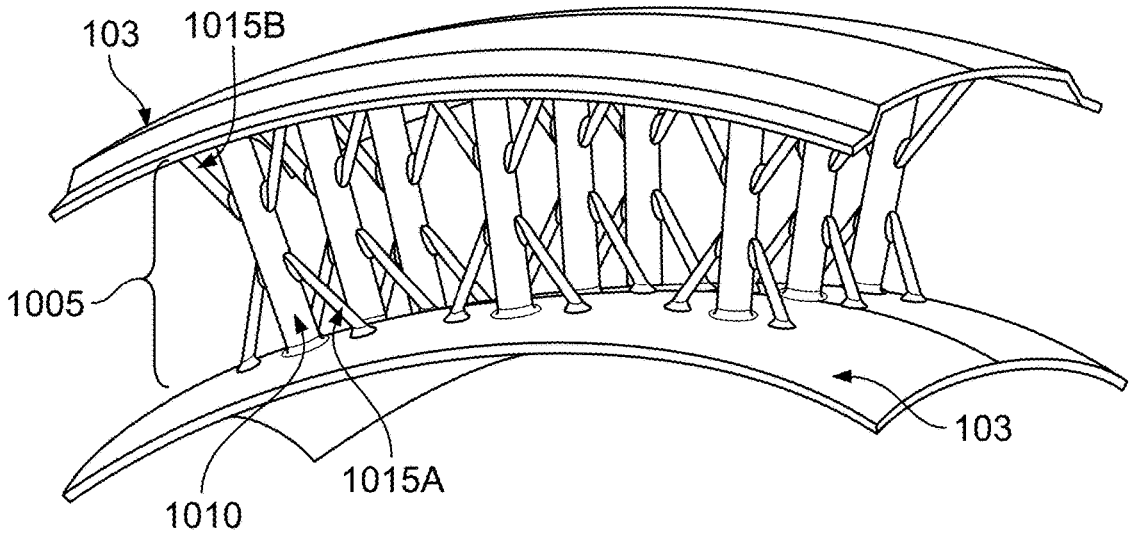
FIG. 10 is a perspective view of an embodiment of an impact absorbing structure having a base portion and angled support portions, in accordance with an embodiment.

FIG. 9 is a perspective view of another alternative embodiment of an impact absorbing structure 910 having a conical structure. In the example shown by FIG. 9, the impact absorbing structure 910 has a circular base 915 coupled to a circular top 920 via a conical structure 925. As shown in FIG. 9, a portion of the conical structure 925 coupled to the circular base 915 has a smaller diameter than an additional portion of the conical structure 925 coupled to the circular top 920 of the impact absorbing structure 910. In various embodiments, the interior of the conical structure 925 is hollow. Alternatively, a less rigid material, such as foam, may be injected into the interior of the conical structure 925 to further dissipate energy from an impact. In various embodiments, the circular base 915 is configured to be coupled to an inner shell of a helmet, while the circular top 920 is configured to be coupled to an outer shell of a helmet, such as the helmet described above in conjunction with FIGS. 6A, 7A, and 8A Alternatively, the circular base 915 is configured to be coupled to an outer shell of a helmet, while the circular top 920 is configured to be coupled to an inner shell of a helmet, such as the helmet described above in conjunction with FIGS. 6A, 7A, and 8A FIG. 10 is a perspective view of another alternative embodiment of an impact absorbing structure 1005 having a base portion 1010 and angled support portions 1015A, 1015B (also referred to individually and collectively using reference number 1015). The base portion (e.g., base column, bar and/or filament) 1010 is coupled to each of the concentric surfaces 103 (similar to the embodiments described in conjunction with FIG. 2), while a support portion (e.g. support bar, column and/or filament) 1015A has an end coupled to the base portion 1010 and another end coupled to one or the concentric surfaces 103. In the example shown by FIG. 10, each base portion 1010 has two support portions 1015A coupled to the base portion 1010 and to one of the concentric surfaces 103 and also has two additional support portions 1015B coupled to the base portion 1010 and to the other concentric surface 103. However, in other embodiments, the base portion 1010 may have any suitable number of support portions 1015 coupled to the base portion 1010 and to one of the concentric surfaces 103. In some embodiments, the base portion can include different numbers of support portions 1015 coupled to the base portion and to a concentric surface 103 and/or coupled to the other concentric surface 103.

As depicted in this embodiment, a support portion 1015 can be coupled to the base portion 1010 at an angle and can be coupled to a concentric surface 103 at an additional angle. In various embodiments, the angle equals the additional angle. Varying the angle at which the support portion 1015 is coupled to the base portion 1010 or the additional angle at which the support portion 1015 is coupled to the concentric surface 103 can modify the structure's response to an incident force and/or critical force that, when applied, may cause the impact absorbing member 1005 to buckle.

Figure 11:
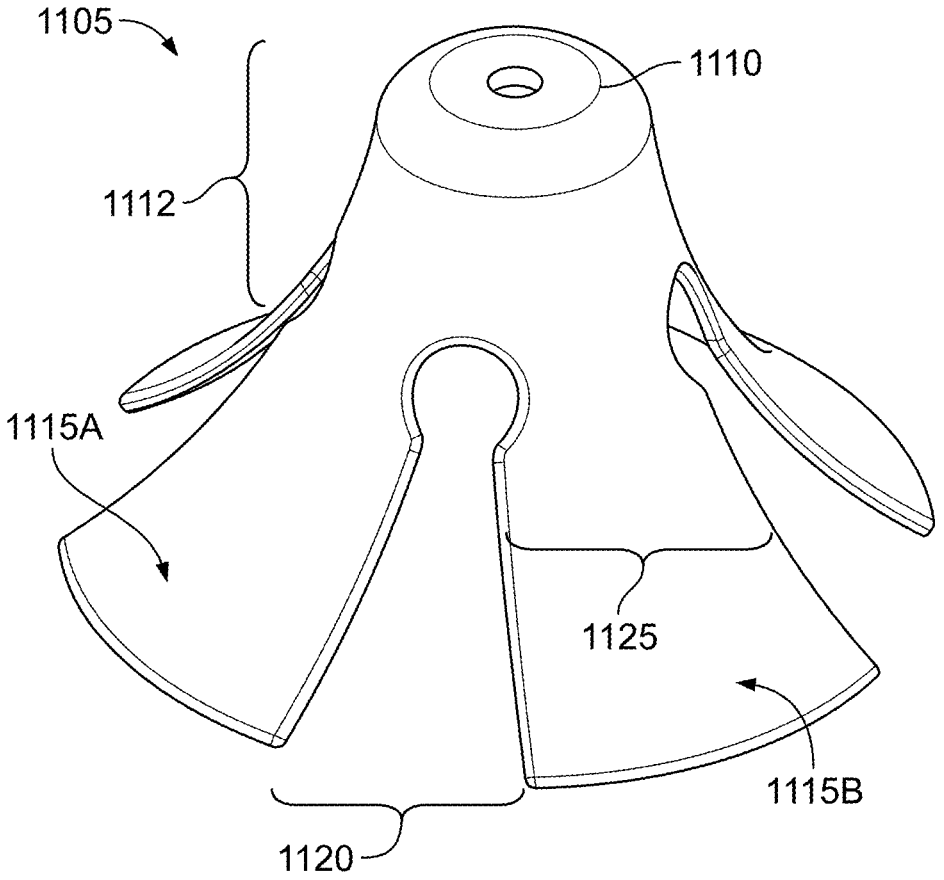
FIG. 11 is a perspective view of an embodiment of an impact absorbing structure having a cylindrical member coupled to multiple planar surfaces, in accordance with an embodiment.

FIG. 11 is a perspective view of another embodiment of an impact absorbing structure 1105 having a cylindrical member coupled to multiple planar surfaces 1115A, 1115B (also referred to individually and collectively using reference number 1115). The cylindrical member has a vertical portion 1112 having a height and having a circular base 1110 at one end. At an opposite end of the vertical portion 1112 from the circular base 110, multiple planar surfaces 1115A, 1115B are coupled to the vertical portion 1112. Different planar surfaces 1115 are separated by a distance 1120. For example, FIG. 11 shows planar surface 1115A separated from planar surface 1115B by the distance 1120. In various embodiments, each planar surface 1115 is separated from an adjacent planar surface 1115 by a common distance 1120; alternatively, different planar surfaces 1115 are separated from other planar surfaces 1115 by different distances 1120. Each planar surface 1115 has a width 1125, while FIG. 11 shows an embodiment where the width 1125 of each planar surface 1115 is the same, different planar surfaces 1115 may have different widths in 1125 in other embodiments. The planar surfaces 1115 are coupled to the opposite end of the vertical portion 1112 of the cylindrical member than the circular base 1110 around a circumference of the cylindrical member. Additionally, the circular base 1110 can be configured to be coupled to an outer shell of a helmet, while ends of the planar surfaces 1115A, 1115B not coupled to the vertical portion of the cylindrical member can be configured to be coupled to an inner shell of a helmet, such as the helmet described above in conjunction with FIGS. 6A, 7A, and 8A. Alternatively, the circular base 1110 can be configured to be coupled to an inner shell of a helmet, while ends of the planar surfaces 1115A, 1115B not coupled to the vertical portion of the cylindrical member may be configured to be coupled to an outer shell of a helmet, such as the helmet described above in conjunction with FIGS. 6A, 7A, and 8A In other embodiments, the circular base 1110 may be configured to be coupled to a concentric surface 103 and the ends of the planar surfaces 1115A, 1115B not coupled to the vertical portion of the cylindrical member are configured to be coupled to another concentric surface 103.

Figure 12:
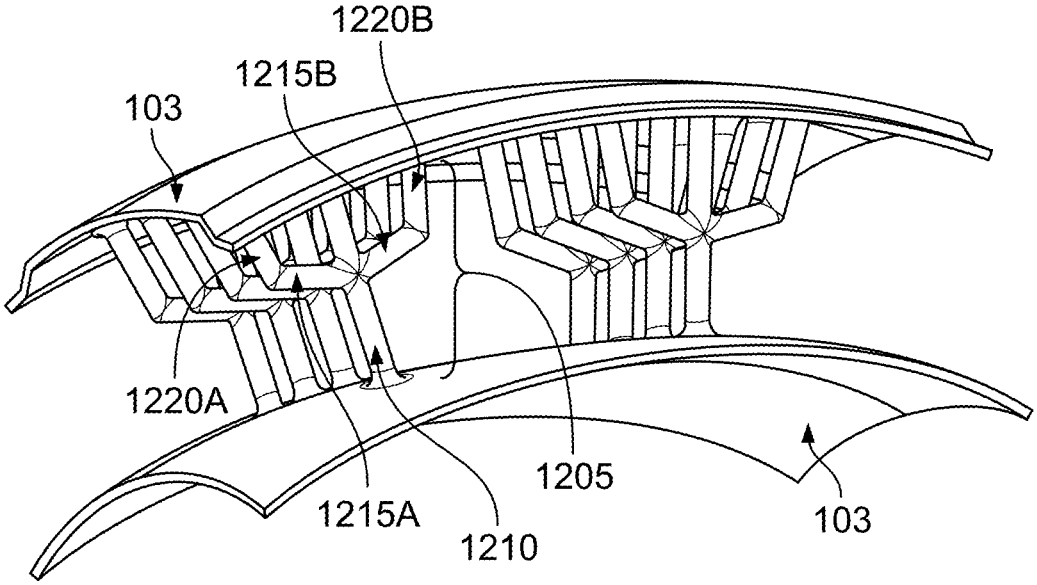
FIG. 12 is a perspective view of an embodiment of an impact absorbing structure having a base portion to which multiple supplemental portions are coupled, in accordance with an embodiment.

FIG. 12 is a perspective view of another alternative embodiment of an impact absorbing structure 1205 having a base portion 1210 to which multiple supplemental portions 1215A, 1215B (also referred to individually and collectively using reference number 1215) are coupled. Support portions 1220A, 1220B (also referred to individually and collectively using reference number 1220) are coupled to a concentric surface 103 and to a supplemental portion 1215A, 1215B. As shown in FIG. 12, an end of a supplemental portion 1215A is coupled to the base portion 1210, while an opposing end of the supplemental portion 1215A is coupled to a support portion 1220A. The support portion 1220A has an end coupled to the opposing end of the supplemental portion 1215A, while another end of the support portion 1220A is coupled to a concentric surface 103. In various embodiments, an end of the base portion 1210 and the other ends of the support portions 1220 are each coupled to a common concentric surface 103, while an opposing end of the base portion 1210 is coupled to a different concentric surface 103.

Any number of supplemental portions 1215 may be coupled to the base portion 1210 of the impact absorbing structure in various embodiments. Additionally, the supplemental portions 1215 are coupled to the base portion 1210 at an angle relative to an axis parallel to the base portion 1210. In some embodiments, each supplemental portion 1215 is coupled to the base portion 1210 at a common angle relative to the axis parallel to the base portion 1210. Alternatively, different supplemental portions 1215 are coupled to the base portion 1210 at different angles relative to the axis parallel to the base portion 1210. Similarly, each support portion 1220 is coupled to a supplemental portion 1215 at an angle relative to an axis parallel to the supplemental portion 1215. In some embodiments, each support portion 1220 is coupled to a corresponding supplemental portion 1215 at a common angle relative to the axis parallel to the supplemental portion 1215. Alternatively, different support portions 1220 are coupled to a corresponding supplemental portion 1215 at different angles relative to the axis parallel to the corresponding supplemental portion 1215.

Figure 13A:
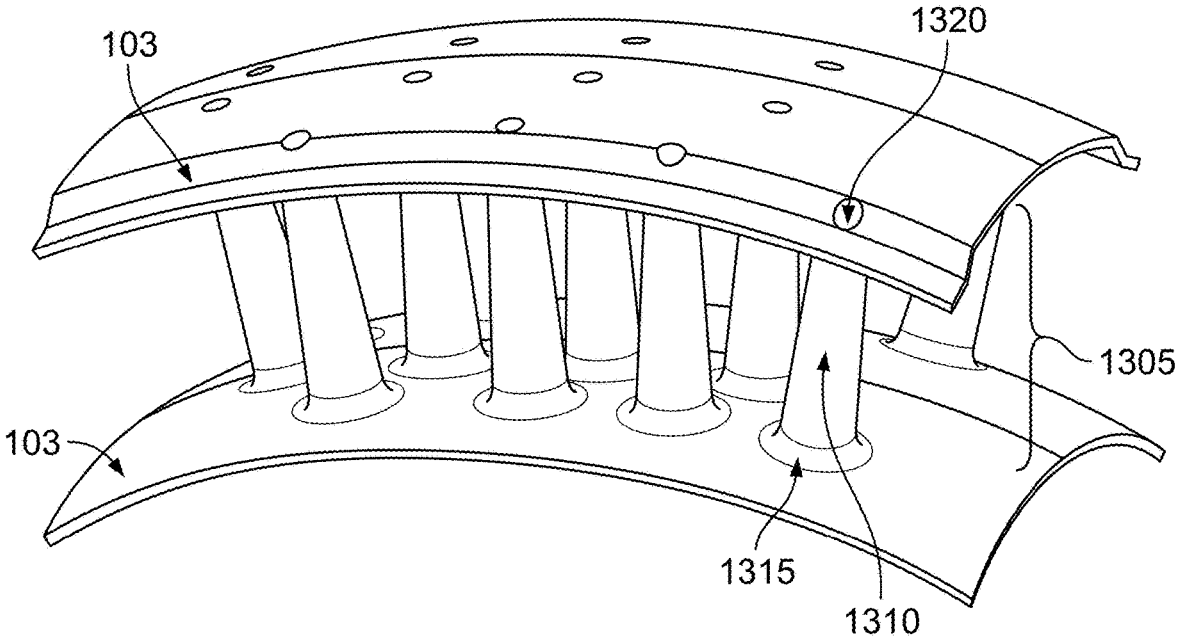
FIG. 13A is a perspective view of an embodiment of a conical impact absorbing structure, in accordance with an embodiment.

FIG. 13A is a perspective view of an embodiment of a conical impact absorbing structure 1305. The conical impact absorbing structure 1305 has a circular base 1315 and an additional circular base 1320 that has a smaller diameter than the circular base 1315. A vertical member 1310 is coupled to the circumference of the circular base 1315 and to a circumference of the additional circular base 1320. Hence, a width of the vertical member 1310 is larger nearer to the circular base 1315 and is smaller nearer to the additional circular base 1320. The circular base 1315 is configured to be coupled to a concentric surface 103, while the additional circular base 1320 is configured to be coupled to an additional concentric surface 103. In the example shown by FIG. 13A, the vertical member 1310 is hollow. Alternatively, a less rigid material, such as foam, may be injected into the interior of the vertical member 1310 to further dissipate energy from an impact.

Figure 13B:
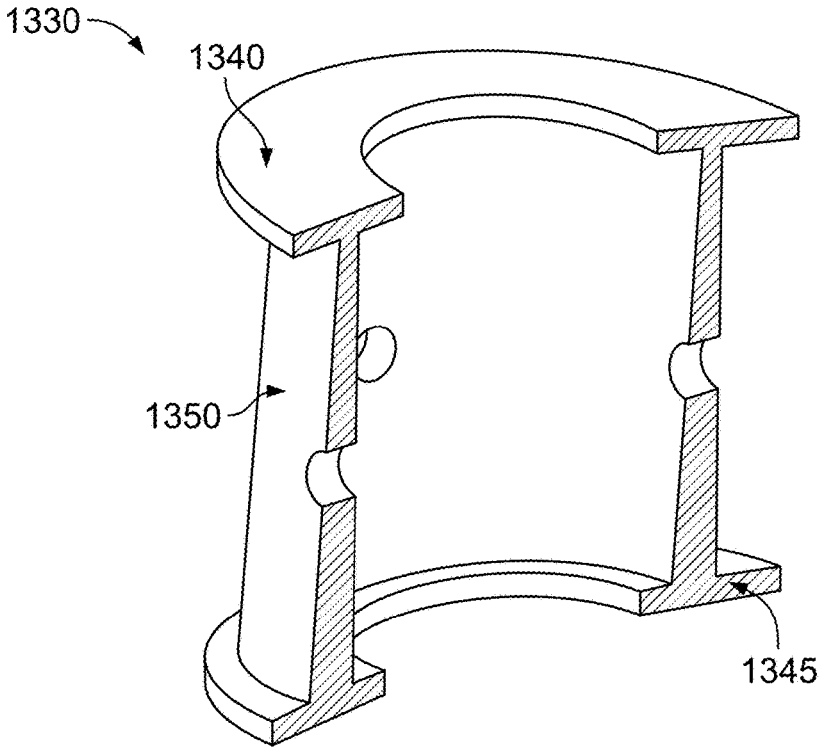
FIG. 13B is a cross-sectional view of an alternative impact absorbing structure, in accordance with an embodiment.

FIG. 13B is a cross-sectional view of an alternative impact absorbing structure 1330. In the example shown by FIG. 13B, the alternative impact absorbing structure 1330 has a circular base 1340 and an additional circular base 1345 that each have a common diameter. A vertical member 1350 is coupled to the circular base 1340 and to the additional circular base 1345. Because the diameter of the circular base 1340 equals the diameter of the additional circular base 1345, the vertical member 1350 can have a uniform width between the circular base 1340 and the additional circular base 1345. In the example of FIG. 13B, the vertical member 1350 is hollow. Alternatively, a less rigid material, such as foam, may be injected into the interior of the vertical member 1350 to further dissipate energy from an impact. The circular base 1345 is configured to be coupled to a concentric surface 103, while the additional circular base 1350 is configured to be coupled to an additional concentric surface 103.

Figure 14:
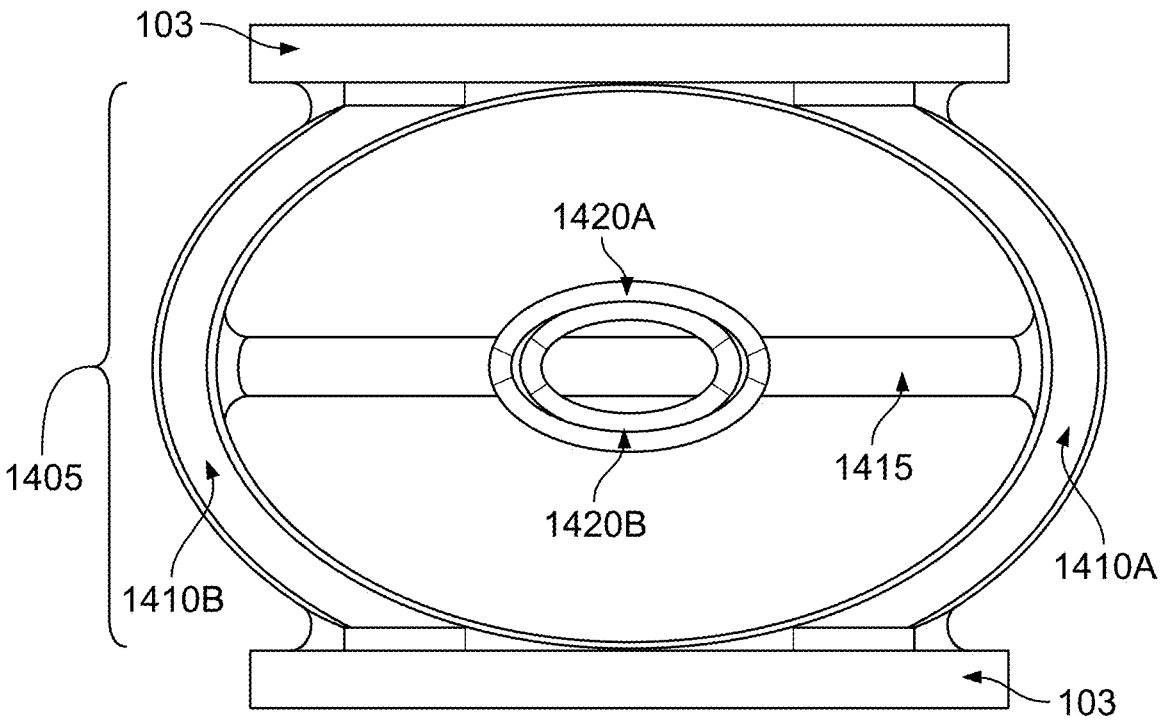
FIG. 14 is a side view of an impact absorbing structure having arched structures, in accordance with an embodiment.

FIG. 14 is a side view of an impact absorbing structure 1405 having arched structures 1410A, 1410B. In the example shown by FIG. 4, the impact absorbing structure 1405 has an arched structure 1410A coupled to a concentric surface 103 at an end and coupled to another concentric surface 103 at an opposing end. Similarly, an additional arched structure 1410B is coupled to the concentric surface 103 at an end, while an opposing end of the additional arched structure 1410B is coupled to the other concentric surface 103. A bracing member 1415 can be positioned in a plane parallel to the concentric surface 103 and the other concentric surface 103. An end of the bracing member 1415 is coupled to the arched structure 1410A, while an opposing end of the bracing member 1415 can be coupled to the additional arched structure 1410B. In various embodiments, the end of the bracing member 1415 is coupled to the arched structure 1410A at an apex of the arched structure 1410B relative to an axis perpendicular to the bracing member 1415. Similarly, the opposing end of the bracing member 1415 is coupled to the additional arched structure 1410B at an apex of the additional arched structure 1410B relative to the axis perpendicular to the bracing member 1415. However, in other embodiments, the bracing member 1415 may be coupled to any suitable portions of the arched structure 1410A and the additional arched structure 1410B along a plane parallel to the concentric surface 103 and the other concentric surface 103.

Additionally, a supporting structure 1420A can be coupled to a portion of a surface of the bracing member 1415 and to an additional portion of the surface of the bracing member 1415. Similarly, an additional supporting structure 1420B is coupled to a portion of an additional surface of the bracing member 1415 that is parallel to the surface of the bracing member 1415 and to an additional portion of the additional surface of the bracing member 1415. As shown in FIG. 14, the supporting structure 1420A is arched between the portion of the surface of the bracing member 1415 and the additional portion of the surface of the bracing member 1415. Similarly, the additional supporting structure 1420B is arched between the portion of the additional surface of the bracing member 1415 and the additional portion of the additional surface of the bracing member 1415.

Figure 15:
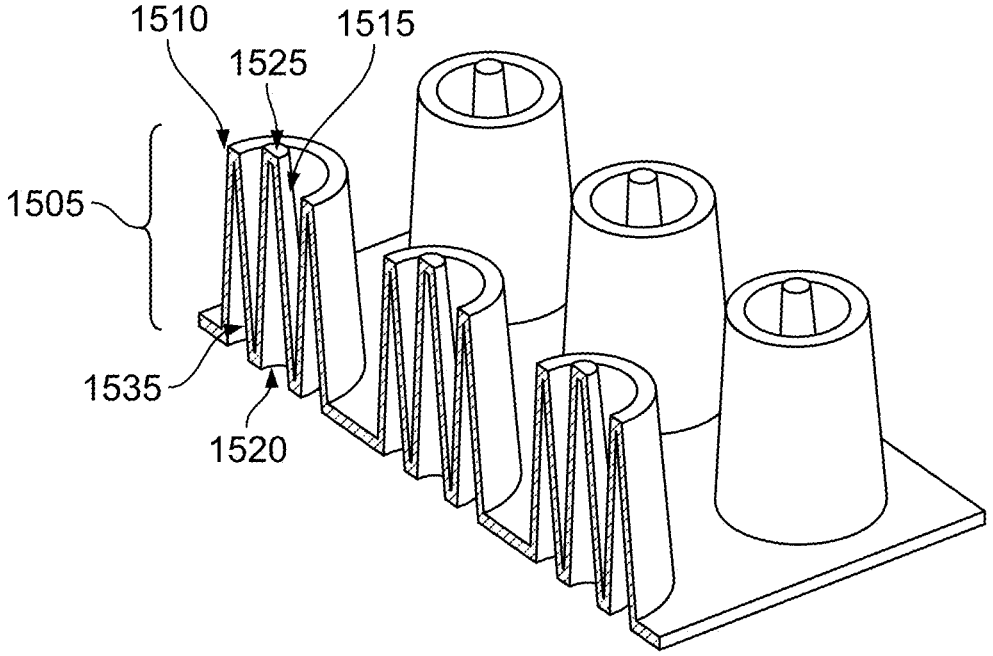
FIG. 15 is a perspective and cross-sectional view of an embodiment of an impact absorbing structure comprising a cylindrical structure enclosing a conical structure, in accordance with an embodiment.
Figure 16:
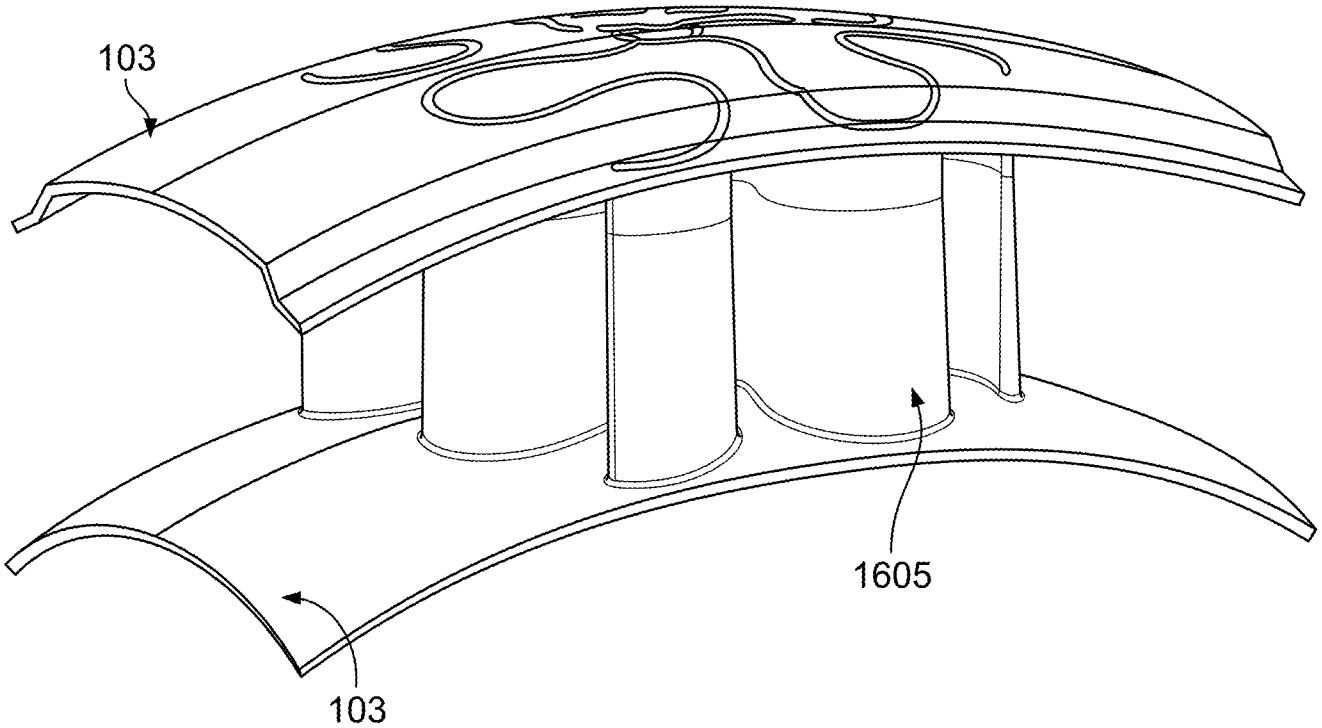
FIG. 16 is a perspective view of an impact absorbing structure, in accordance with an embodiment.

FIG. 15 is a perspective and cross-sectional view of an embodiment of an impact absorbing structure 1505 comprising a cylindrical structure 1510 enclosing a conical structure 1515. In the example shown by FIG. 15, the impact absorbing structure 1505 has a cylindrical structure 1510 having an interior wall 1535 and an exterior wall. The cylindrical structure 1510 encloses a conical structure 1515 having a circular base 1520 at one end and an additional circular base 1525 at an opposing end. In various embodiments, the cylindrical structure 1510 and the conical structure 1515 can each have different durometers, so the cylindrical structure 1510 and the conical structure 1515 have different hardnesses. Alternatively, the cylindrical structure 1510 and the conical structure 1515 have a common hardness. The additional circular base 1525 has a smaller diameter than the circular base 1520. Additionally, the interior wall 1535 of the cylindrical structure 1510 may optionally taper from a portion of the cylindrical structure 1510 nearest the additional circular base 1525 of the conical structure 1515 to being coupled to a circumference of the circular base 1520 of the conical structure 1515. In some embodiments, such as shown in FIG. 15, a height of the conical structure 1515 is greater than a height of the cylindrical structure 1510, so the additional circular base 1525 of the conical structure 1515 protrudes above the cylindrical structure 1510. Alternatively, the height of the conical structure 1515 equals the height of the cylindrical structure 1510, so a top of the cylindrical structure 1510 is in a common plane as the additional circular base 1525 of the conical structure 1515. Alternatively, the height of the conical structure 1515 is less than the height of the cylindrical structure 1510. As an additional example, the conical structure 1515 and the cylindrical structure 1510 have equal heights. In various embodiments, the circular base 1520 of the conical structure 1515 is configured to be coupled to an inner shell of a helmet, while the additional circular base 1525 of the conical structure 1515 is configured to be coupled to an outer shell of a helmet, such as the helmet described above in conjunction with FIGS. 6A, 7A, and 8A. Alternatively, the circular base 1520 of the conical structure 1515 is configured to be coupled to an outer shell of a helmet, while the additional circular base 1525 of the conical structure 1515 is configured to be coupled to an inner shell of a helmet, such as the helmet described above in conjunction with FIGS. 6A, 7A, and 8A FIG. 16 shows an embodiment of another embodiment of an impact absorbing structure 1605. In the example shown by FIG. 16, the impact absorbing structure 1605 can include an open and/or closed polygon and/or irregular surface that undulates in a plane perpendicular to a plane including a concentric surface 103, which as depicted is coupled at one end to the concentric surface 103 and is coupled at an opposing end to an additional concentric surface 103. For example, the impact absorbing structure 1605 can have a sinusoidal cross section in a plane parallel to the plane including the concentric surface 103. However, in other embodiments, the impact absorbing structure 1605 may have any suitable profile in a cross section along the plane parallel to the plane, including the concentric surface 103.

Supporting Wall Structures

Figure 17A:
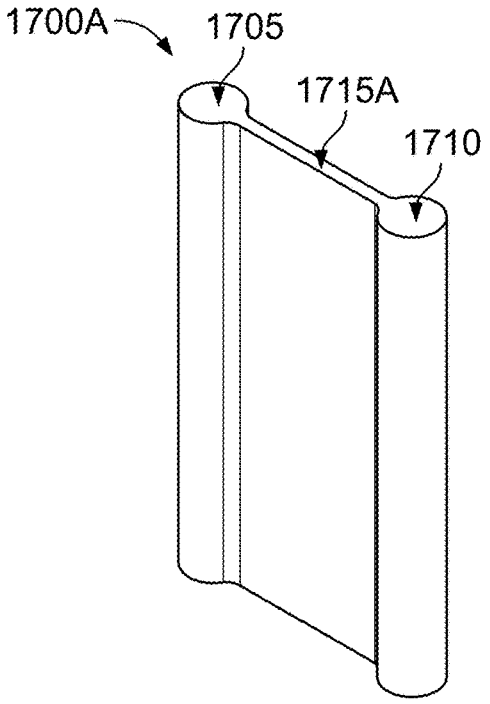
FIGS. 17A through 17C show perspective views of impact absorbing structures comprising connected support members, in accordance with an embodiment.
Figure 17B:
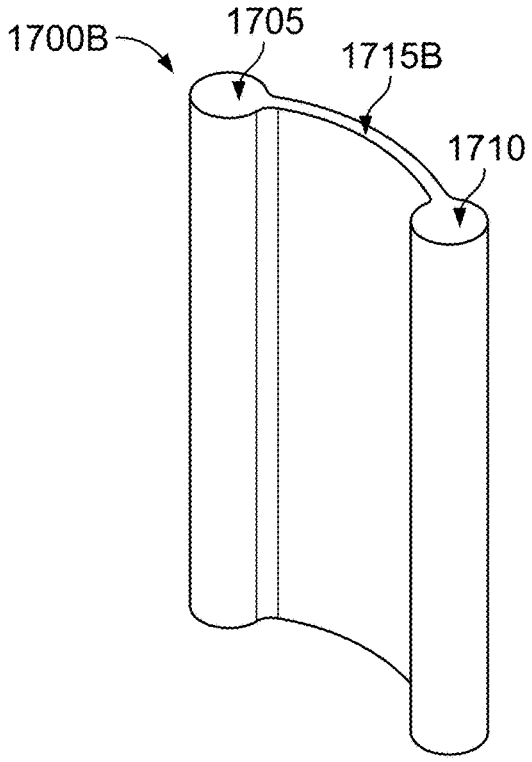
Figure 17C:
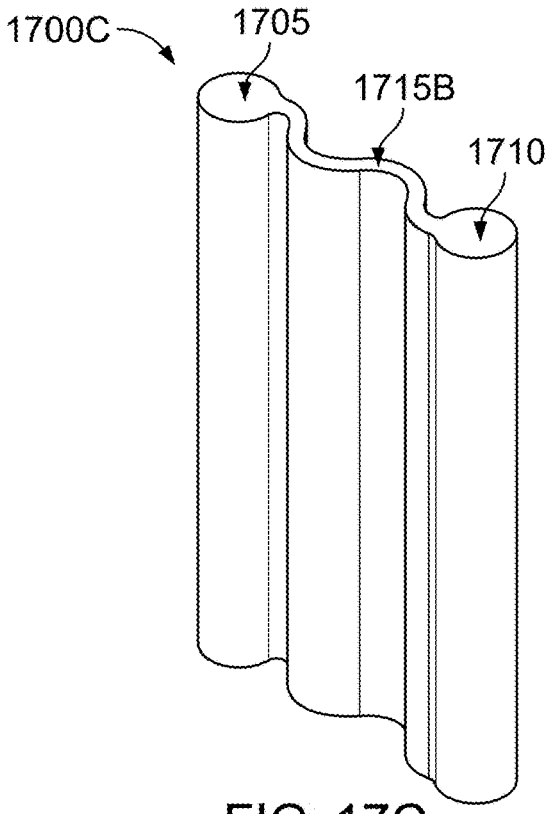

FIGS. 17A-17C show perspective views of additional embodiments of impact absorbing structures 1700A, 1700B, 1700C comprising connected support members 1705, 1710. Each support member 1705, 1710 has an end configured to be coupled to a concentric surface 103 and an opposing end configured to be coupled to another concentric surface 103. A support member 1705 is coupled to the other support member 1710 by a connecting element that is desirably in a plane perpendicular to a plane including the concentric surface 103, or in a plane perpendicular to another plane including the other concentric surface 103. In the example of FIG. 17A, an impact absorbing structure 1700A may include a rectangular sheet-like or wall-like structure 1715A connecting the support member 1705 to the other support member 1710, with this wall structure positioned perpendicular to the concentric surface 103 and to the other concentric surface 103. In various embodiments, an end of the rectangular structure 1715A is coupled to the concentric surface 103, while an opposite end of the rectangular structure 1715A is coupled to the other concentric surface 103.

FIG. 17B shows an impact absorbing structure 1700B including a non-planer surface or "arched" wall structure 1715B connecting the support member 1705 to the other support member 1710. The arched structure 1715B is perpendicular to the concentric surface 103 and to the other concentric surface 103 and is arched in a plane that is parallel to the concentric surface 103 and to the other concentric surface 103. In various embodiments, an end of the arched structure 1715B is coupled to the concentric surface 103, while an opposite end of the arched structure 1715B is coupled to the other concentric surface 103.

FIG. 17C shows an impact absorbing structure 1700B including a complex or "undulating" wall structure 1715C connecting the support member 1705 to the other support member 1710. The undulating structure 1715C can desirably be perpendicular to the concentric surface 103 and to the other concentric surface 103, and may include multiple arcs in a plane that is parallel to the concentric surface 103 and to the other concentric surface 103. For example, the undulating structure 1715C may have a sinusoidal cross section in a plane parallel to the plane including a concentric surface 103. In various embodiments, an end of the undulating structure 1715C is coupled to the concentric surface 103, while an opposite end of the undulating structure 1715C is coupled to the other concentric surface 103.

Figure 18:
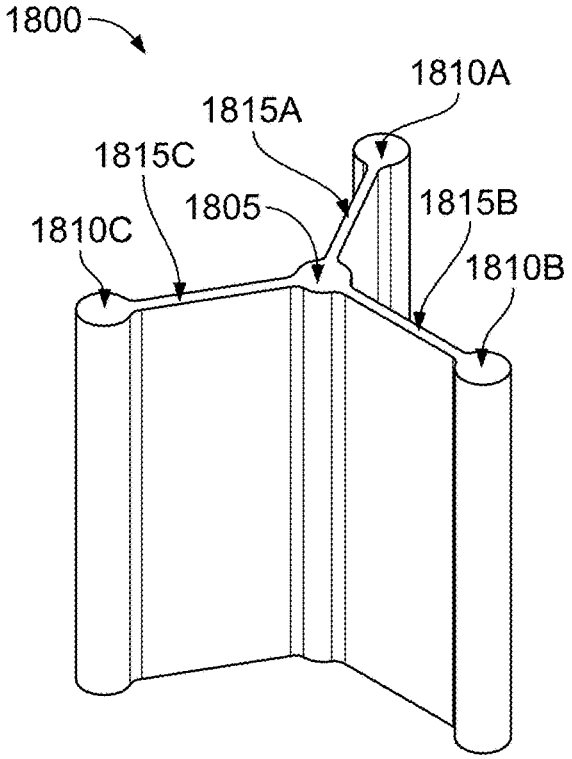
FIGS. 18 through 20 show example structural groups including multiple support members positioned relative to each other with different support members coupled to each other by connecting members, in accordance with an embodiment.

While FIGS. 17A-17C show examples of impact absorbing structures where a pair of support members are coupled to each other by a connecting member, any number of support members may be positioned relative to each other and different pairs of the support members connected to each other by connecting members to form structural groups. FIGS. 18-20 show exemplary structural groups including multiple support members positioned relative to each other with different support members or filaments coupled to each other by connecting members or walls. FIG. 18 shows an impact absorbing structure 1800 having a central support member 1805 coupled to three radial support members 1810A, 1810B, 1810C that are positioned along a circumference of a circle having an origin at the central support member 1805. The central support member 1800 is coupled to radial support member 1810A by connecting member 1815A and is coupled to radial support member 1810B by connecting member 1815B. Similarly, the central support member 1800 is coupled to radial support member 1810C by connecting member 1815C. While FIG. 18 shows an example where the connecting member 1815A, 1815B, 1815C are rectangular, while in other embodiments, the connecting members 1815A, 1815B, 1815C may be arched structures or undulating structures as described in FIGS. 17B and 17C or may have any other suitable cross section.

Figure 19A:
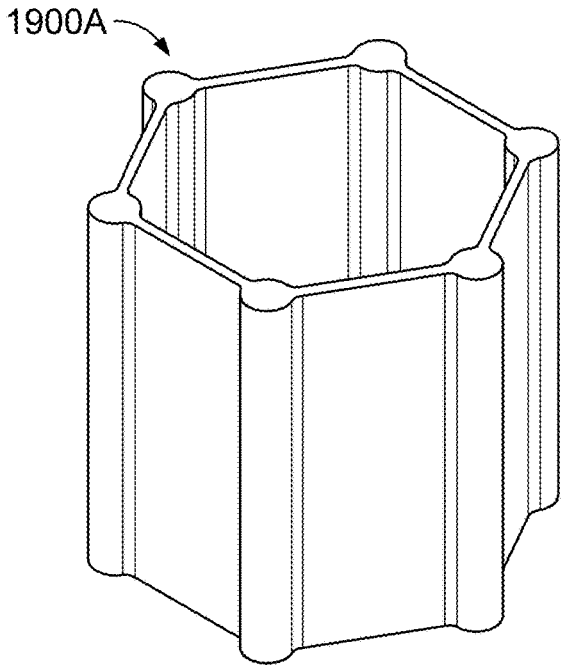
Figure 19B:
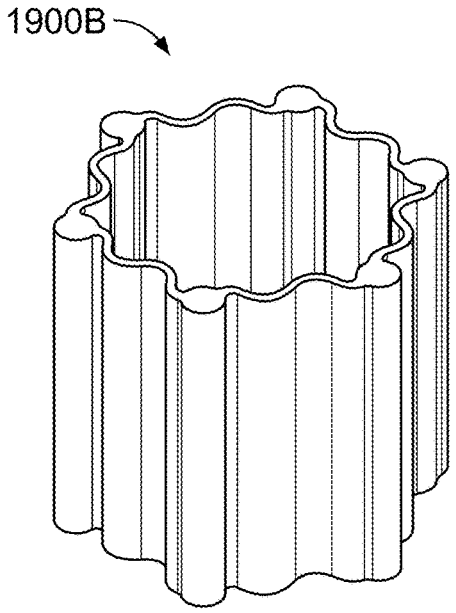
Figure 20:
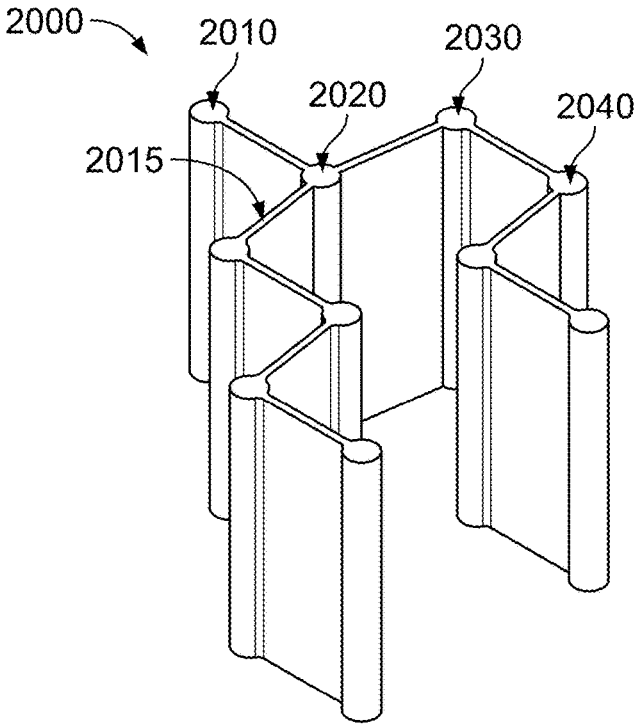

FIGS. 19A and 19B show perspective views of additional embodiments of impact absorbing structures 1900A and 1900B, comprising six support members or filaments coupled to each other by connecting members or walls formed in a hexagonal pattern. In the example shown by FIG. 19A, the impact absorbing structure 1900A has pairs of support members coupled to each other via rectangular connecting members to form a hexagon. The impact absorbing structure 1900B shown by FIG. 19B has pairs of support members coupled to each other via undulating support members to form a hexagon.

FIG. 20 is a perspective view of an impact absorbing structure 2000 comprising rows of offset support members coupled together via connecting members in an "open" polygonal structure. In the example of FIG. 20, support members are positioned in multiple parallel rows 2010, 2020, 2030, 2040, with support members in a row offset from each other so support members in adjacent rows are not in a common plane parallel to the adjacent rows. For example, support members in row 2010 are positioned so they are not in a common plane parallel to support members in row 2020. As shown in the example of FIG. 20, a support member in row 2020 is positioned so it is between support members in row 2010. Connecting members connect support members in a row 2010 to support members in an adjacent row 2020. In some embodiments, support members in a row 2010 are not connected to other support members in the row 2010, but are connected to a support member in an adjacent row 2020 via a support member 2015.

Figure 21A:
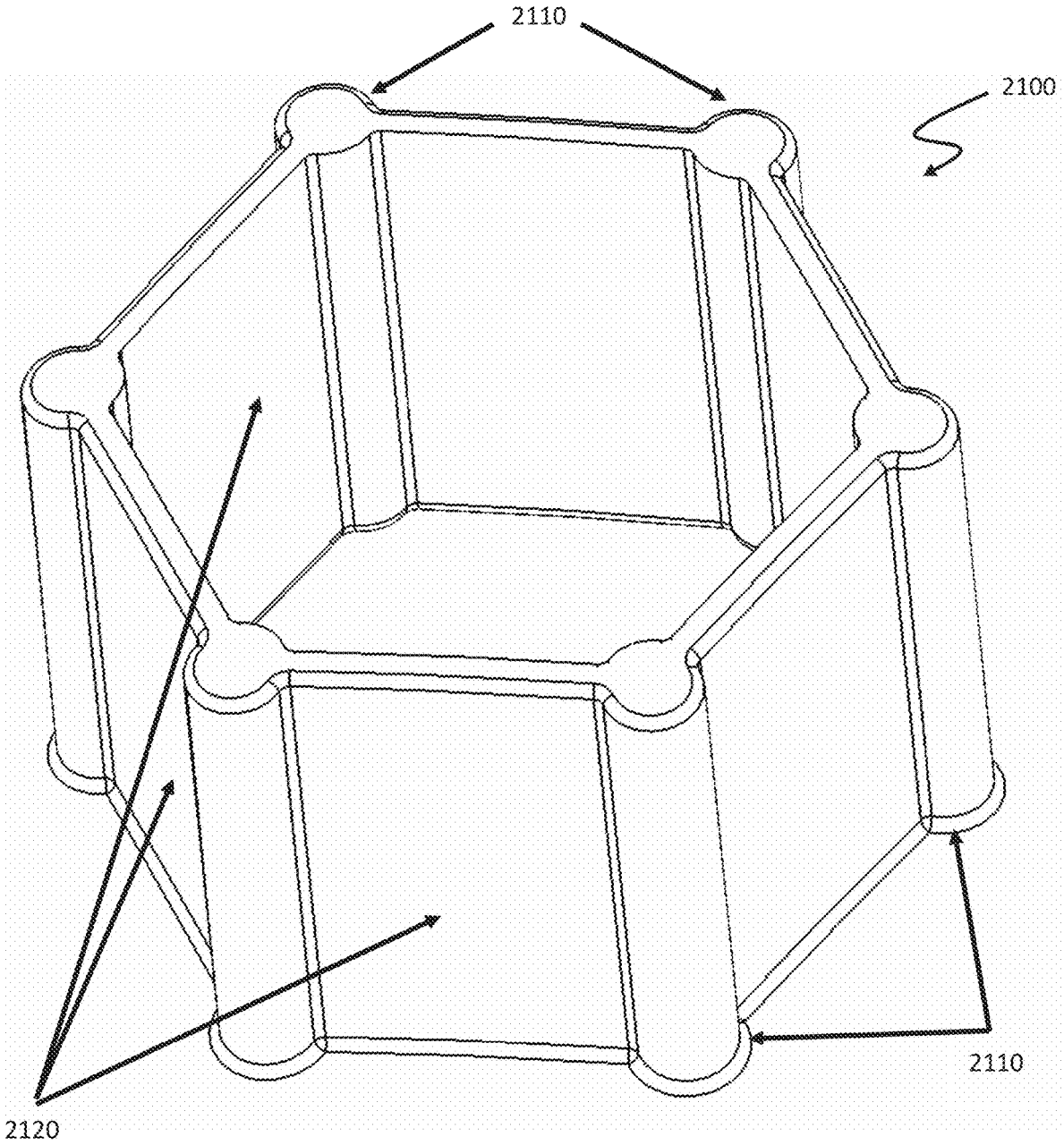
FIG. 21A depicts another exemplary embodiment of an improved impact absorbing element comprising a plurality of filaments interconnected by laterally positioned walls or sheets in a hexagonal configuration.

FIG. 21A depicts another view of the exemplary embodiment of an improved impact absorbing element 2100 comprising a plurality of filaments 2110 that are interconnected by laterally positioned walls or sheets in a hexagonal configuration. The hexagonal structures may be manufactured as individual structures or in a patterned array. The manufacturing may include extrusion, investment casting or injection molding process. If manufactured as individual structures, each structure may be affixed to the desired product.

Alternatively, if manufactured in a patterned array, the patterned array structures may be affixed to at least one face sheet.

Figure 21B:
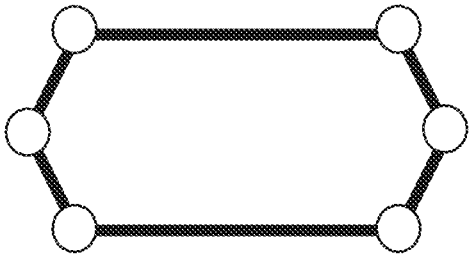
FIG. 21B depicts an alternative embodiment of an improved hexagonal impact absorbing element, with differing sized walls between filaments.
Figure 21C:
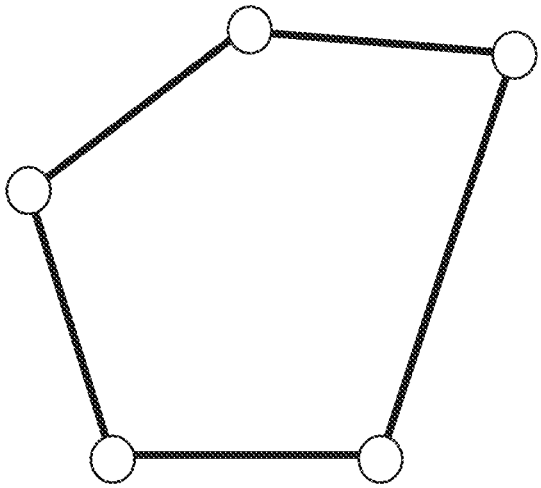
FIG. 21C depicts another alternative embodiment of an improved hexagonal impact absorbing element, with non-symmetrical arrangement of the filaments and walls.

In this embodiment, the filaments can be connected at a lower end and/or an upper end by a face sheet or other structure (not shown), which are/is typically oriented perpendicular to the longitudinal axis of the filaments. A plurality of sheets or lateral walls 2120 can be secured between adjacent pairs of filaments 2110, with each filament having a pair of lateral walls 2120 attached thereto. In the disclosed embodiment, the lateral walls can be oriented approximately 120 degrees apart about the filament axis, with each lateral wall extending substantially along the longitudinal length of the filament. However, in alternative embodiments, an offset hexagonal pattern may be utilized for the filaments and sheets, in which some of the lateral walls may be arranged at 120 degrees, while other walls may be arranged at greater than or less than 120 degrees (see FIG. 21B) or an irregular hexagon pattern may be used, in which the lateral walls are not symmetrical in their positioning and/or arrangement. For any of these embodiments, an upper and/or lower end of the lateral wall may be secured to one or more upper/lower face sheets (not shown), if desired.

Figure 22A:
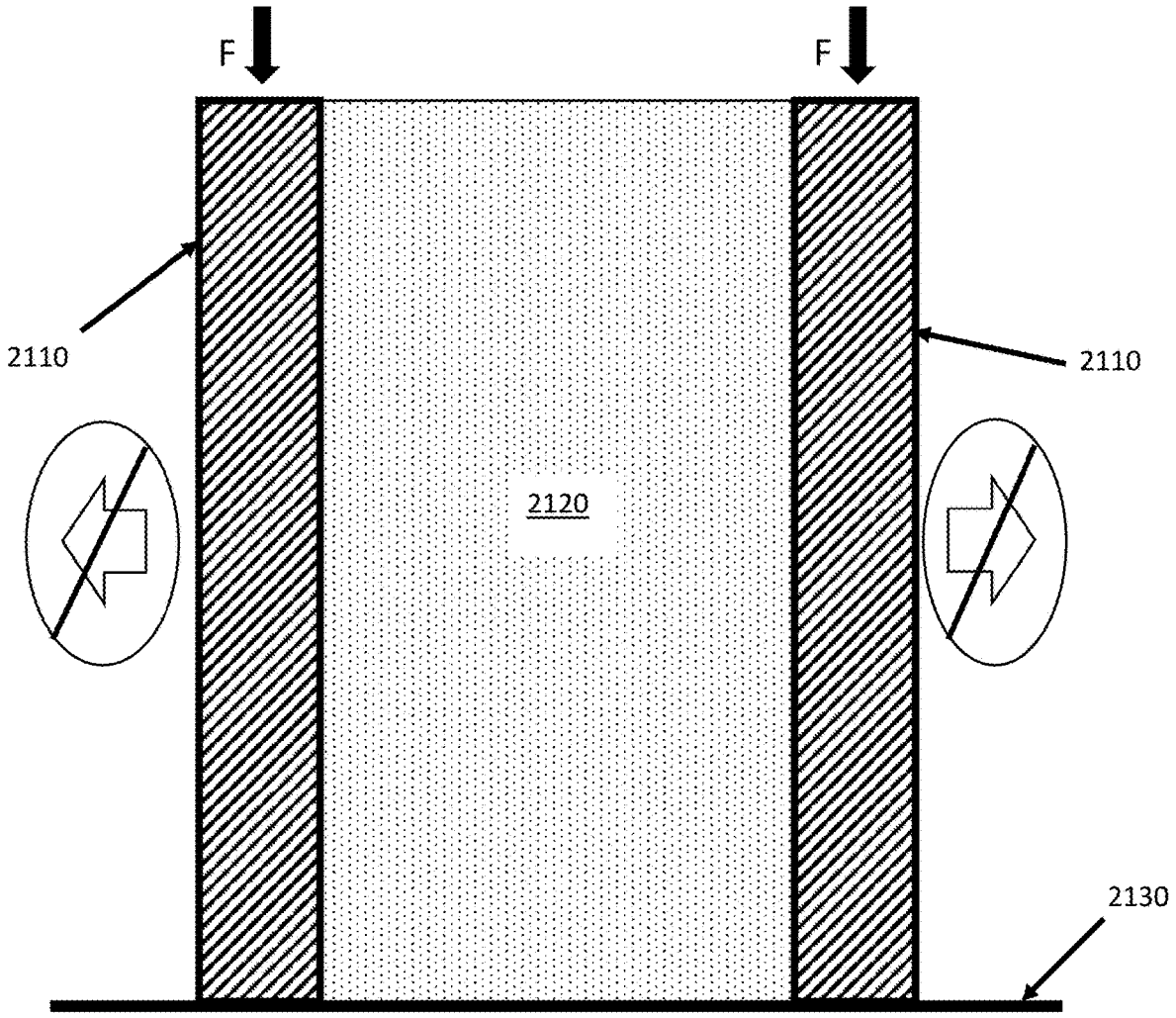
FIG. 22A depicts a side view of a portion of an array element, showing an exemplary pair of filaments connected by a lateral wall and lower face sheet.
Figure 22B:
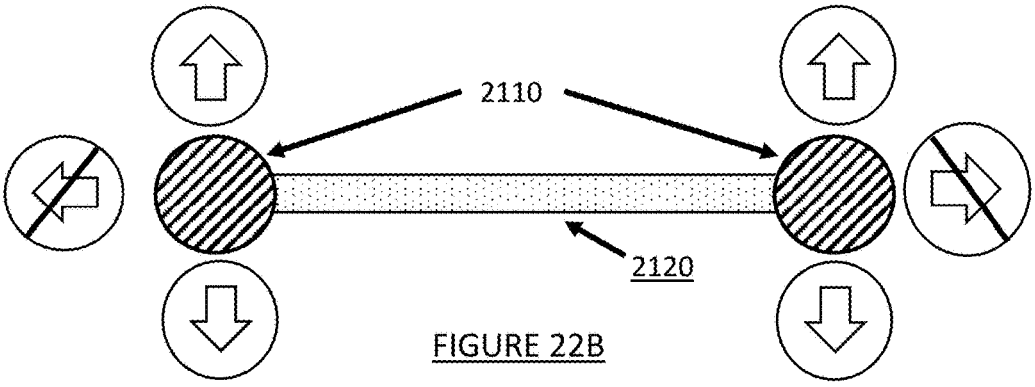
FIG. 22B depicts a top plan view of the array element portion of FIG. 22A with some exemplary buckling constraints identified.

FIG. 22A depicts a side view of an exemplary pair of filaments 2110 that are connected by a lateral wall 2120, with a face sheet 2130 connected at the bottom of the filaments 2110 and wall 2120. In this embodiment, a vertical force (i.e., an axial compressive "impact" F) downward on the filaments 2110 will desirably induce the filaments to compress to some degree in initial resistance to the force F, with a sufficient vertical force eventually inducing the filaments to buckle. However, the presence of the lateral wall 2120 will desirably prevent and/or inhibit buckling of the columns in a lateral direction away from the wall, as well as possibly prevent and/or inhibit sideways buckling of the filaments (and/or buckling towards the wall) to varying degrees-generally depending upon the thickness, structural stiffness and/or material construction of the various walls, as well as various other considerations. As best seen in FIG. 22B, the most likely direction(s) of buckling of the filaments as depicted may be transverse to the wall 2120, which stiffens the resistance of the filaments 2110 to buckling along various lateral directions, to a measurable degree in a desired manner.

Figure 22C:
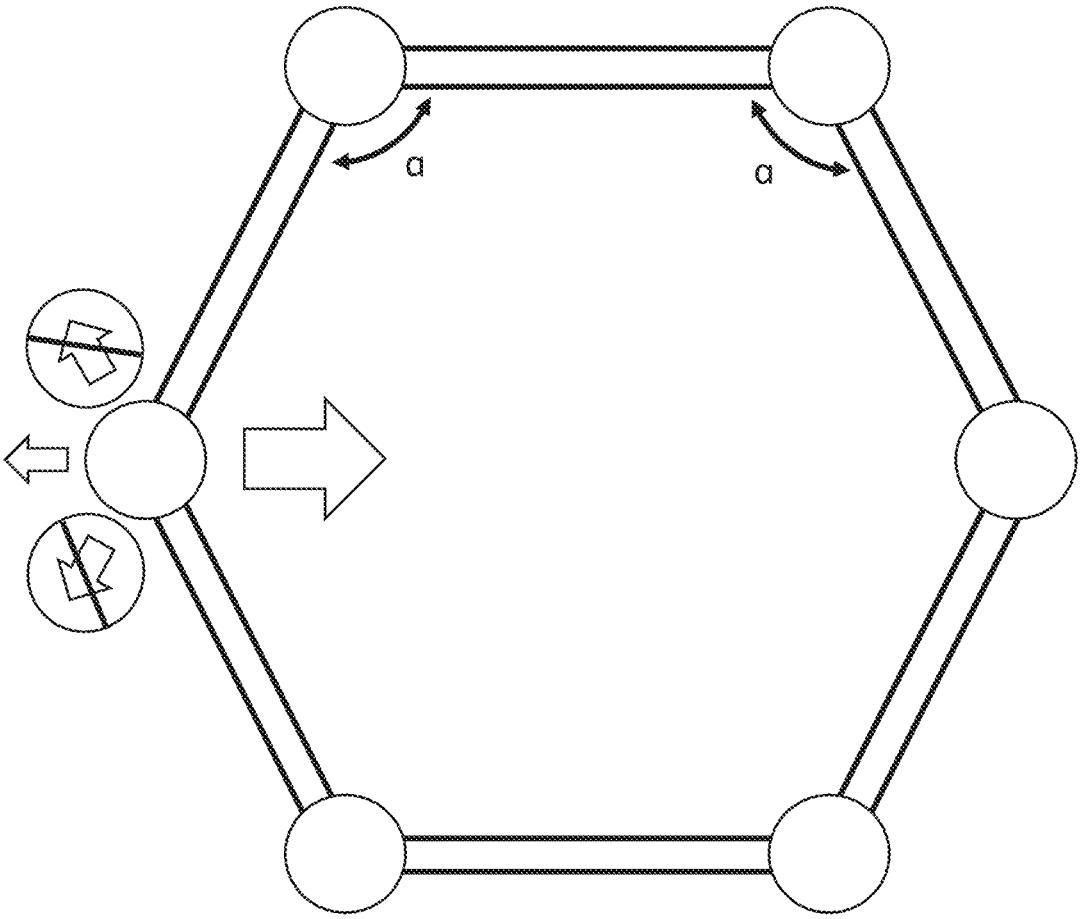
FIG. 22C depicts a top plan view of an exemplary hexagonal element with some exemplary buckling constraints identified.

FIG. 22C depicts a top plan view of filaments 2110 and walls 2120 in an exemplary hexagonal configuration. In this embodiment, each filament 2110 is connected by walls 2120 to a pair of adjacent filaments, with two walls 2120 extending from and/or between each filament set. In this arrangement, an axial compressive force (not shown) will desirably induce each of the filaments to initially compress to some degree in resisting the axial force, with a sufficient vertical force inducing the filaments to buckle in a desired manner. The presence of the two walls 2120, however, with each wall separated at an approximately 120 degree angle $\alpha$, tends to limit lateral displacement of each filament away from and/or towards various directions, effectively creating a circumferential or "hoop stress" within the filaments/walls of the hexagonal element that can alter, inhibit and/or prevent certain types, directions and/or degrees of bucking of the individual filaments, of the individual walls and/or of the entirety of the hexagonal structure.

Figure 22D:
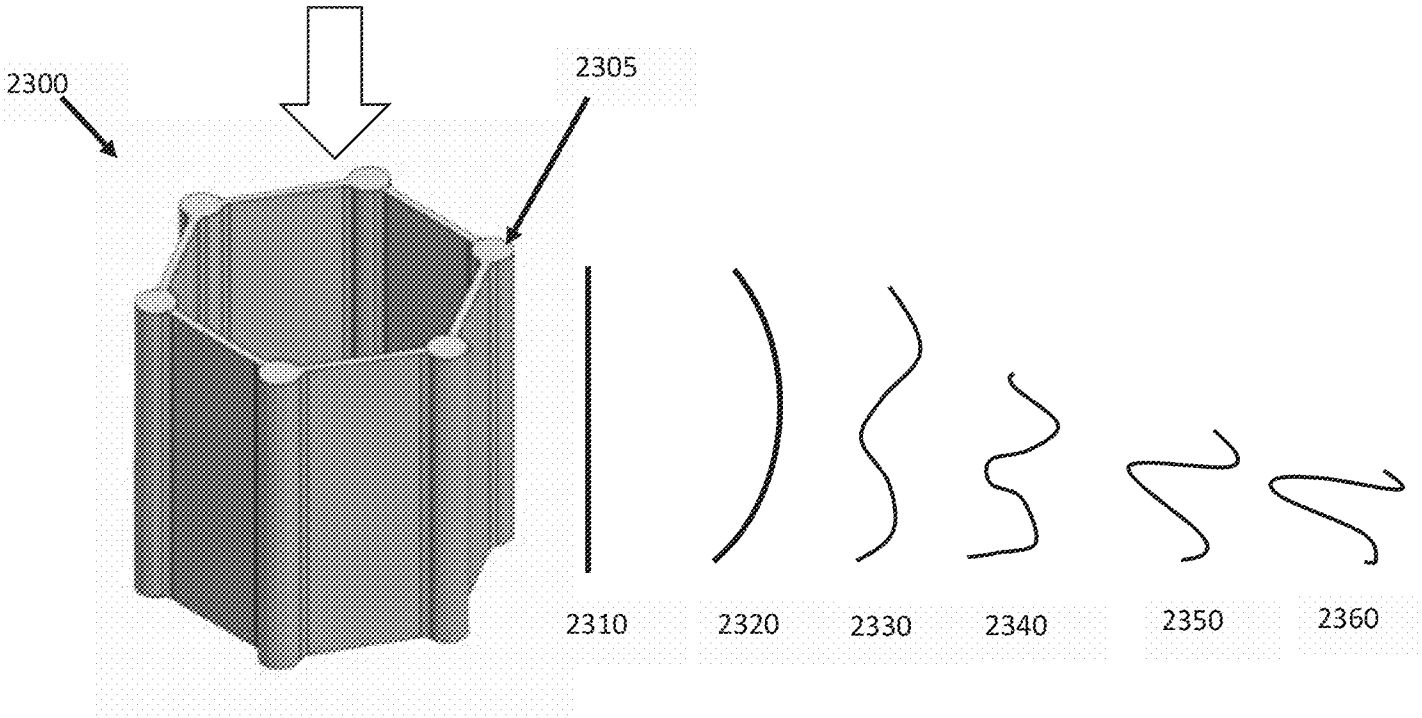
FIG. 22D depicts a perspective view of another embodiment of a hexagonal impact absorbing element, with an exemplary potential mechanical behavior of one filament element undergoing progressive buckling depicted in a simplified format.

FIG. 22D shows a perspective view of a hexagonal impact absorbing element 2300, with an exemplary progressive mechanical behavior of one filament element 2305 (in this embodiment connected only to a face sheet at its bottom end) as the hexagonal structure undergoes buckling induced by an axial compressive force. In this embodiment, the filament in initially in a generally straightened condition 2310, with the compressive force F initially causing the upper and/or central regions of the filament to displace laterally to some degree 2320 (corresponding to possible stretching, compression and/or "rippling" of the lateral walls), with the central region of the filament bowing slightly outward (causing a portion of the hexagonal structure to assume a slight barrel-like shape). Further compression of the hexagonal element by the force may reach a point where one or more of the filaments begin to buckle 2330, which can include buckling of a portion of the filament inwards towards the center of the hexagonal structure, with other portions of the filament buckling outward (i.e., potentially taking an "accordion" shape as the hexagonal structure buckles), which may be accompanied by asymmetric failure of some or all of the hexagonal structure (i.e., "toppling" or tilting of the hexagonal structure to one side). Further compression of the hexagonal structure should desirably progressively increase the collapse of the filaments 2340, which may include filament and/or wall structures overlapping each other to varying degrees 2350. Eventually, increased the compressive loading should eventually completely collapse the hexagonal structure and associated filaments/walls 2360, at which point the array may reach a "bottomed out" condition, in which further compression occurs mainly via compressive thinning or elastic/plastic "flowing" of the collapsed material bed (not shown). Desirably, once the compressive load is removed, the individual filaments and/or walls of the hexagonal structure will rebound to approximate their original un-deformed shape, awaiting a new load.

In various embodiments, the presence of the lateral walls between the filaments of the hexagonal structure can greatly facilitate recovery and/or rebound of the filament and hexagonal elements as compared to the independent filaments within a traditional filament bed. During buckling and collapse of the filaments and hexagonal structures, the lateral walls desirably constrain and control filament "failure" in various predictable manners, with the walls and/or filaments elastically deforming in various ways, similar to the "charging" of a spring, as the hexagonal structure collapses. When the compressive force is released from the hexagonal structure, the walls and filaments should elastically deform back to their original "unstressed" or prestressed sheet-like condition, which desirably causes the entirety of the hexagonal structure and associated filaments/walls to quickly "snap back" to their original position and orientation, immediately ready for the next compressive force.

The disclosed embodiments also confer another significant advantage over current filament array designs, in that the presence, orientation and dimensions of the lateral walls and attached filaments can confer significant axial, lateral and/or torsional stability and/or flexibility to the entirety of the array, which can include the creation of orthotropic impact absorbing structures having unique properties when measured along different directions. More importantly, one unique features of these closed polygonal structures (and to some extent, open polygonal structures in various alternative configurations) is that the orthotropic properties of the hexagonal structures and/or the entirety of the impact absorbing array can often be "tuned" or "tailored" by alterations and/or changes in the individual structural elements, wherein the alteration of one element can significantly affect one property (i.e., axial load resistance and/or buckling strength) without significantly altering other properties (i.e., lateral and/or torsional resistance of the structural element). In various embodiments, this can be utilized to create a protective garment that responds differently to different forces acting in different areas of the garment.

Figure 23A:
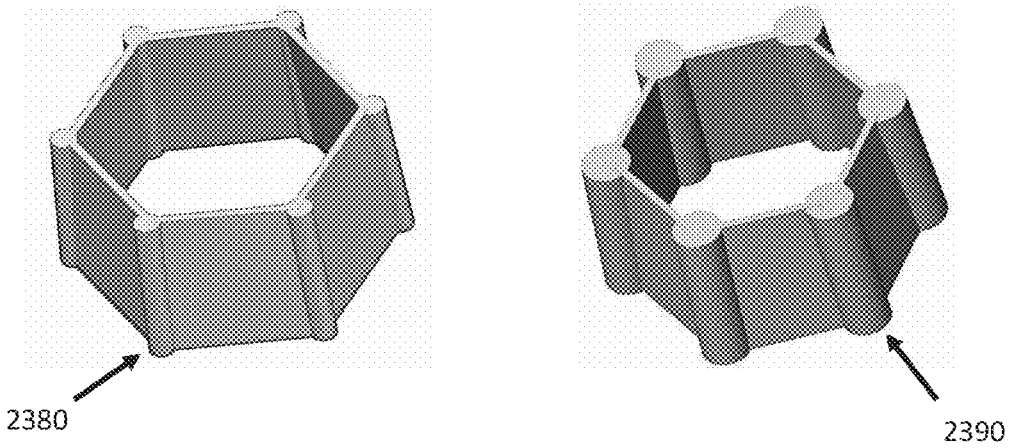
FIG. 23A depicts alternative embodiments of hexagonal elements incorporating thinner or thicker filament diameters.

Desirably, alterations in the structural, dimensional and/or material components of a given design of an array element will alter some component(s) of its orthotropic response to loading. For example, FIG. 23A depicts a first hexagonal element 2380 having relatively small diameter filaments of a certain length, and a second hexagonal element 2390 having relatively larger diameter filaments of the same height or offset. When incorporated into respective impact absorbing arrays of repeating elements of similar design, these elements would desirably perform equivalently in torsional and/or shear loading, with the second array (i.e., having the array having the second hexagonal elements 2390) having greater resistance to deformation and/or buckling under axial compressive loading than the first array (having the first hexagonal elements). In a similar manner, the thickness, dimensions and/or material composition of the lateral walls can have significant impact on the lateral and/or torsional response of the structure, with alterations in these structures desirably increasing, decreasing and/or otherwise altering the resistance of the element's torsional and/or lateral loading response, while minimizing changes to the axial compression response. For example, one embodiment of a hexagonal structure may have a tapered configuration. The hexagonal structure can have a top surface and a bottom surface, with the bottom surface perimeter (and/or bottom surface thickness/diameter of the individual elements) may be larger than the corresponding top surface perimeter (and/or individual element thickness/diameter).

Figure 23B:
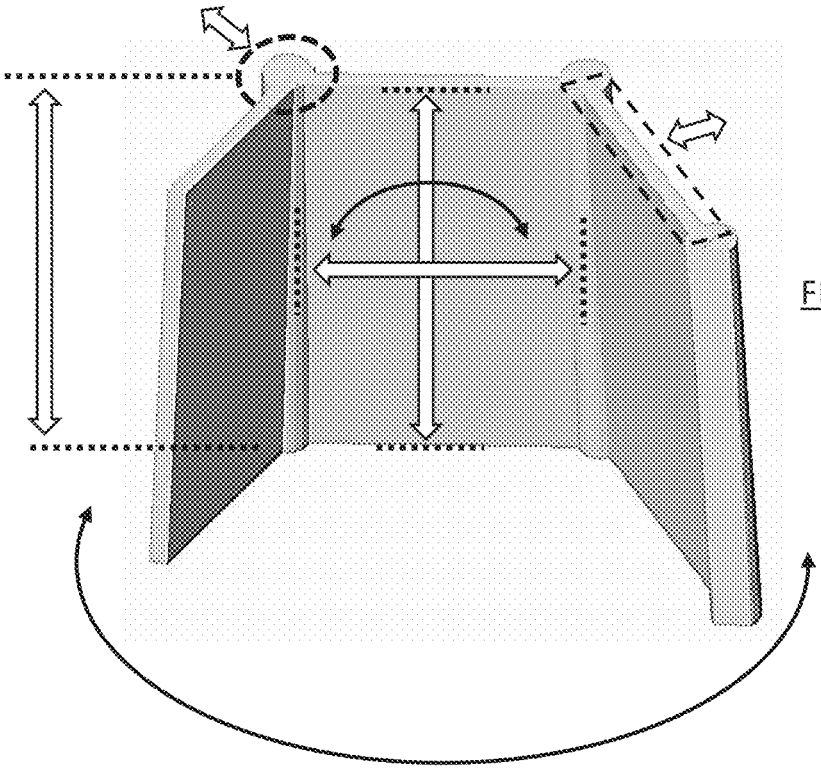
FIG. 23B depicts a cross-sectional portion of an exemplary hexagonal element, identifying some of the structural features, alignments and/or dimensions that could be altered to tune or tailor the element to a desired performance.
Figure 24:
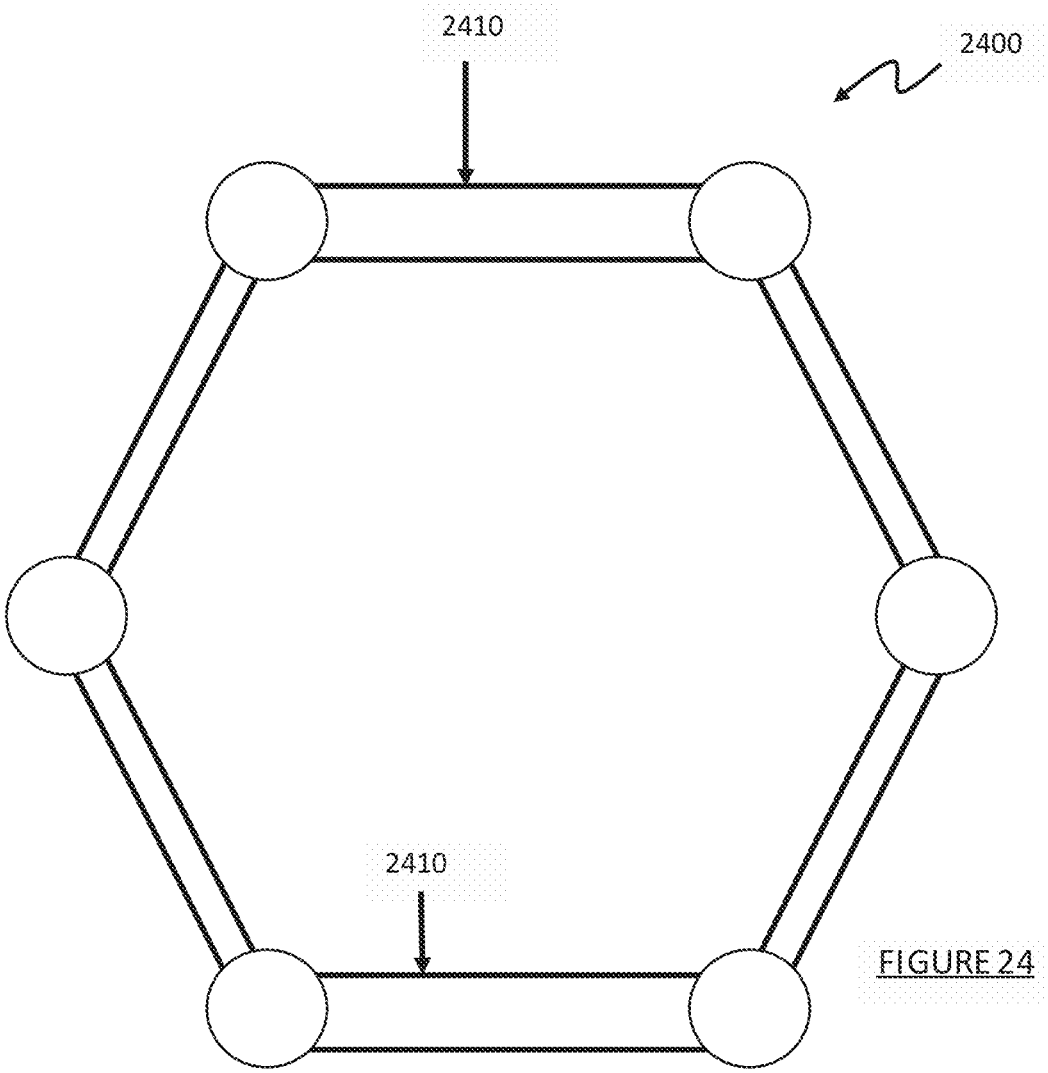
FIG. 24 depicts a top plan view of another embodiment of a hexagonal impact absorbing element incorporating lateral walls of differing thicknesses in the same element.

If desired, the hexagonal elements of an impact absorbing array can include components of varying size, shape and/or material within a single element, such as filaments of different diameter and/or shape within a single element and/or within an array of repeating elements. For example, the orthotropic response of the hexagonal element 2400 depicted in FIG. 24 can be altered by increasing the thickness of one set of lateral walls 2410, while incorporating thinner lateral walls 2420 in the remaining lateral walls, if desired. This can have the effect of "stiffening" the lateral and/or torsional response of the structure in one or more directions, while limiting changes to the axial response. As show in FIG. 23B, a wide variety of structural features and dimensions, as well as material changes, can be utilized to "tune" or "tailor" the element to a desired performance, which could include in-plane and/or out-of-plane rotation of various hexagonal elements relative to the remainder of elements within an array.

Figure 25A:
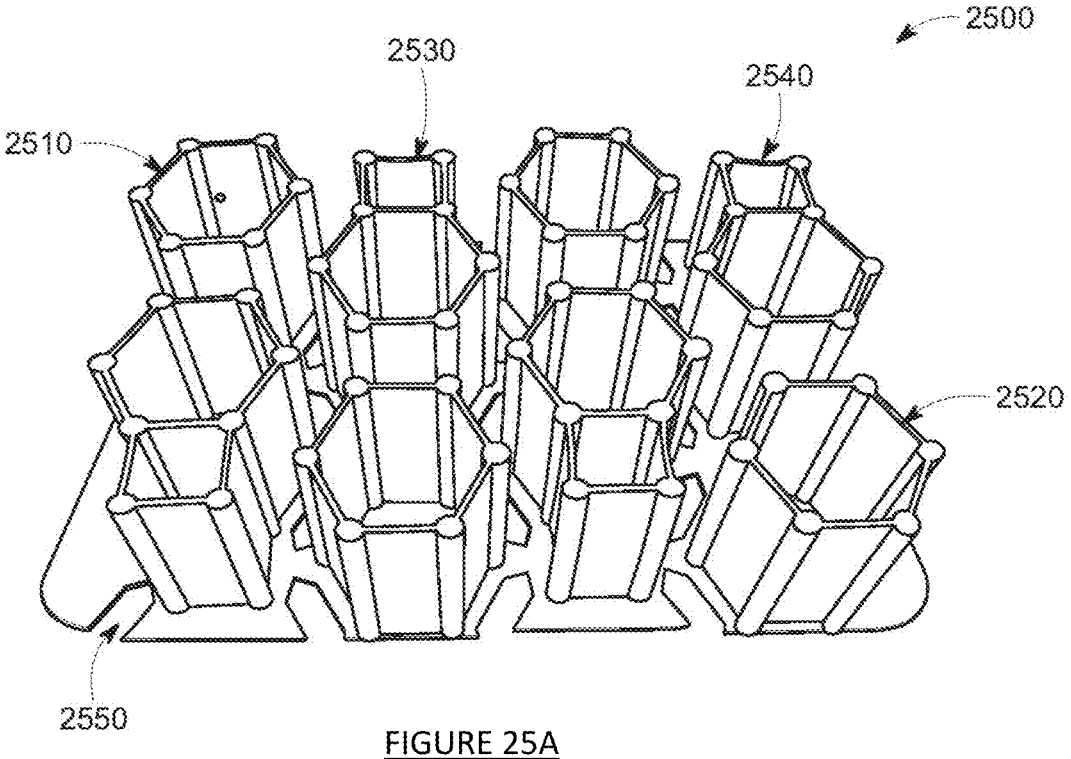
FIG. 25A depicts a perspective view of one embodiment of an impact absorbing array incorporating closed polygonal elements, including hexagonal elements and square elements.
Figure 25B:
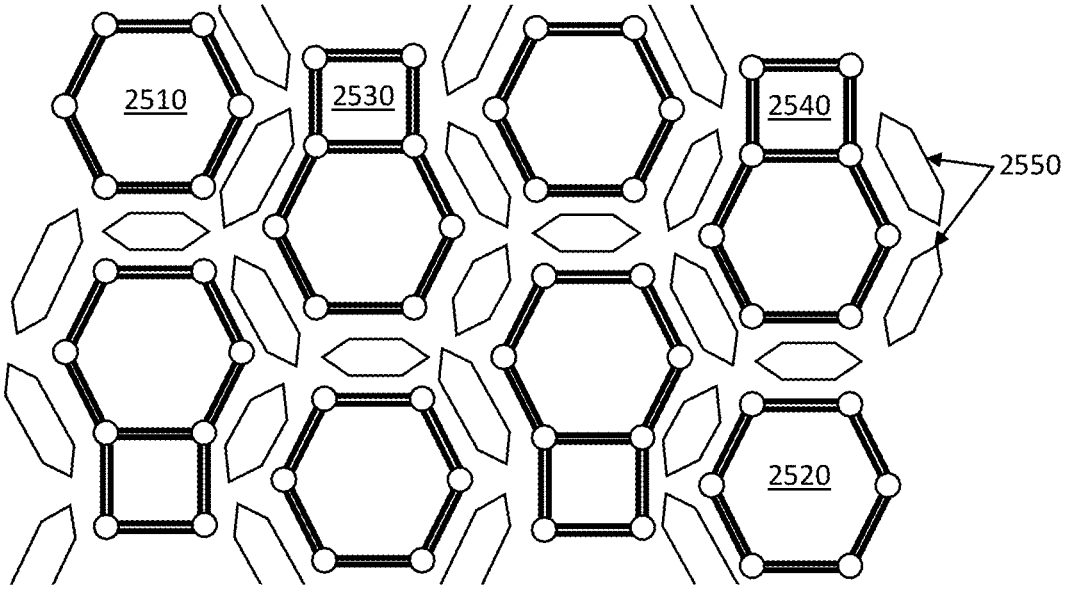
FIG. 25B is a simplified top plan view of the impact absorbing array and lower face sheet of FIG. 25A.
Figure 25C:
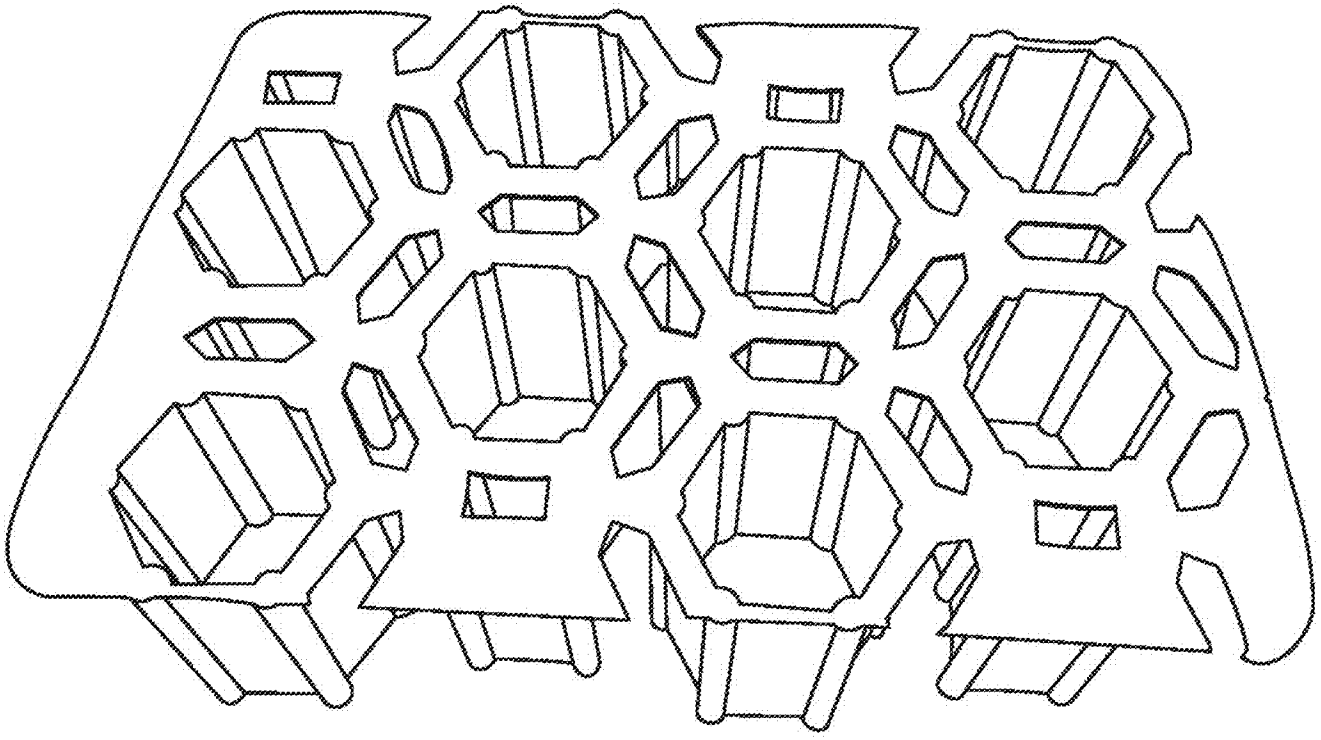
FIG. 25C is a bottom perspective view of the pierced lower face sheet and associated impact absorbing array of FIG. 25A.

In various embodiments, one or more array elements could comprise non-symmetrical open and/or closed polygonal structures, including polygonal structures of differing shapes and/or sizes in a single impact absorbing array. For example, FIGS. 25A and 25C depict top and bottom perspective views of one embodiment of an impact absorbing array 2500 incorporating closed polygonal elements, including hexagonal elements 2510 and 2520, and square elements 2530 and 2540. FIG. 25B depicts a simplified top plan view of the array of FIG. 25A. If desired, the individual polygonal elements can be spaced apart and/or attached to each other at various locations, including proximate the peripheral edges of the array (which may allow for attachment of "stray elements" near the edges of the array, where a complete repeating pattern of a single polygonal element design may be difficult and/or impossible to achieve). Also depicted are various holes or perforations 2550 in the face sheet, which desirably reduce the weight of the face sheet and can also significantly increase the flexibility of the face sheet and the resulting impact absorbing array. These perforations may be positioned in a repeating pattern of similar size and/or shaped holes, or the perforations may comprise a variety of shapes, sizes and/or orientations in the face sheet of a single array. The perforated face sheet may be directly affixed to the product (e.g., helmet, footwear and protective clothing) or a thin-walled polycarbonate backsheet may be additionally affixed to the perforated face sheet. The perforated face sheet may have a back surface where the polycarbonate backsheet may be affixed. The polycarbonate backsheet may improve load distribution throughout the hexagonal structures, may provide more comfort for direct contact with the wearer and/or may assist with a more uniform adherence to the product.

Figure 25D:
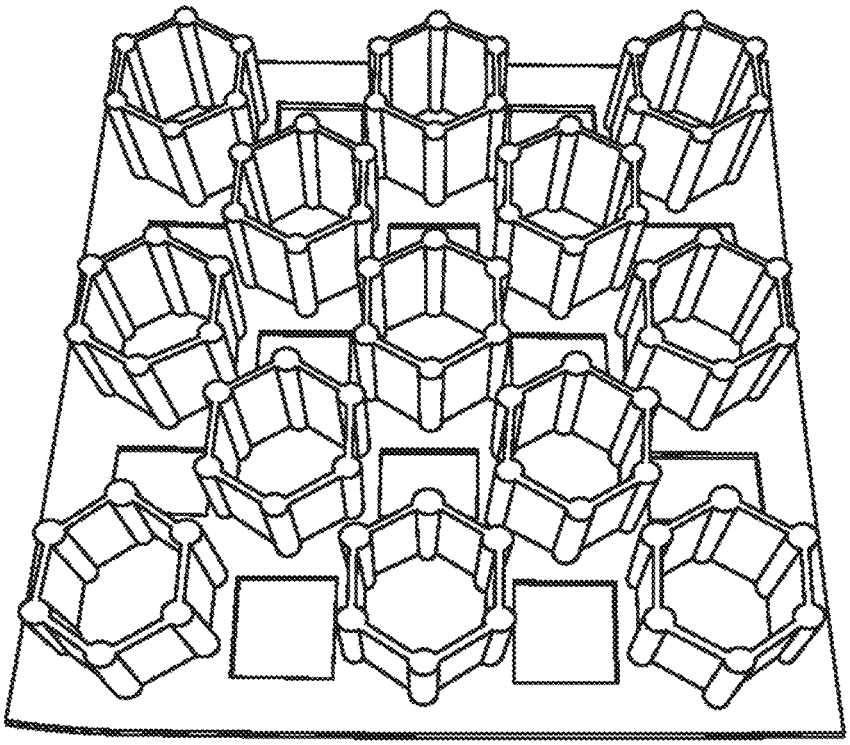
FIGS. 25D and 25E are top and bottom perspective views of another alternative embodiment of an impact absorbing array, with hexagonal elements connected to a lower face sheet and the lower face sheet is perforated by generally hexagonal openings underneath the hexagonal elements and square holes positioned between the hexagonal elements.
Figure 25E:
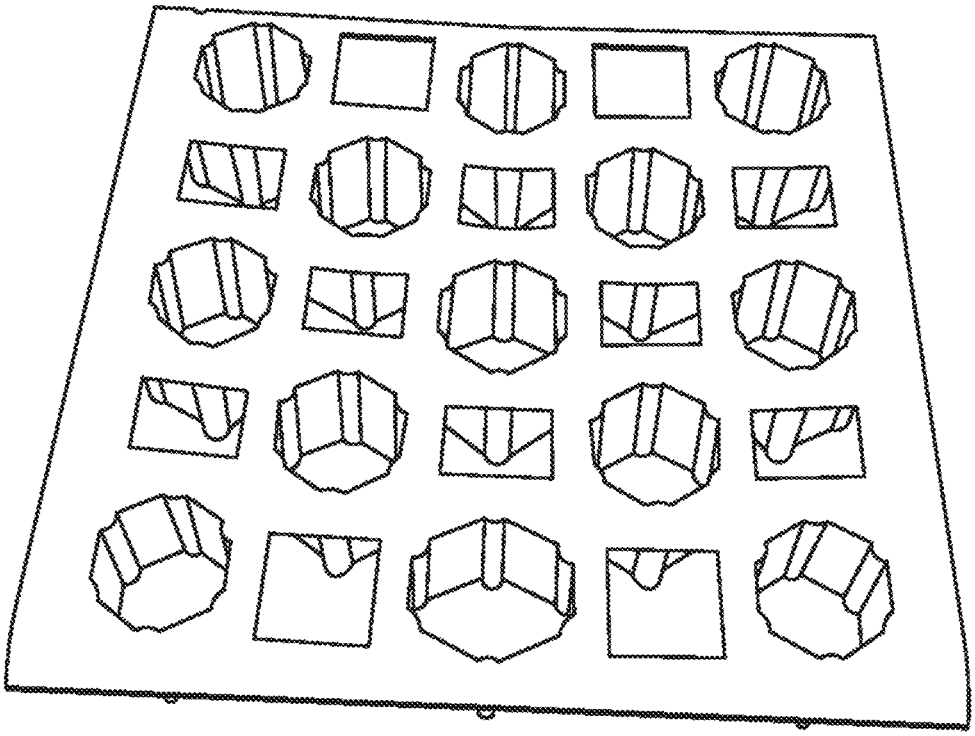

FIGS. 25D and 25E depict top and bottom perspective views of another alternative embodiment of an impact absorbing array, with hexagonal elements connected to a lower face sheet, wherein the lower face sheet is perforated by generally hexagonal openings underneath the hexagonal elements and square holes positioned between the hexagonal elements.

Figure 26A:
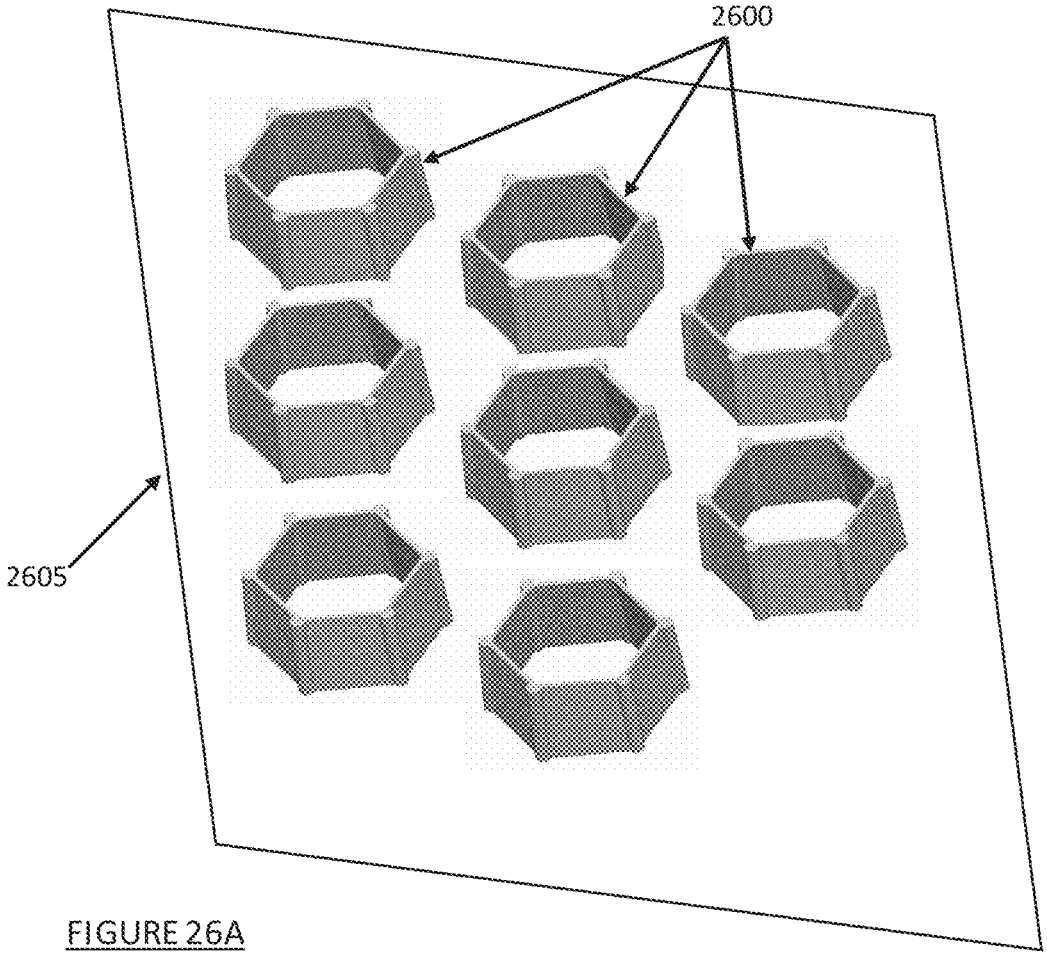
FIG. 26A depicts an alternative embodiment of an impact absorbing array comprising a plurality of hexagonal elements in a generally repeating symmetrical arrangement.
Figure 26B:
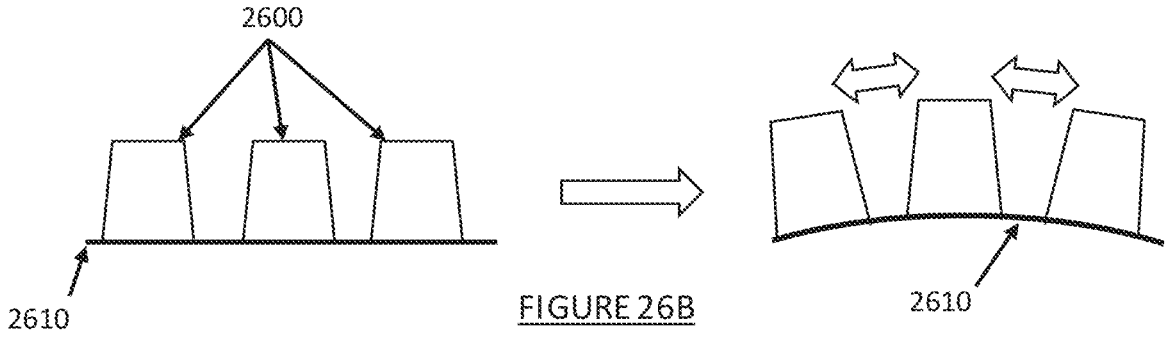
FIG. 26B depicts how elements of the impact absorbing array of FIG. 26A can be redistributed to accommodate bending of the lower face sheet.

FIG. 26A depicts an exemplary impact absorbing array comprising a plurality of hexagonal elements 2600 in a generally repeating symmetrical arrangement. In this embodiment, the elements 2600 are connected to each other by a lower face sheet 2605, which can optionally include connection by a pierced or "lace-like" lower face sheet, if desired. An upper portion of each of the elements 2600 in this embodiment is desirably not connected by an upper face sheet, which consequently allows the lower face sheet 2610 (and thus the array) to easily be bent, twisted and/or otherwise shaped or "flexed" to follow a hemispherical or curved shape (See FIG. 26B), including an ability to deform the lower sheet and associated array elements around corners and/or edges or other complex surfaces, if desired. In this manner, the array elements can be manufactured in sheet form, if desired, and then the array sheet can be manipulated to conform to a desired shape (i.e., the hemispherical interior of an athletic or military helmet, for example) without significantly affecting the shape and/or impact absorbing performance of the hexagonal elements therein. In some embodiments, the lower face sheet may curve smoothly, while in other embodiments the lower face sheet may curve and/or flex primarily at locations between hexagonal or other elements, while maintaining a relatively flat profile underneath individual polygonal elements.

Figure 26C:
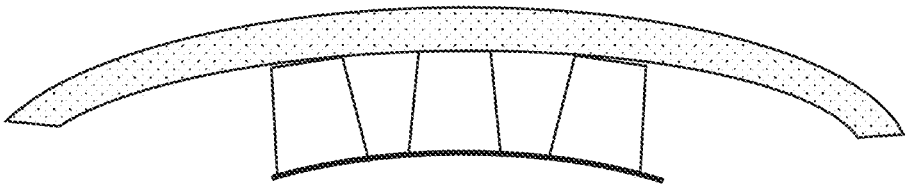
FIGS. 26C and 26D depict how bending of the face sheet of the impact absorbing array of FIG. 26A in different directions and array orientation can affect element density and/or alignment.
Figure 26D:
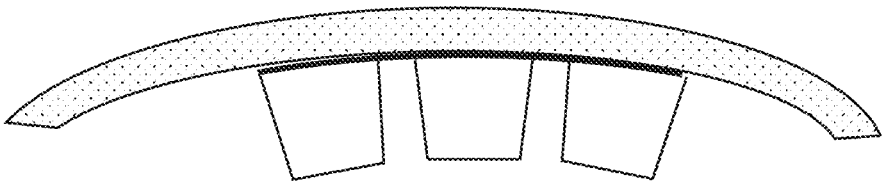

FIG. 26C depicts one embodiment of how flexing or bending of a flat array can result in repositioning of the polygonal elements relative to an external contact surface. For example, FIG. 26C shows that upward flexing of the center of the flat array (to match the curved inner surface of the helmet) can cause the upper ends of the individual elements to separate to some degree, which may affect the response of the array to incident forces on the helmet. In contrast, FIG. 26D depicts the same array with the center of the array flexed in an opposing direction, which brings the upper ends of the individual elements in closer proximity to each other, which can alter the response of the array to incident forces on the helmet as compared to that of FIG. 26C.

In various alternative embodiments, an upper face sheet can be connected to the upper portion of the elements, if desired. In such arrangements, the upper face sheet could comprise a substantially flexible material that allows flexing of the array in a desired manner, or the upper face sheet could be a more rigid material that is attached to the array after flexing and/or other manipulation of the lower face sheet and associated elements has occurred, thereby allowing he array to be manufactured in a flat-sheet configuration.

Figure 27A:
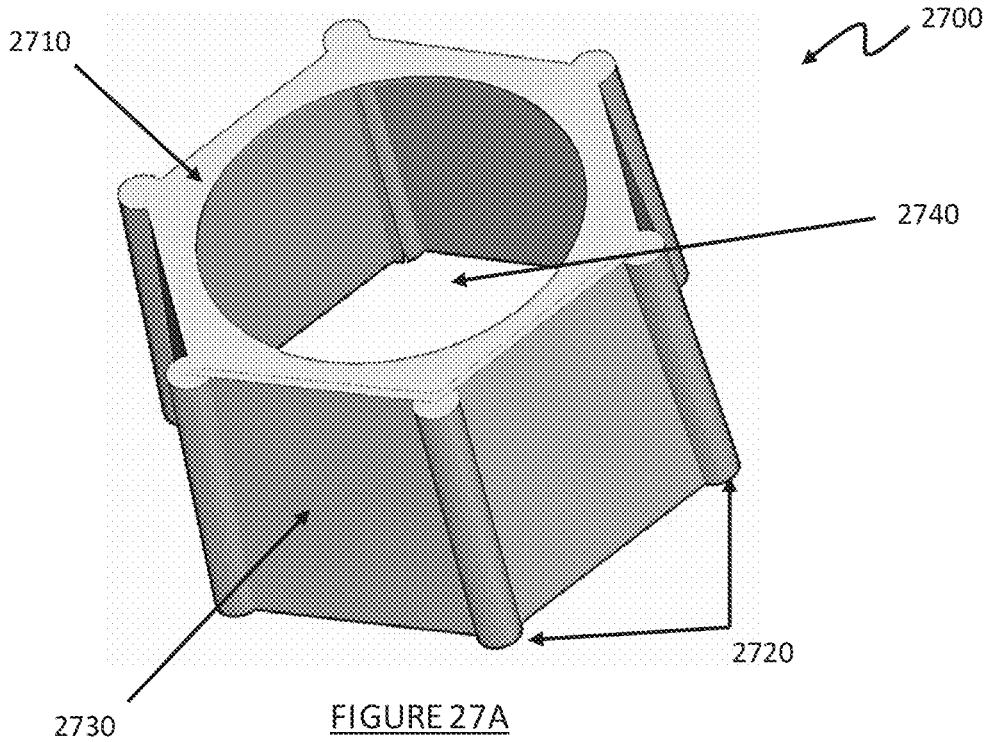
FIG. 27A depicts a perspective view of another alternative embodiment of a hexagonal impact absorbing element which incorporates an upper ridge feature.
Figure 27B:
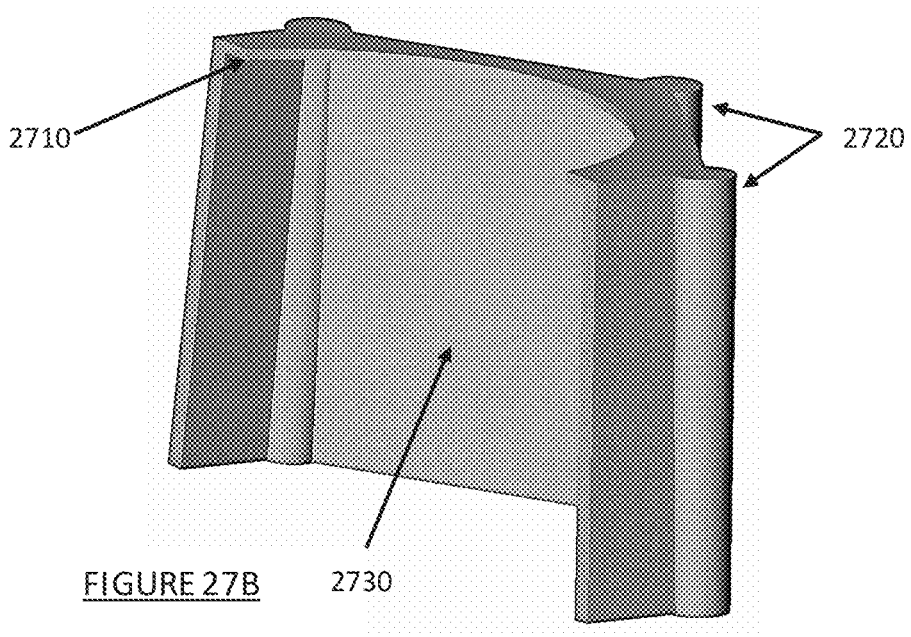
FIG. 27B depicts a cross-sectional view of the hexagonal impact absorbing element of FIG. 27A.

FIGS. 27A and 27B depict perspective and cross-sectional views of one alternative embodiment of a hexagonal impact absorbing element 2700, which incorporates an upper ridge 2710 at the upper end of the filaments 2720, with the upper ridge connected to the upper ends of the filaments and upper portions of the lateral walls 2730. In this embodiment, the upper ridge 2710 includes an open or perforated central section 2740, which in alternative embodiments could be formed in a variety of opening shapes and/or configurations, including circular, oval, triangular, square, pentagonal, hexagonal, septagonal, octagonal and/or any other shape, including shapes that mimic or approximate the shape of the polygonal element. In other alternative embodiments, the upper ridge could comprise a continuous sheet that covers the entirety of the upper surface of the element, or could include a plurality of perforations or holes (i.e., a perforated regular or irregular lattice and/or lace-like structure).

One significant advantage of incorporating an upper ridge into the hexagon element is a potential increase in the "stiffness" and rebound force/speed of the hexagon element as compared to the open elements of FIG. 26A. The addition of the upper ridge can, in various configurations, function in some ways similar to an upper face sheet attached to the element, in that the upper ridge can constrain movement of the upper end of the filaments in various ways, and also serve to stiffen the lateral walls to some degree. This can have the desired effect of altering the response of the element to lateral and/or torsional loading, with various opening sizes, configurations and sheet thickness having varying effect on the lateral and/or torsional response. Moreover, the addition of the upper ridge can increase the speed and/or intensity at which the element (and/or components thereof) "rebounds" from a compressed, buckled and/or collapsed state, which can improve the speed at which the array can accommodate repeated impacts. In addition, the incorporation of the upper ridge can reduce stress concentrations that may be inherent in the various component connections during loading, including reducing the opportunity for plastic flow and/or cracking/fracture of component materials during impacts and/or repetitive loading.

Figure 28A:
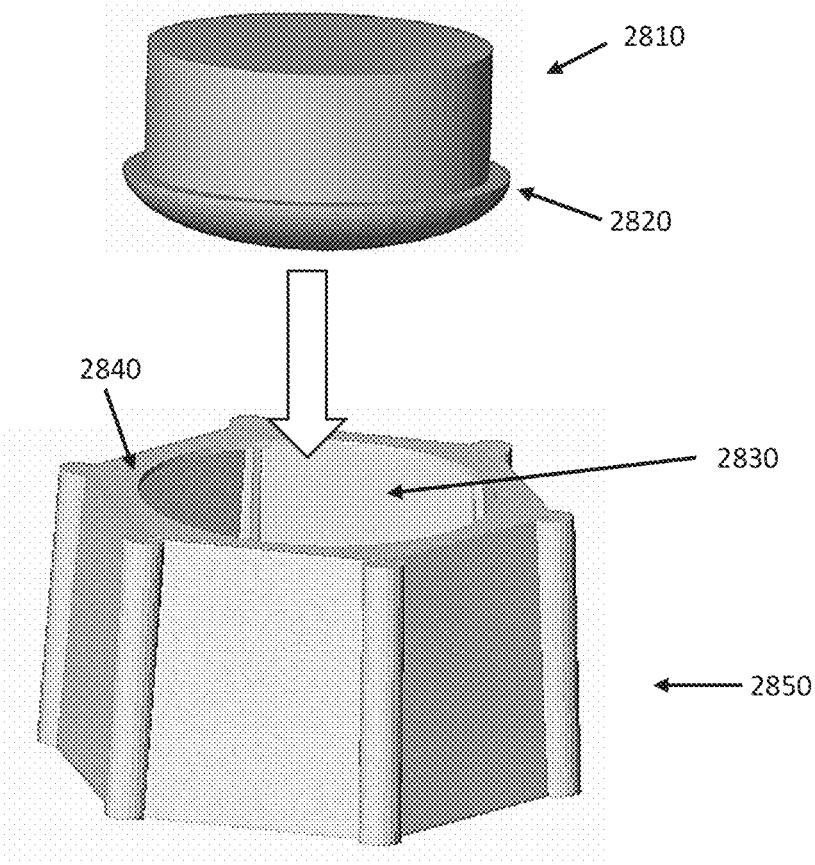
FIG. 28A depicts an engagement insert, grommet or plug for insertion into the hexagonal element of FIG. 27A.
Figure 28B:
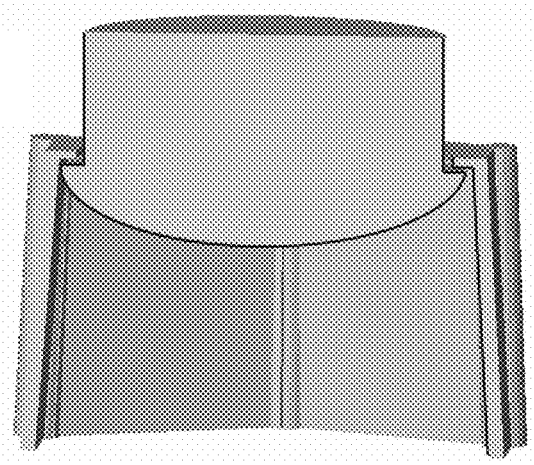
FIG. 28B depicts the insert of FIG. 28A engaged with the hexagonal element of FIG. 27A.

The incorporation of the upper ridge can also facilitate connection of the upper end of the element to another structure, such as an inner surface of a helmet or other item of protective clothing. FIG. 28A depicts an engagement insert, grommet or plug 2810 having an enlarged tip 2820 that is desirably slightly larger than the opening 2830 in the upper ridge 2840 of the hexagonal element 2850. In use, the enlarged tip 2820 can desirably be pushed through the opening 2830, with the tip and/or opening comprising a material sufficiently flexible to permit the tip and/or opening to deform slightly and, once the tip is through the opening, allows the tip and an inner surface of the ridge to engage, which desirably retains the tip within the element 2850 (with the plug 2810 desirably attached or secured to some other item such as the inner surface of the helmet)-see FIG. 28B. If desired, the inner surface of the ridge and/or the engaging surface of the tip could include a flat and/or saw-tooth configuration, for greater retention force. In various embodiments, the plug may be connected to the helmet or other item with an adjustable and/or sliding connector (not shown), for greater flexibility and/or comfort for the wearer.

Figure 28C:
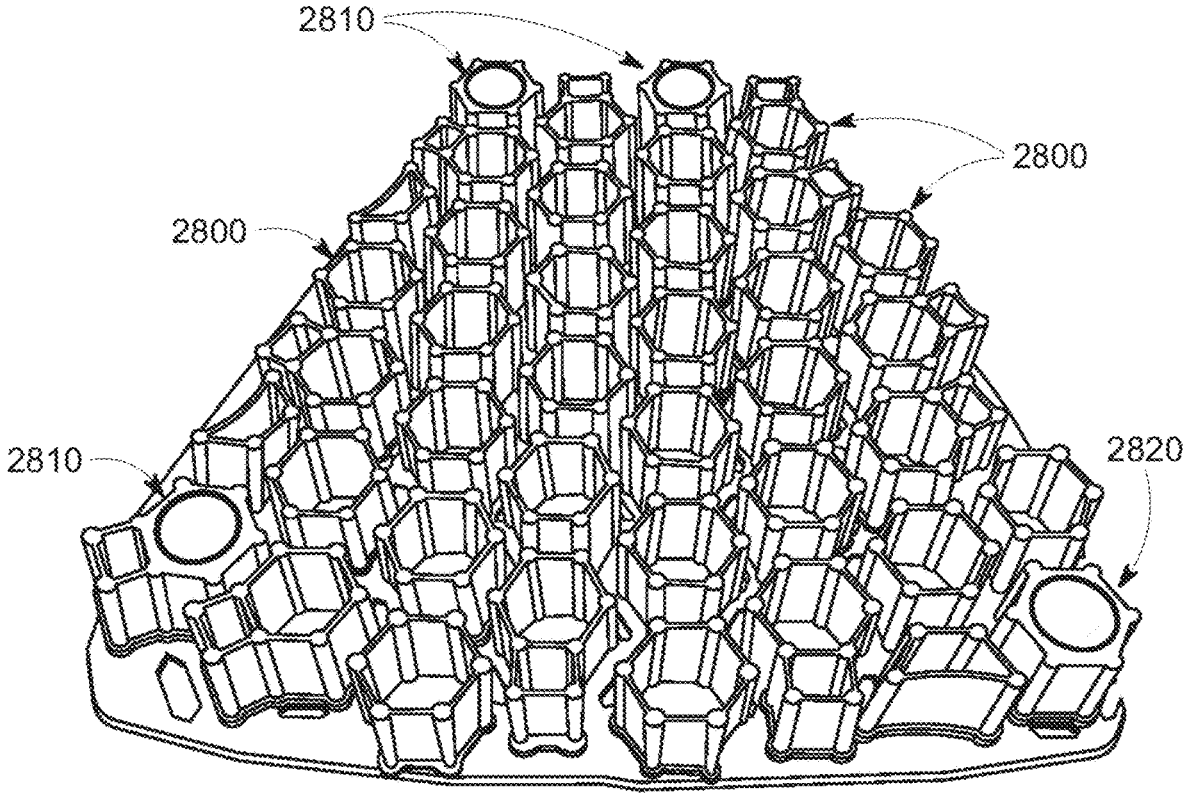
FIGS. 28C, 28D and 28E depicts various alternative embodiments of impact absorbing arrays incorporating hexagonal elements with integral engagement features.
Figure 28D:
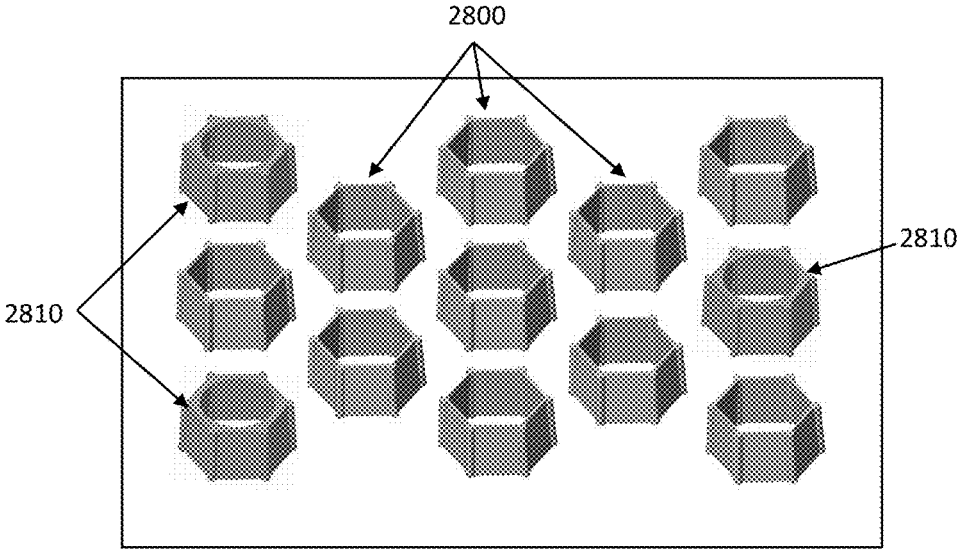

In various embodiments, an impact absorbing array of hexagonal and/or other shaped elements can comprise one or more elements having an upper ridge engagement feature for securement of the array to an item of clothing or other structure. For example, FIGS. 28C and 28D depict alternative impact absorbing array configurations in which a series of hexagonal elements 2800 are bounded at various edges by hexagonal engaging elements 2810, which can desirably be engaged with plugs or other inserts for securement to other items.

Figure 28E:
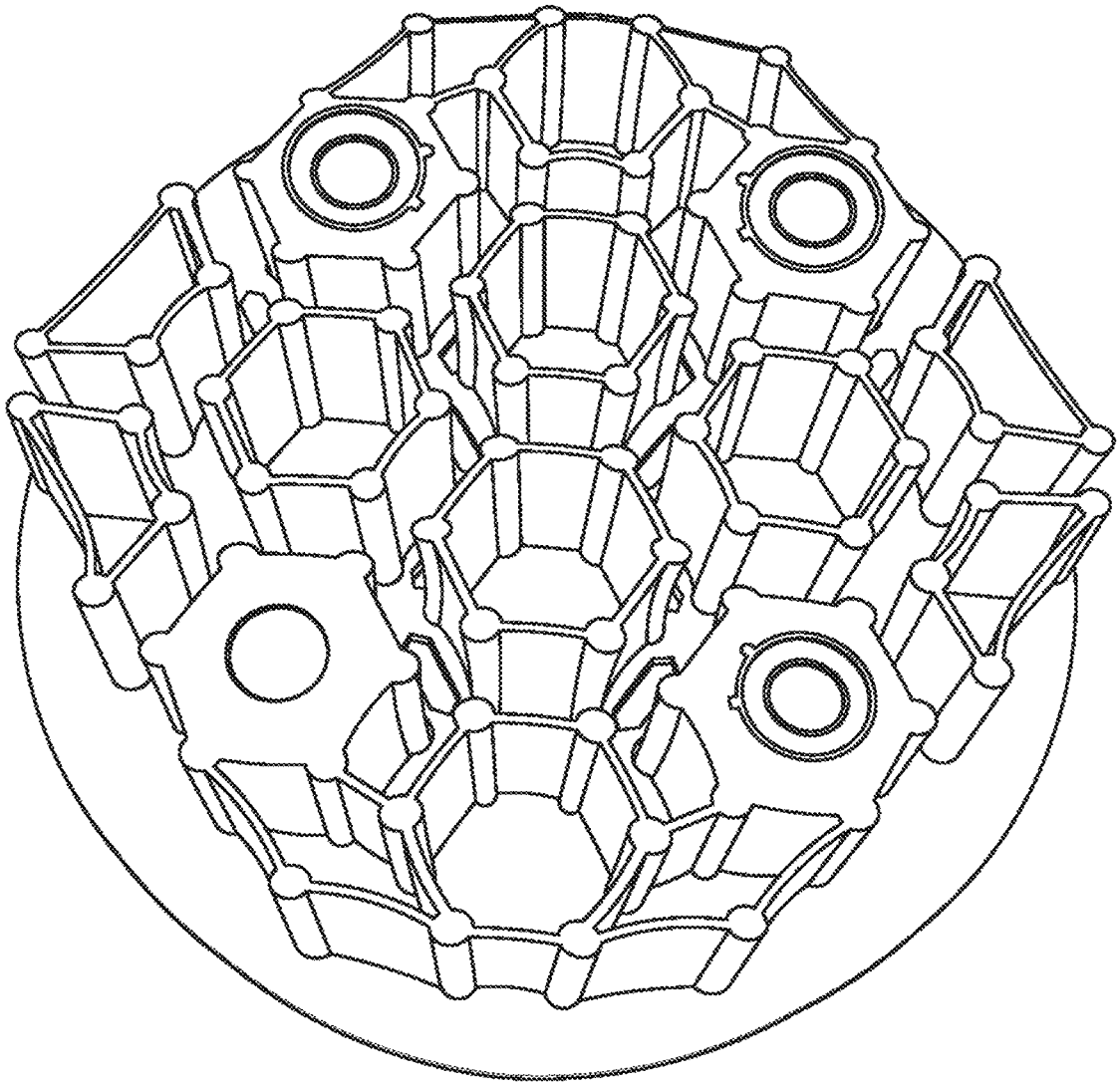
Figure 28F:
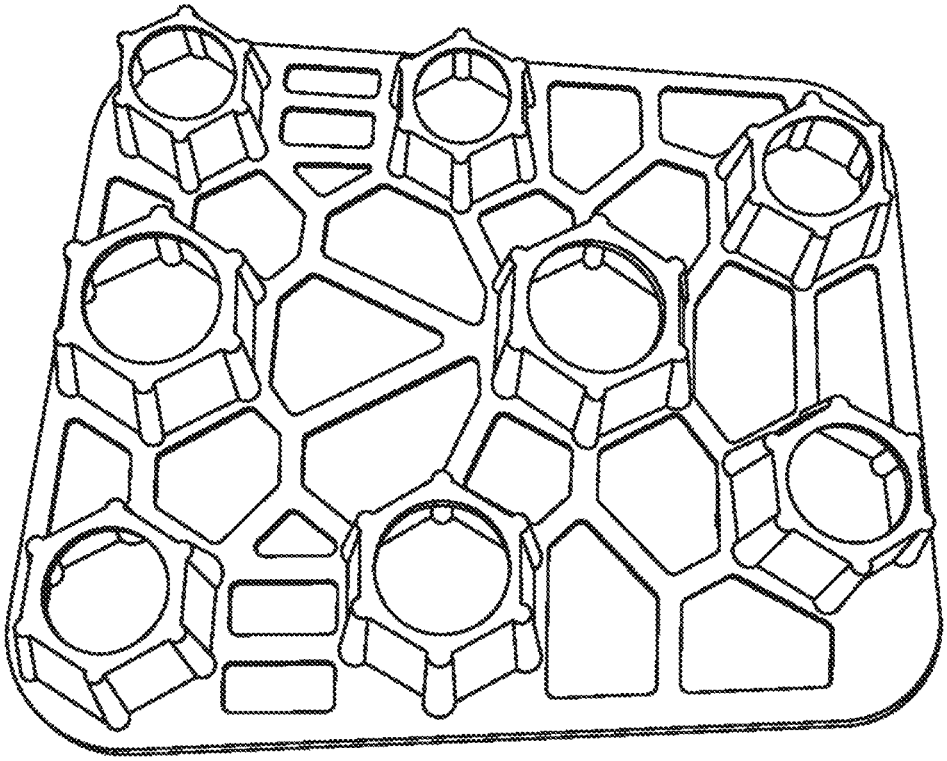
FIGS. 28F and 28G depict top and bottom perspective views of another alternative embodiment of an impact absorbing array.
Figure 28G:
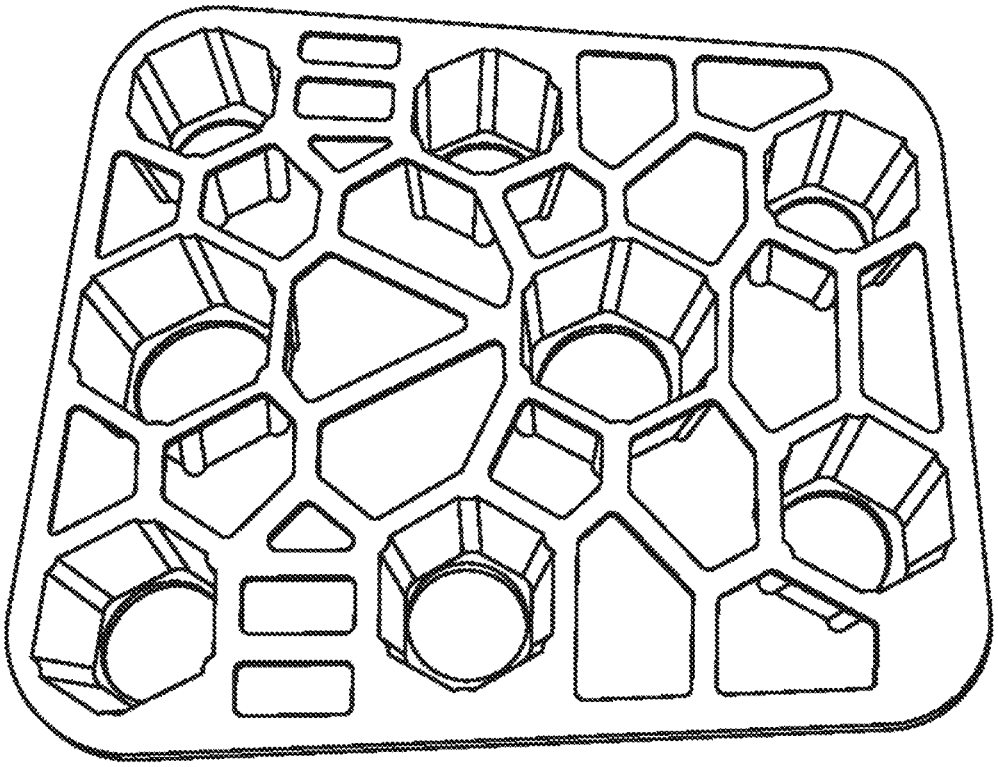

While various embodiments are depicted with the engaging elements proximate to a periphery of the array, it should also be understood that the engaging elements could similarly be incorporated throughout the array in various locations (see FIG. 28E), including the use of such elements in the center and/or throughout the entirety of the array. For example, FIGS. 28F and 28G depict an impact absorbing array comprising eight irregularly-spaced hexagonal elements, with all of the hexagonal elements including an upper ridge that could permit the element to be utilized as an engaging element. If desired, 1, 2, 3, 4, 5, 6, 7 or all 8 of the depicted elements could be engaged to corresponding inserts, grommets or plugs (not shown) for securing the array in a desired location and/or orientation.

FIG. 29 depicts another alternative embodiment of an impact absorbing array comprising fourteen regularly-spaced elements, 10 of which are hexagonal and 4 of which are approximately triangular elements, with all of the depicted elements including an upper ridge structure that could permit the element to be utilized as an engaging element. As depicted, the hexagonal and triangular elements each desirably utilize a different design, size, shape and/or other arrangements of plugs (not shown). If both differing plug types were utilized on a helmet or other protective garment, then the array for attachment thereto might need to be properly oriented and/or positioned relative to the plugs before attachment could be accomplished, which could ensure proper placement and/or orientation of the array in a desired location of a helmet or other item of clothing which corresponds to the different plugs for the triangular and hexagonal elements.

In various embodiments, the patterns of element placement and spacing of elements could vary widely, including the use of regular and/or irregular spacing or element placement, as well as higher and/or lower densities of elements in particular locations no a given array. For a given element design, size and/or orientation, the different patterns and/or spacing of the elements will often significantly affect the impact absorption qualities and/or impact response of the array, which provides the array designer with an additional set of configurable qualities for tuning and/or tailoring the array design such that a desired impact performance is obtained (or optimized) from an array which is sized and configured to fit within an available space, such as between a helmet and a wearer's head.

In various alternative embodiments, composite impact absorbing arrays could be constructed that incorporate various layers of materials, including one or more impact absorbing array layers incorporating closed and/or open polygonal element layers and/or other lateral wall supports. Desirably, composite impact absorbing arrays could be utilized to replace and/or retrofit existing impact absorbing layer materials in helmets and/or other articles of protective clothing, as well as for non-protective clothing uses including, but not limited to, floor mats, shock absorbing or ballistic blankets, armor panels, packing materials and/or surface treatments. In many cases, impact absorbing arrays such as described herein can be designed to provide superior impact absorbing performance to an equivalent or lesser thickness of foam or other cushioning materials being currently utilized in impact absorbing applications. Where existing impact absorbing materials can be removed from an existing item (a military or sports helmet, for example), one or more replacement impact absorbing arrays and/or composite arrays, such as those described herein, can be designed and retro-fitted in place of the removed material(s), desirably improving the protective performance of the item.

Depending upon layer design, material selections and required performance characteristics, impact absorbing arrays incorporating closed and/or open polygonal element layers and/or other lateral wall supports such as described herein can often be designed to incorporate a lower offset (i.e., a lesser thickness) than a layer of foam or other impact absorbing materials providing some equivalence in performance. This reduction in thickness has the added benefit of allowing for the incorporation of additional thicknesses of cushioning or other materials in a retrofit and/or replacement activity, such as the incorporation of a thin layer of comfort foam or other material bonded or otherwise positioned adjacent to the replacement impact absorbing array layer(s), with the comfort foam in contact with the wearer's body. Where existing materials are being replaced on an item (i.e., retro-fitted to a helmet or other protective clothing item), this could result in greatly improved impact absorbing performance of the item, improvement in wearer comfort and potentially a reduction in item weight. Alternatively, where a new item is being designed, the incorporation of the disclosed impact absorbing array layer(s) can allow the new item to be smaller and/or lighter that its prior counterpart, often with a concurrent improvement in performance and/or durability.

Figure 29A:
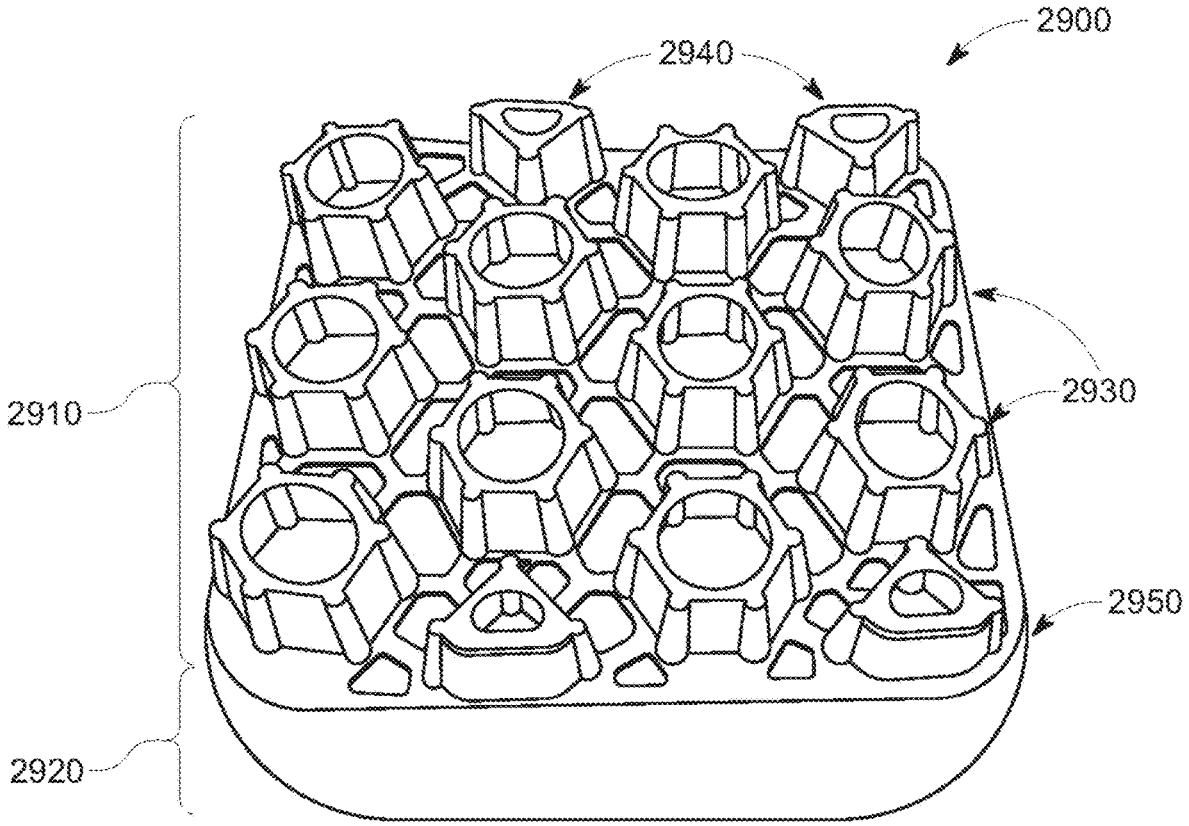
FIGS. 29A and 29B depict perspective and side plan views of another alternative embodiment of an impact absorbing array incorporating multiple composite layers.
Figure 29B:
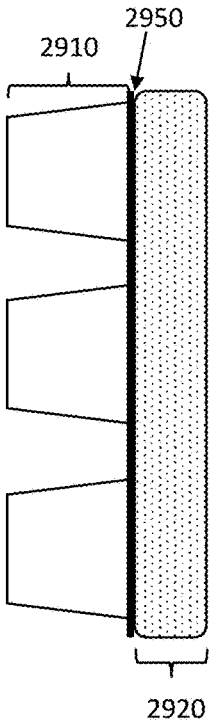

FIGS. 29A and 29B depicts various views of another alternative embodiment of an impact absorbing array or "composite" array 2900, comprising a polygonal element layer 2910 combined with a foam layer 2920. The polygonal element layer 2910 comprises a series of hexagonal elements 2930 and triangular elements 2940, which are connected to a lower face sheet 2950. The lower face sheet 2950 is in turn secured to the foam layer 2920, which may comprise a wide variety of foams or other materials. In the disclosed embodiment, the foam layer can comprise an open or closed cell "memory" foam, which is often utilized to contact a wearer's body to increase comfort, wearability and/or breathability of the impact absorbing array. In use, the composite array 2900 can be inserted into a desired item of protective clothing, such as into the interior of a helmet, with the array facing towards and/or away from the wearer's body, depending upon design and user preference. If desired, the impact absorbing array and/or foam layer assembly could be covered and/or layered with a durable, lightweight, thin fabric. The fabric may be constructed as a fully integrated component of the array, or could be removable and/or washable.

Figure 30A:
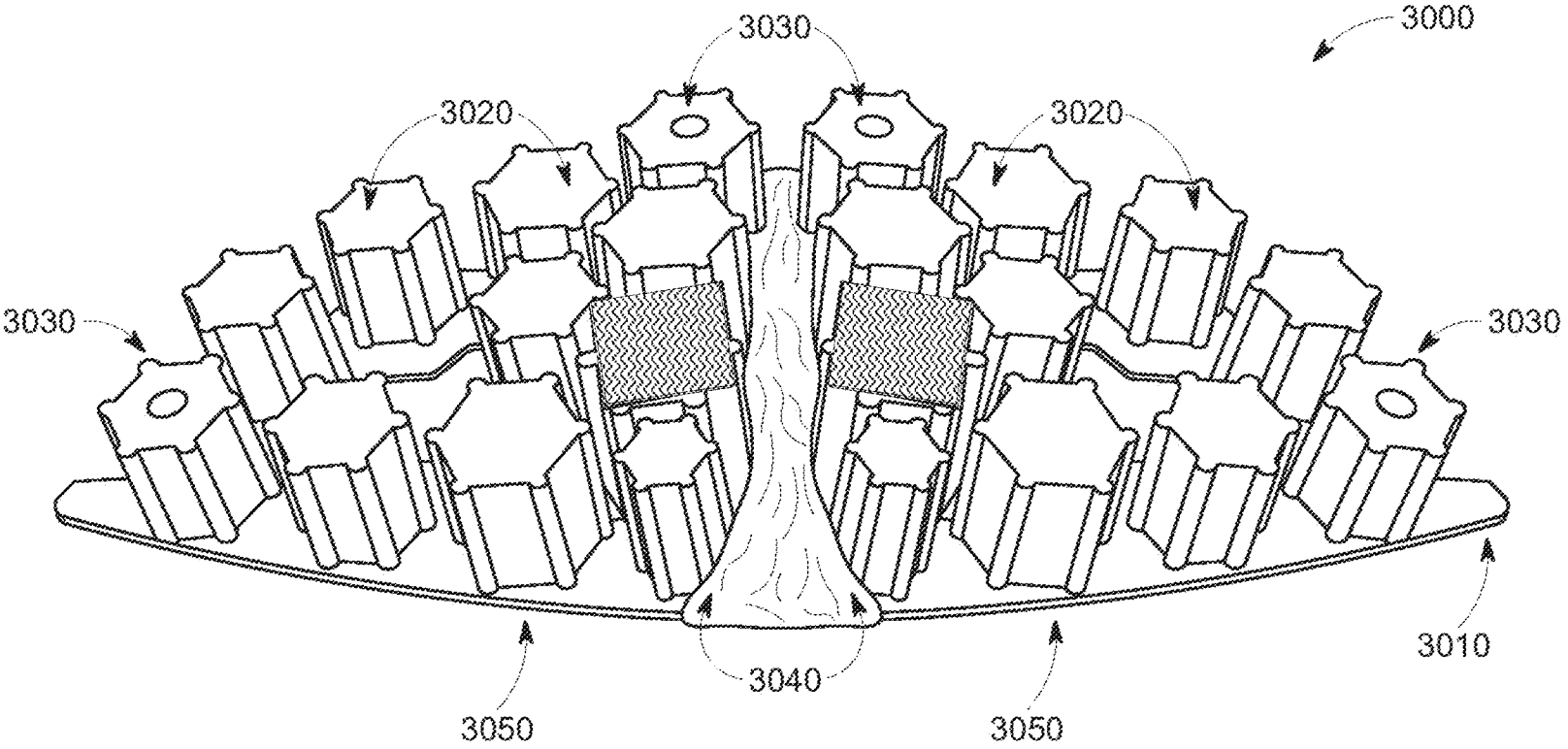
FIG. 30A depicts another alternative embodiment of an impact absorbing array incorporating some hexagonal elements having completely closed or sheet-like upper ridges.
Figure 30B:
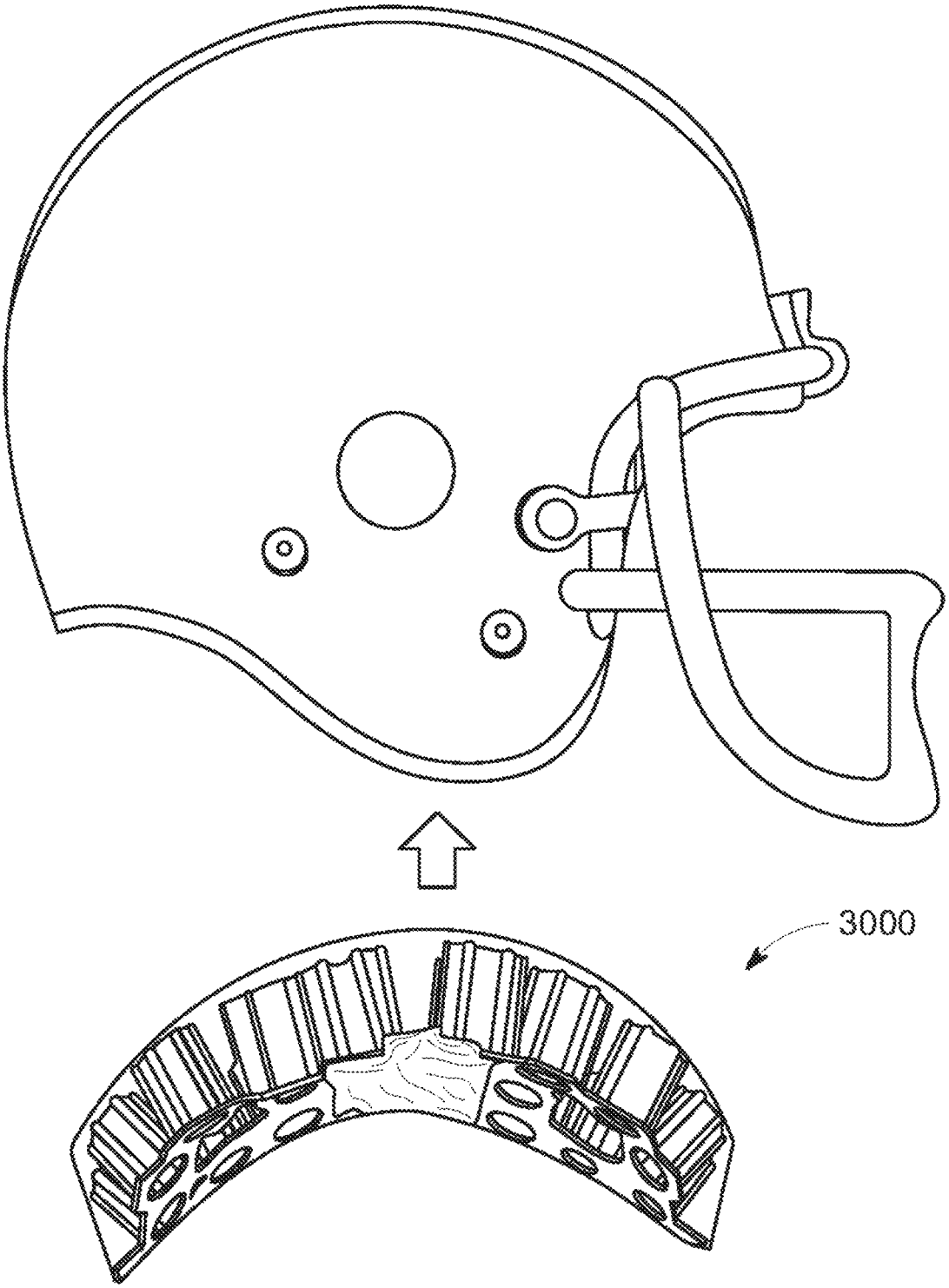
FIG. 30B depicts placement of the impact absorbing array of FIG. 30A into a helmet or other protective clothing, with the array flexed to accommodate a curved inner helmet surface.

FIG. 30A depicts a front perspective view of an impact absorbing array 3000 comprising a plurality of hexagonal elements interconnected by a lower face sheet 3010, with many of the hexagonal elements including completely closed or sheet-like upper ridges 3020, along with four peripheral hexagonal elements 3030 having upper ridges with engaging elements. Desirably, this array can be manufactured in a generally flat configuration (i.e., by using injection molding, extrusion and/or casting techniques), and then the lower sheet can be flexed or curved (see FIG. 30B) to accommodate a curved contact surface such as the interior of a helmet or other article of clothing.

The embodiment of FIG. 30A also depicts hexagonal elements of differing sizes incorporated into a single array, with a pair of smaller hexagonal elements 3040 proximate to a central region of the array, with larger hexagonal elements 3050 adjacent thereto. Such smaller elements can be designed to have some similar response to impact forces as the surrounding larger elements, or can provide differing responses. In this embodiment, the smaller elements 3040 desirably have a higher filament density (i.e., the filaments are closer together), which can provide a greater axial impact response, but with smaller walls which reduces the response to lateral and/or torsional loading. The smaller elements 3040 can also fit into a smaller space in the array, such as proximate to the lower edge.

In various embodiments, an array can be designed that incorporates open and/or closed polygonal elements of different heights or offsets in individual elements within a single array. Such designs could be particularly useful when replacing and/or retrofitting an existing helmet or other item of protective clothing, in that the impact absorbing array might be able to accommodate variations in the height of the space available for the replacement array. In such a case, the lower face sheet of the replacement array might be formed into a relatively flat, uniform surface, with the upper ends of the hexagonal elements therein having greater or lesser offsets, with longer elements desirably fitting into deeper voids in the inner surface of the helmet. When assembled with the helmet, the lower face sheet of the replacement array may be bent into a spherical or semispherical surface (desirably corresponding to the wearer's head), with the upper surfaces of the elements in contact with the inner surface of the helmet.

Figure 32B:
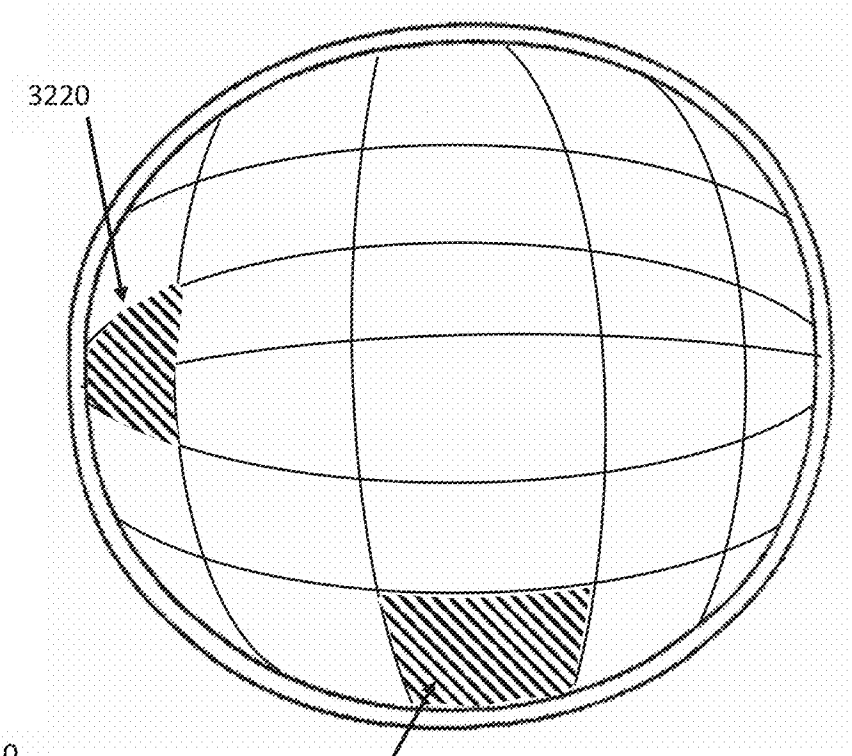
FIG. 32B depicts a bottom plan view of the inner shell or insert of FIG. 32A.
Figure 32A:
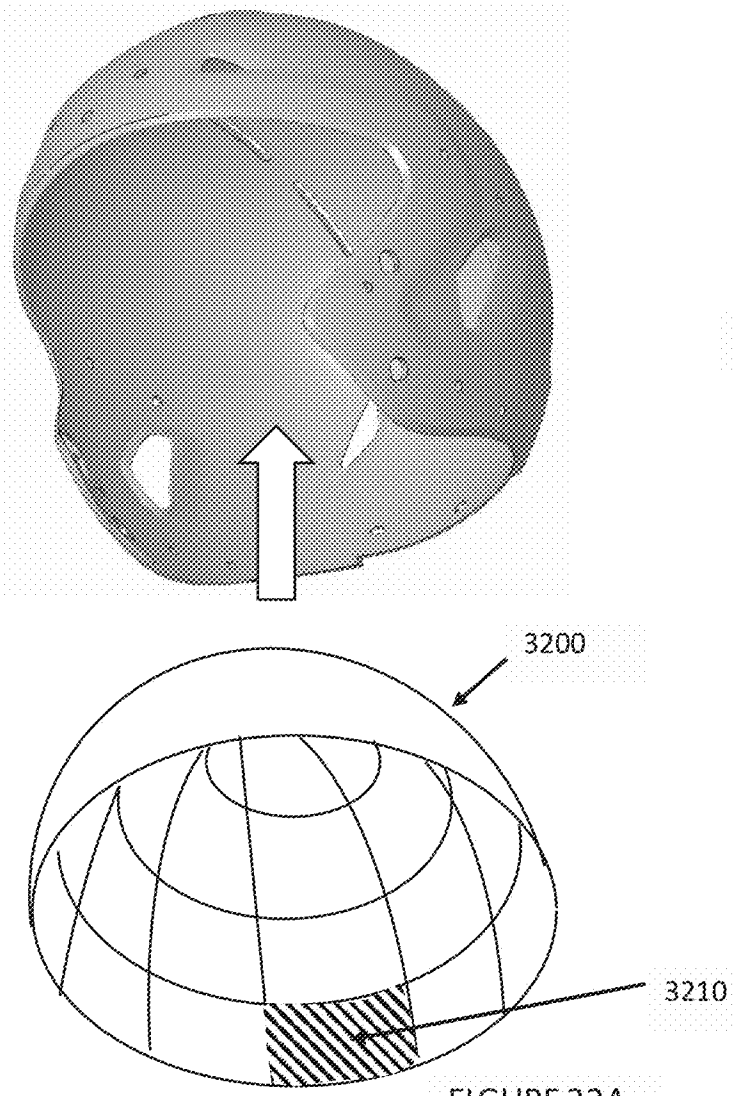
FIG. 32A depicts a perspective view of an inner shell or insert for securing modular impact absorbing arrays inside of a helmet or other protective garment.

In various embodiments, a helmet or other article of protective clothing could incorporate perforations and/or openings on an inner surface of the helmet or protective clothing and/or have a grid frame affixed to the inner surface. The openings provided in a grid-like or other pattern may desirably be sized and/or configured for attaching the various impact absorbing structures therein. Alternatively, an inner shell or other insert 3200 (See FIGS. 32A and 32B) could be provided that is positioned within and/or adjacent to the outer helmet shell, with the inner shell having openings, spaces, depressions and/or voids 3210, 3220 formed therein. In use, the inner shell could be attached to the outer shell (which could include permanent as well as non-permanent fixation to the out shell, if desired), with one or more impact absorbing arrays attached to the inner shell, with the array(s) comprising a plurality of open and/or closed hexagonal elements, the elements including features for connecting to one or more of the openings or depressions of the inner shell. If desired, the impact absorbing array(s) could comprise a composite or multi-layered array including open and/or closed polygonal impact absorbing elements layered with a foam layer and/or a covering sheet (i.e., a thin fabric layer), with the multi-layered array fitting into place into one or more of the openings in the inner shell of the helmet.

In various embodiments, the inner shell could be customized and/or particularized for a specific helmet design, which could include the ability to retrofit an existing protective helmet by removing existing pads and/or cushioning material and replacing some or all of them with an inner shell and appropriate impact absorbing arrays, as described herein. If desired, the customized inner shell could include modularly replaceable arrays of different sized, designs and/or thicknesses, which could include foam and/or fabric coverings for wearer comfort.

In at least one alternative design, the openings in the inner shell could be relatively small, circular openings formed in a regular or irregular array, such as in a colander-like arrangement, whereby the modular or segmented arrays and/or pads could include plugs or grommets sized and/or shaped to fit within the openings for securement to the inner shell. This arrangement could allow the arrays/pads to be secured the various locations and/or orientations within the helmet, desirably accommodating a wide variety of head shapes and/or sizes as well as providing improved comfort and/or safety to the wearer.

Figure 31A:
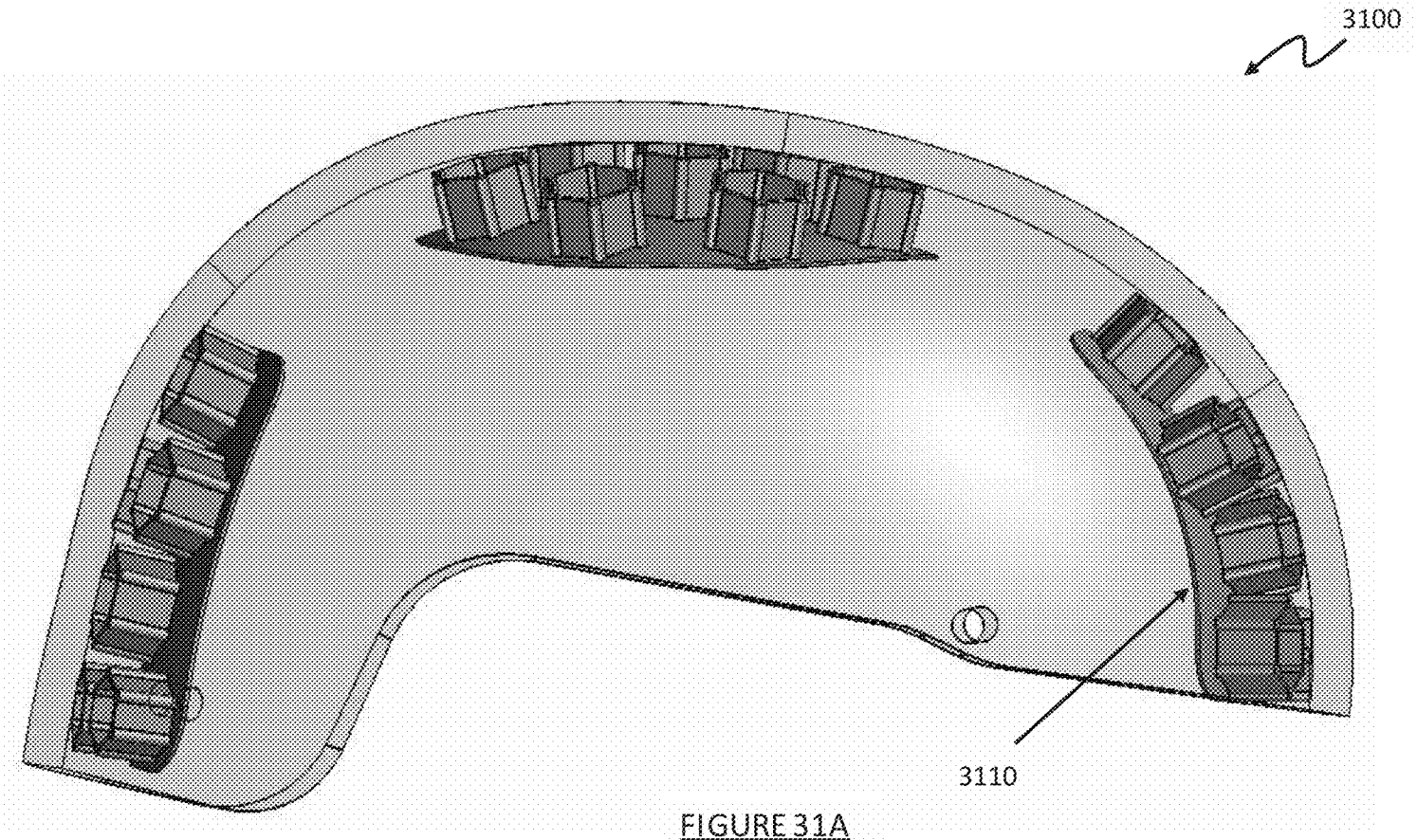
FIGS. 31A and 31B depict a side perspective and lower perspective views, respectively, of one alternative embodiment of a protective helmet including impact absorbing arrays with hexagonal elements.
Figure 31B:
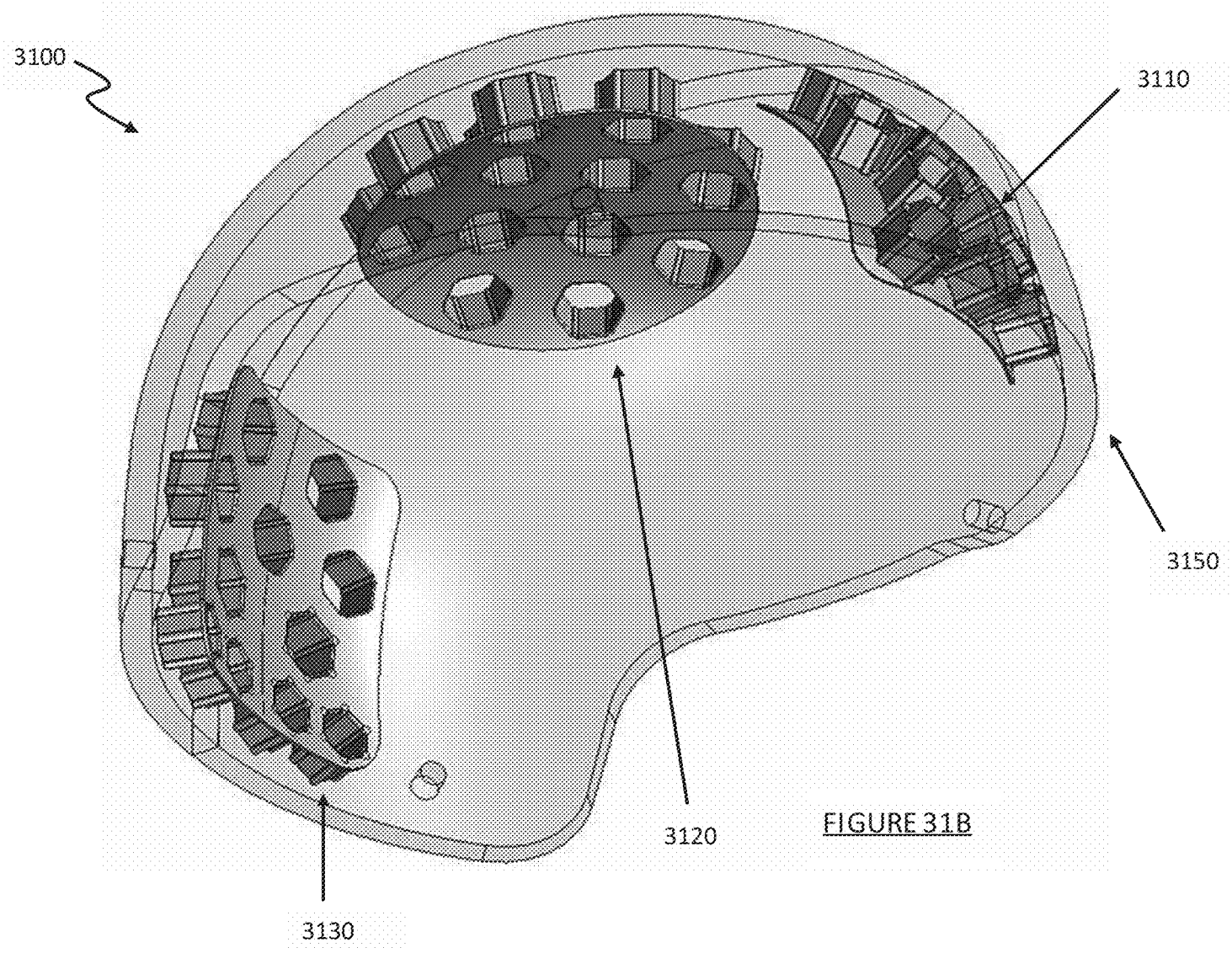

FIGS. 31A and 31B depict a side plan and lower perspective view, respectively, of one embodiment of a protective helmet 3100 including impact absorbing arrays 3110, 3120 and 3130 incorporating hexagonal elements, as described herein. In this embodiment, three impact absorbing arrays are provided, a front or brow array 3110, a crown or peak array 3120 and a rear or back array 3130. While not depicted here, additional arrays could be provided in the helmet, such as side arrays (not shown) located near the cars and/or temples of the wearer. Each segmented array can be customized to desired impact zones, the protective helmet profile or consumer's desired shape allowing variable offset and/or other variable dimensions of the each hexagonal structures on an array. The segmented or modular arrays could include more traditional padding and/or cushioning materials such as foam pads to increase comfort and fit, if desired.

Figure 31C:
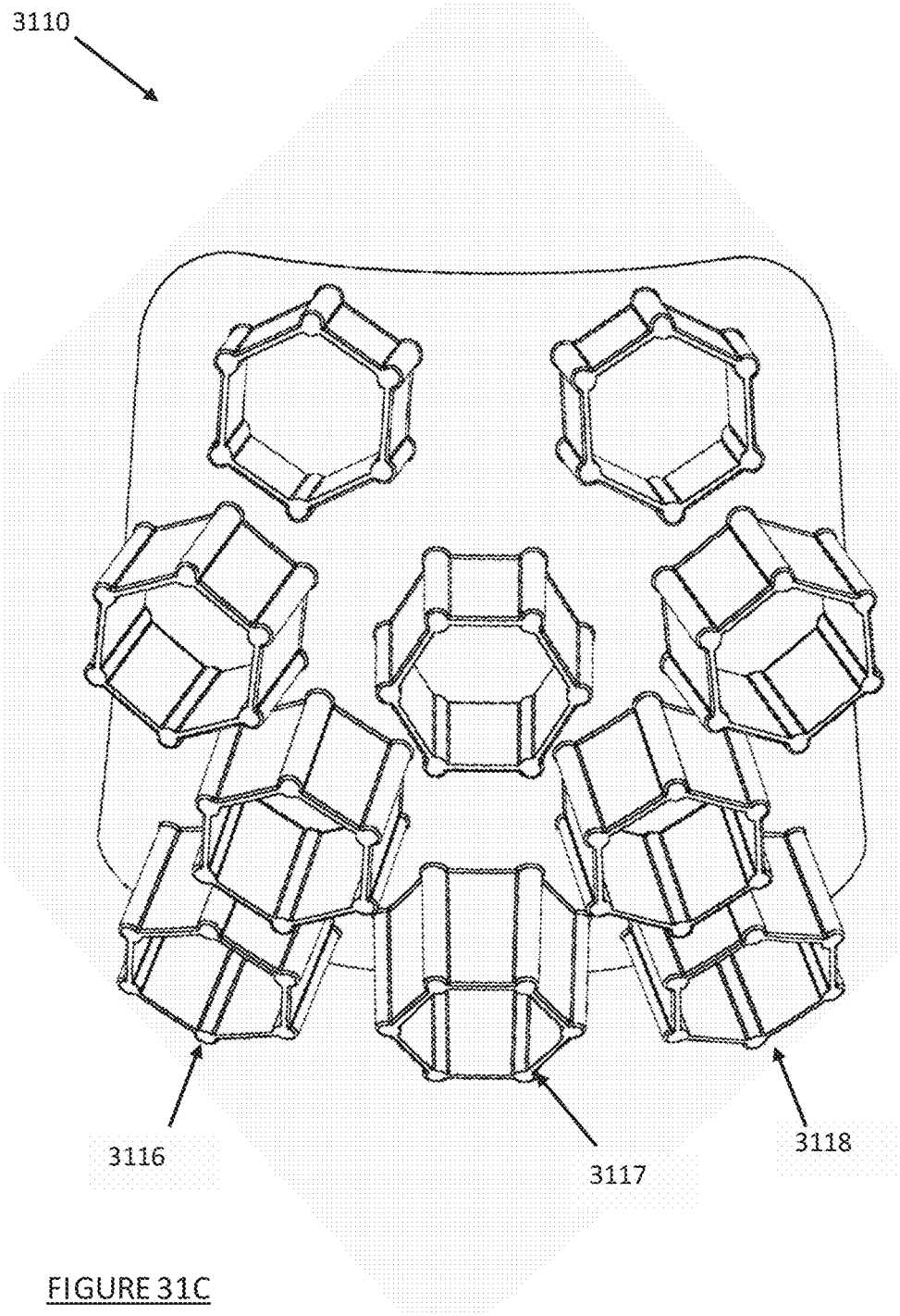
FIGS. 31C, 31D and 31E depict perspective views of the impact absorbing arrays of FIGS. 31A and 31B.

FIG. 31C depicts a perspective view of the brow array 3110, in which an array of hexagonal impact absorbing elements 3115. The positioning and design of the various hexagonal elements can be selected to provide a desired orthogonal response for the array to various forces incident to the helmet (i.e., axial, lateral and/or torsional impacts on the outer helmet). If desired, the hexagonal elements in a single array could be of similar design, or various elements could incorporate differing designs in a single array, including variations in filament diameter and/or offset, length, wall thickness, wall dimensions, element orientation and/or wall angulation within a single element or between elements within the same array. Where the array is being retrofitted into an existing helmet design, it may be necessary to tune or tailor the array design such that a desired impact performance is obtained (or optimized) from an array which is sized and configured to fit within the available space between the helmet and the wearer's head.

As best shown in FIG. 31C, the brow array 3110 is desirably designed to accommodate significant frontal impacts (as well as other impacts) to the face and brow of the helmet. Consequently, a series of three hexagonal elements 3116, 3117 and 3118 are aligned and positioned in close proximity to a front edge 3150 of the helmet 3100. During a frontal impact, these three elements, along with the remaining elements of the brow 3110 array, will desirably absorb, attenuate and/or ameliorate the effects of the frontal impact on the wearer, as described herein.

Figure 31D:
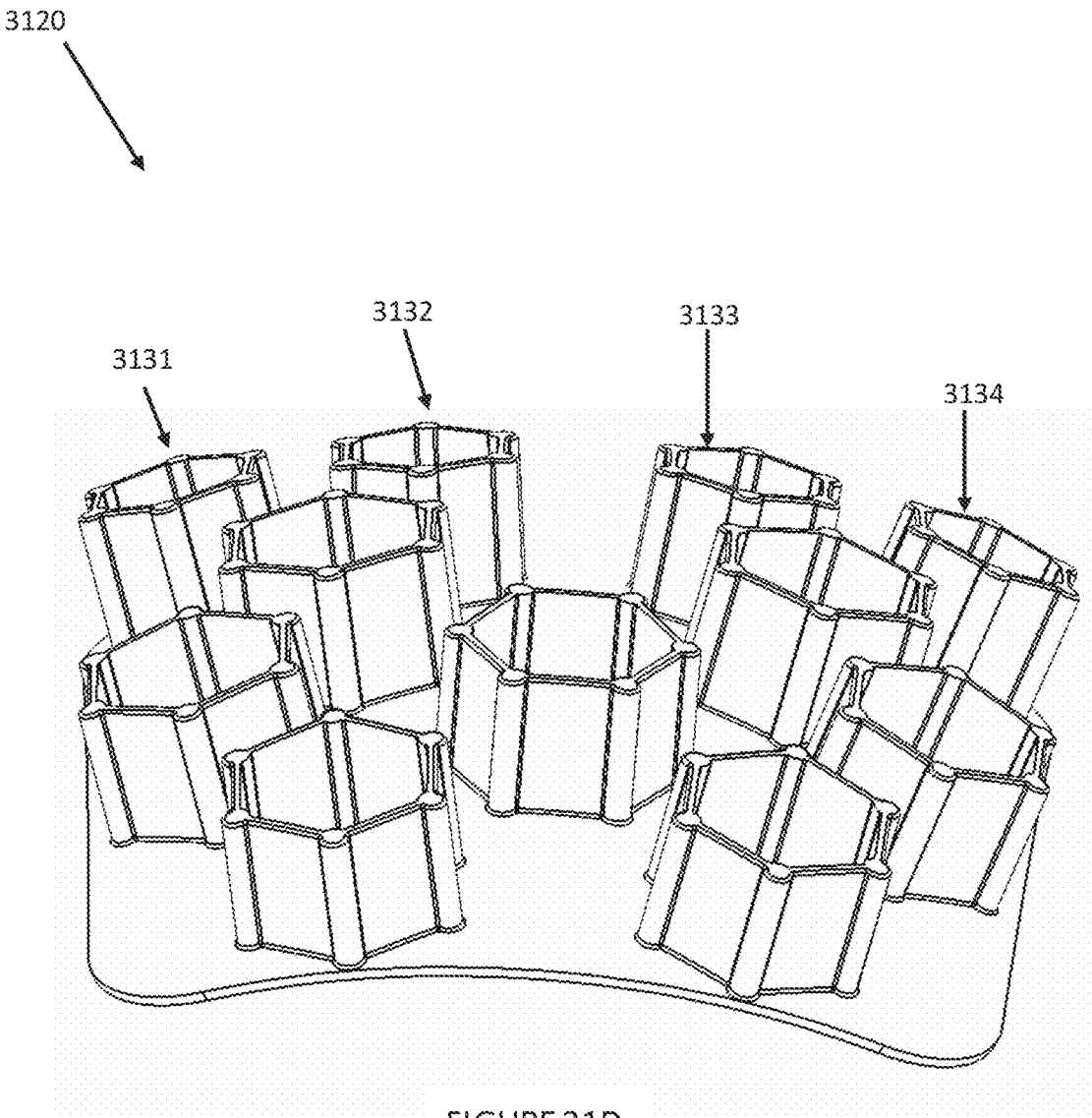

FIG. 31D depicts the peak array 3120, which comprises a generally rounded and/or hemispherical array of hexagonal elements, with each element aligned concentrically around a centroid of the array. This design is desirably selected to provide significant impact protection to the top of the wearer's head, as well as provide support for other impacts to other locations of the helmet.

Figure 31E:
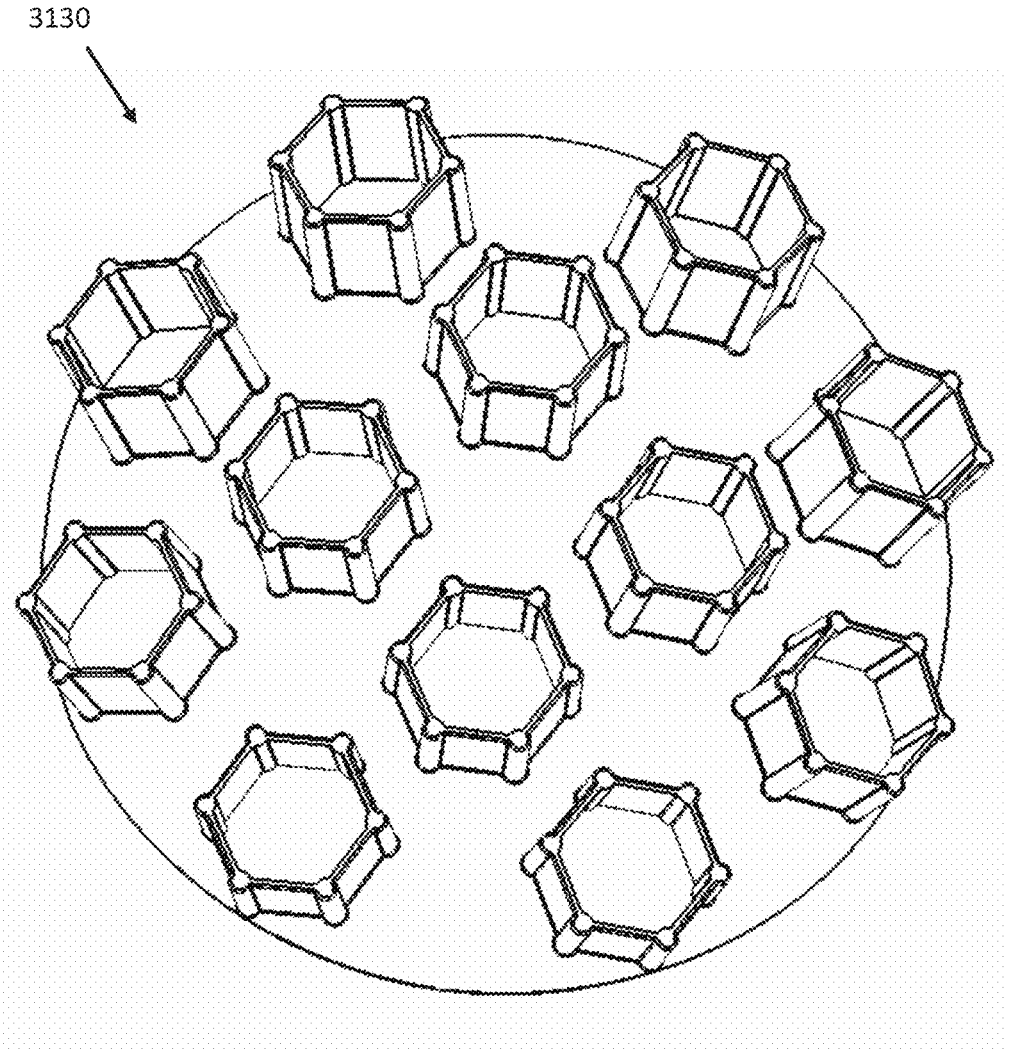

FIG. 31E depicts a back array 3130, in which a series of four smaller hexagonal units 3131, 3132, 3133 and 3134 are provided proximate to a rear edge 3160 of the helmet, with larger hexagonal units positioned higher on the array. This design and arrangement for the array desirably optimizes performance of this array during rearward impacts on the helmet, such as when the user may fall backwards and strike their back (and the back of their head) on snow, ice or other obstructions during snowboarding and/or skiing.

Retrofitting Existing Designs

In various embodiments, impact absorbing arrays incorporating open and/or closed polygonal elements can be retrofitted into an existing helmet design that may require a low offset, such as a protective military combat helmet and/or a sports snowboard helmet.

For military applications, it is often desirous for a protective helmet design to be optimized for protecting the wearer from impacts from small, high velocity objects such as bullets and shell fragments (i.e., moving objects hitting the user), as well as provide protection from "slower" impacts such as a user's fall from a vehicle. Military helmets typically include an extremely hard and durable outer shell, and the size of the helmet is desirably as close as possible to the size of the wearer's head (allowing for the presence of the cushioning and/or padding material between the wearer's skull and the helmet's inner surface).

The offset available for accommodating the impact absorbing layer in a military helmet can be relatively low, with offsets of less than 1 inch being common. In various embodiments, impact absorbing layers incorporating open and/or closed polygonal elements for military helmet applications can have offsets at or between 0.4 inches to 0.9 inches, with filament diameters of between 3 and 4 millimeters and lateral wall thicknesses of 1 millimeter or greater.

Figure 33:
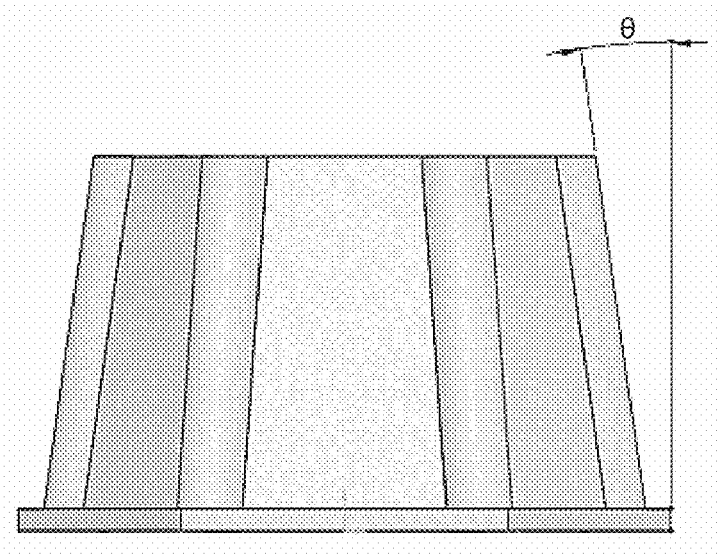
FIG. 33 depicts a front plan view of one exemplary embodiment of a tapered or frustum shaped hexagonal structure in a polymeric layer.

In at least one exemplary embodiment, a protective helmet for a military, law enforcement, combat and/or other application could comprise an array or pad comprising approximately 0.5 inches high hexagonal polymeric structures with an underlying 0.25 inch thick comfort layer of foam padding. The polymeric layer could be attached to a thin plastic face sheet (i.e., a lower face sheet) that could help distribute force to the comfort layer and/or the wearer's head. In this embodiment, the filament column diameter could range from 0.09 inches to 0.10 inches (inclusive), with a connecting wall thickness ranging from 0.03 inches to 0.05 inches (inclusive). The individual hexagonal structures in the polymeric layer could be tapered (see FIG. 33), such that the cross-section at the base (i.e., where the structure attaches to the face sheet) has a larger profile than the corresponding profile along a top section of the structure. In various embodiments, the taper angel 0 can be approximately 15 degrees, although in other alternative embodiments the taper angle could range from 0 degrees to 15 degrees (inclusive), while in still further embodiments the taper angle can range from 3 degrees to 5 degrees to 10 degrees to 20 degrees or greater (inclusive).

In various embodiments, a hexagonal structures will desirably incorporate upper ridges or flanges (see FIG. 27A) at the top of each hexagonal structure to aid in structural stability and/or increase stiffness of the structure (see also FIGS. 28F and 29A). The array or pad can desirably comprise thermoplastic and/or thermoset materials. If desired, thermoset materials can be utilized to meet and/or high-temperature requirements, as these types of materials are typically less sensitive to temperature effects.

In various embodiments, the individual hexagonal structures can be linked together with a face sheet, a perforated face sheet and/or a face sheet webbing the desirably provides flexibility to the pad as well as provides proper spacing of the filament structures. Where desired, the face sheet can provide a surface for adhering the pad structures to a thin plastic layer.

In various embodiments, the pads and/or structures therein can be molded, cast, extruded and/or otherwise manufactured in in a flat configuration, and then bent or otherwise flexed to matching and/or be attached to a curved surface such as a curved load-spreading layer and/or inner helmet surface, or otherwise manipulated to match helmet curvature. Alternatively, the pads and/or structures therein could be created in a curved or other configuration, and then flattened to accommodate a desired environment of use.

Figure 34:
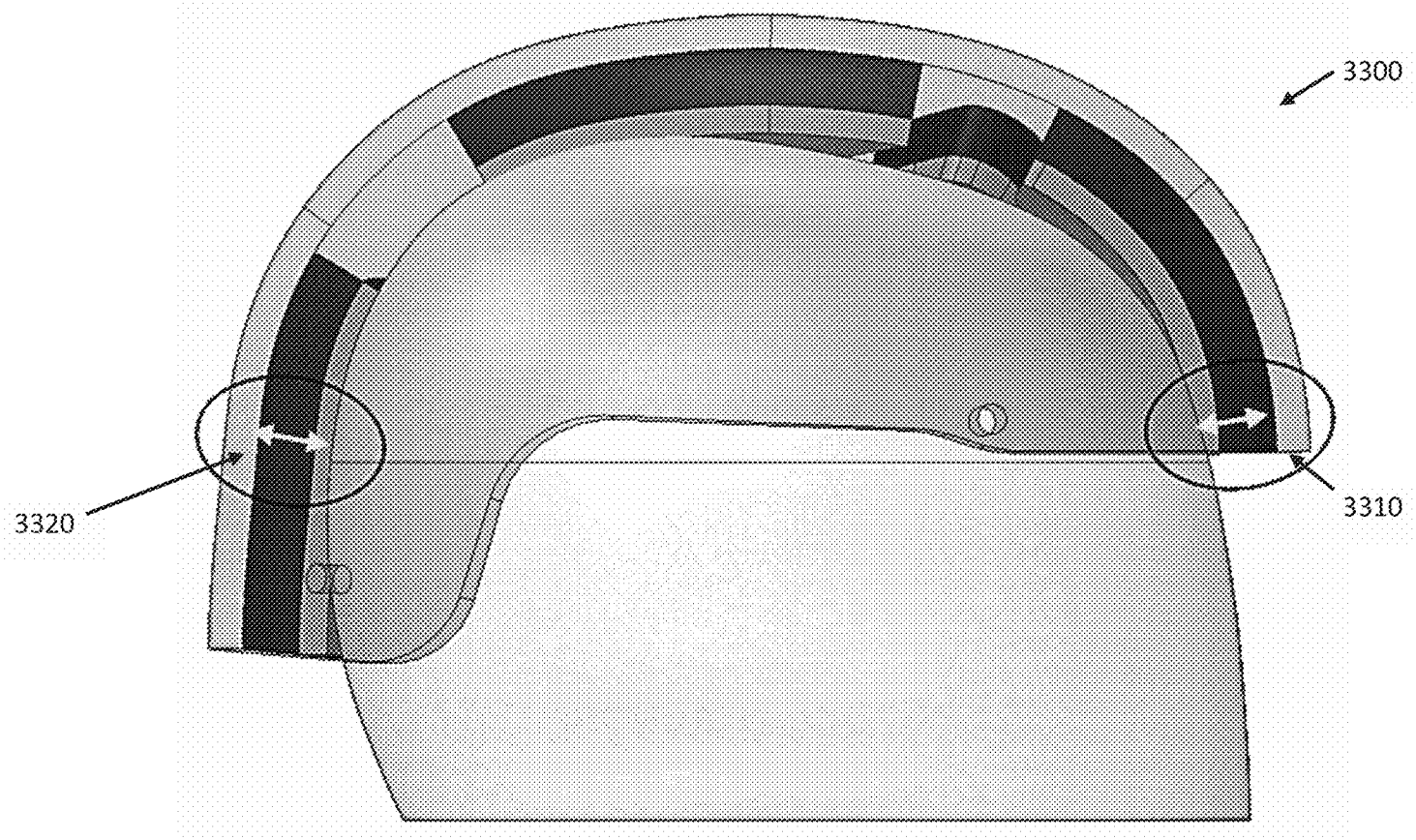
FIG. 34 depicts a cross-sectional side view of one exemplary embodiment of a military helmet incorporating various buckling structure arrays.

In various embodiments, the hexagonal structures can be spaced differently in different locations of the helmet or other protective clothing. For example, hexagonal structures can be spaced sparsely in various locations to maximize collapsibility of the pads, such as proximate to areas of lowest offset within the helmet (i.e., at the front edge of the helmet and/or near the rear and/or nape locations). In other areas of the helmet, including areas with higher available offsets, more densely packed hexagonal structures may be placed to desirably absorb and/or ameliorate impact forces to a greater degree. Desirably, the hexagonal structures can be strategically placed to match location-specific requirements, including anticipated impact zones and/or directions. For example, FIGS. 26F and 26G depict one exemplary embodiment of an array having three evenly spaced buckling structures along a left edge of the array, which could correspond to a front edge 3310 and/or rear portion 3320 or other edge of a helmet 3300 (see FIG. 34). For example, the three hexagonal structures of FIG. 26F could be positioned along the front edge 3310 of the helmet, with plenty of "dead space" or open areas between the structures to allow for significant deformation and/or collapse.

If desired, the comfort layer can comprise an open cell foam and/or a silicone foam. Desirably, silicone foams are less temperature sensitive than viscoelastic polyurethane foams, although both types of foams could be utilized for various applications.

For sports applications such as skiing and snowboarding, protective helmets are typically larger than their military counterparts, with the impact protection typically designed to protect a moving user from impact with stationary objects and/or other skiers. In addition, sport helmets are often very lightweight, so a replacement array design should also minimize additional weight for the helmet.

The offset available for accommodating the impact absorbing layer in a sports helmet can be 1 inch or greater, but offsets of less than 1 inch are increasingly common in some designs. In various embodiments, impact absorbing layers incorporating open and/or closed polygonal elements for sports applications can have offsets at or between 0.6 inches to 0.9 inches or greater, with filament diameters of between 3 and 4 millimeters and lateral wall thicknesses of 1 millimeter or greater. In various embodiments, the column diameter can range from 0.1 inch to 0.175 inches (inclusive) in some or all array elements and pads, with connecting wall thicknesses approximating 0.03 inches to 0.04 inches (inclusive). The individual hexagonal elements can be linked together using a face sheet webbing that is pierced, which desirably provides flexibility within the array as well as proper spacing of the structures. If desired, the face sheet and/or webbing could provide a surface for adhering pads or other components to a thin plastic layer. In various embodiments, one or more pads can be incorporated with the reflex player, with the pad(s) located and/or positioned within an expanded polystyrene foam (EPS) frame of varying density that lies adjacent to the pad structures.

In creating a replacement array, the existing liner from the commercially available helmet may be removed, allowing measurements to be recorded of the interior profile. All specifications (e.g., mechanical characteristics, behavioral characteristics, the impact zones, fit and/or aesthetics) may be considered in customizing a full array or a modular array. The full or modular array may be further assembled to incorporate foam padding to improve fit, rotation and/or absorption of sweat and skin oils. The full or modular array assembly can be permanently affixed or removably connected to be washable or easily replaced.

Although described throughout with respect to a helmet or similar item, the impact absorbing structures described herein may be applied with other garments such as padding, braces, and protectors for various joints and bones, as well as non-protective garment and non-garment applications.

While many of the embodiments are described herein as constructed of polymers or other plastic and/or clastic materials, it should be understood that any materials known in the art could be used for any of the devices, systems and/or methods described in the foregoing embodiments, for example including, but not limited to metal, metal alloys, combinations of metals, plastic, polyethylene, ceramics, cross-linked polyethylene's or polymers or plastics, and natural or man-made materials. In addition, the various materials disclosed herein could comprise composite materials, as well as coatings thereon.

Additional Configuration Considerations

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure. The invention may be embodied in other specific forms without departing from the spirit or essential characteristics thereof. The foregoing embodiments are therefore to be considered in all respects illustrative rather than limiting on the invention described herein. The scope of the invention is thus intended to include all changes that come within the meaning and range of equivalency of the descriptions provided herein.

Many of the aspects and advantages of the present invention may be more clearly understood and appreciated by reference to the accompanying drawings. The accompanying drawings are incorporated herein and form a part of the specification, illustrating embodiments of the present invention and together with the description, disclose the principles of the invention. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the disclosure herein.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosed embodiments are intended to be illustrative, but not limiting, of the scope of the disclosure.

INCORPORATION BY REFERENCE

The entire disclosure of each of the publications, patent documents, and other references referred to herein is incorporated herein by reference in its entirety for all purposes to the same extent as if each individual source were individually denoted as being incorporated by reference.

What is claimed is:

1. A helmet comprising:

an outer shell; and an impact absorbing layer comprising a plurality of impact absorbing structures of polyurethane material positioned inside the outer shell, wherein at least a portion of the outer shell is flexible to transmit an impact force to a localized section of the plurality of impact absorbing structures positioned inside the outer shell, wherein one or more of the plurality of impact absorbing structures comprise a plurality of filaments including at least three intersecting filaments connected at an intermediate point between a respective first end of each filament of the at least three intersecting filaments and a respective second end of each filament of the at least three intersecting filaments, the intermediate point comprising a node between an inner surface of the outer shell and an outer surface of a wearer's head, wherein:

at least two of the at least three intersecting filaments are oblique to the inner surface of the outer shell;

the respective first end of each filament of the at least two of the at least three intersecting filaments is proximate the inner surface of the outer shell; and the at least two of the intersecting filaments are capable of buckling and absorbing energy when subjected to the impact force.

2. The helmet of claim 1, wherein the one or more of the plurality of impact absorbing structures rebound to an undeformed shape once the impact force is removed.

3. The helmet of claim 1, further comprising a foam layer interior to the impact absorbing layer, wherein the foam layer comprises a foam pad.

4. The helmet of claim 1, wherein the impact absorbing layer is positioned proximate to the inner surface of the outer shell.

5. The helmet of claim 1, wherein an attachment angle between the at least two of the intersecting filaments at the intermediate point is less than 90 degrees.

6. The helmet of claim 1, wherein:

longitudinal axes of the at least two of the intersecting filaments are oblique to the inner surface of the outer shell at the respective end proximate the inner surface of the outer shell; and an attachment angle between the longitudinal axes of the at least two of the intersecting filaments at the intermediate point is less than 90 degrees.

7. The helmet of claim 1, wherein the at least three intersecting filaments connect the intermediate point to faces of an enclosing polyhedron.

8. The helmet of claim 1, further comprising a face sheet proximate the respective ends of the at least two of the intersecting filaments.

9. The helmet of claim 8, wherein the face sheet joins the respective ends of the at least two of the intersecting filaments.

10. The helmet of claim 9, wherein the face sheet and the plurality of filaments comprise the same material.

11. The helmet of claim 8, wherein:

longitudinal axes of the at least two of the intersecting filaments are oblique to the inner surface of the outer shell at the respective end proximate the inner surface of the outer shell; and an attachment angle between the longitudinal axes of the at least two of the intersecting filaments at the intermediate point is less than 90 degrees.

12. The helmet of claim 11, further comprising a second face sheet proximate opposing ends of the at least two of the intersecting filaments, wherein:

the second face sheet joins the opposing ends of the at least two of the intersecting filaments; and the second face sheet and the plurality of filaments comprise the same material.

13. The helmet of claim 1, further comprising a face sheet proximate opposing ends of the at least two of the intersecting filaments proximate the outer surface of the wearer's head, wherein the face sheet joins the opposing ends of the at least two of the intersecting filaments and the face sheet and the plurality of filaments comprise the same material.

14. The helmet of claim 13, further comprising a foam layer interior to the impact absorbing layer, wherein the foam layer is disposed between the face sheet and a wearer.

15. The helmet of claim 14, wherein the one or more of the plurality of impact absorbing structures are mechanically secured to the inner surface of the outer shell by a press fit.

16. A helmet comprising:

an outer shell; and an impact absorbing layer comprising a plurality of impact absorbing structures of polyurethane material positioned inside the outer shell, wherein at least a portion of the outer shell is flexible to transmit an impact force to a localized section of the plurality of impact absorbing structures positioned inside the outer shell, wherein one or more of the plurality of impact absorbing structures comprise a plurality of filaments including a first filament, a second filament, and a third filament connected at an intermediate point between a respective first end of each filament of the first filament, the second filament and the third filament and a respective second end of each filament of the first filament, the second filament and the third filament, the intermediate point comprising a node between an inner surface of the outer shell and an outer surface of a wearer's head, wherein:

at least two of the first filament, the second filament and the third filament are oblique to the inner surface of the outer shell;

the respective first end of each filament of the at least two of the first filament, the second filament and the third filament is proximate the inner surface of the outer shell and the at least two of the first filament, the second filament and the third filament are capable of buckling and absorbing energy when subjected to the impact force;

the first filament, the second filament and the third filament are joined at an angle between 30 degrees and 120 degrees; and the one or more of the plurality of impact absorbing structures rebound to an undeformed shape once the impact force is removed.

17. The helmet of claim 16, further comprising a foam layer interior to the impact absorbing layer, wherein the foam layer comprises a foam pad.

18. The helmet of claim 16, wherein the impact absorbing layer is positioned proximate to the inner surface of the outer shell.

19. The helmet of claim 18, wherein the impact absorbing layer is mechanically secured to the inner surface of the outer shell.

20. The helmet of claim 19, wherein the one or more of the plurality of impact absorbing structures is mechanically secured to the inner surface of the outer shell by a press fit.

21. A helmet comprising:

an outer shell having a curved interior surface; and an impact absorbing layer including a plurality of modular impact absorbing arrays positioned inside the outer shell, wherein at least a portion of the outer shell is flexible to transmit an impact force to a localized section of the impact absorbing layer positioned inside the outer shell, wherein each modular impact absorbing array of the plurality of modular impact absorbing arrays includes a concentric outer surface proximate the curved interior surface, a concentric inner surface, and an impact absorbing structure between the concentric outer surface and the concentric inner surface of the respective modular impact absorbing array, the impact absorbing structure comprising at least three intersecting structures of polyurethane material, wherein:

the at least three intersecting structures include a first structure, a second structure and a third structure;

the first structure, the second structure and the third structure each have a respective first end proximate the concentric outer surface and a respective second end proximate the concentric inner surface;

the first structure, the second structure and the third structure are connected at an intermediate point between the respective first end of each structure of the first structure, the second structure and the third structure and the respective second end of each structure of the first structure, the second structure and the third structure, the intermediate point comprising a node between the curved interior surface of the outer shell and an outer surface of a wearer's head; and at least two of the first structure, the second structure and the third structure are oblique to the curved interior surface of the outer shell.

22. The helmet of claim 21, further comprising a foam layer interior to the impact absorbing layer, wherein:

the respective first end of each structure of the at least two of the first structure, the second structure and the third structure is secured to the concentric outer surface as a result of integral formation; and the respective second end of each structure of the at least two of the first structure, the second structure and the third structure is secured to the concentric inner surface as a result of integral formation.

* * * * *